US012653363B2

(12) United States Patent
Wie et al.

(10) Patent No.: US 12,653,363 B2
(45) Date of Patent: Jun. 16, 2026

(54) CLEANER STATION AND METHOD OF CONTROLLING THE SAME

(71) Applicant: LG ELECTRONICS INC., Seoul (KR)

(72) Inventors: Jeahyuk Wie, Seoul (KR); Sungjun Kim, Seoul (KR); Ingyu Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 690 days.

(21) Appl. No.: 18/010,029

(22) PCT Filed: Jun. 10, 2021

(86) PCT No.: PCT/KR2021/007253
§ 371 (c)(1),
(2) Date: Jul. 7, 2023

(87) PCT Pub. No.: WO2021/261811
PCT Pub. Date: Dec. 30, 2021

(65) Prior Publication Data

US 2023/0346185 A1 Nov. 2, 2023

(30) Foreign Application Priority Data

Jun. 22, 2020 (KR) ..... 10-2020-0075901

(51) Int. Cl.
*A47L 9/28* (2006.01)
*A47L 9/10* (2006.01)

(52) U.S. Cl.
CPC ..... *A47L 9/2873* (2013.01); *A47L 9/108* (2013.01); *A47L 9/2805* (2013.01); (Continued)

(58) Field of Classification Search
CPC ..... A47L 9/2873; A47L 9/108; A47L 9/2805; A47L 9/2842; A47L 2201/022; A47L 2201/024
See application file for complete search history.

(56) References Cited

U.S. PATENT DOCUMENTS 10,595,692 B2 3/2020 Morin et al.
2012/0291809 A1* 11/2012 Kuhe ..... A47L 11/33 134/18

(Continued)

FOREIGN PATENT DOCUMENTS

CN 105708389 6/2016
CN 106175594 12/2016

(Continued)

OTHER PUBLICATIONS

KR20070012109A(machine translation) (Year: 2007).*

(Continued)

*Primary Examiner* — Andrew A Horton
(74) *Attorney, Agent, or Firm* — KED & ASSOCIATES, LLP

(57) ABSTRACT

The present disclosure relates to a cleaner station and a method of controlling the same, the method including: a dust bin fixing step of holding and fixing, by a fixing member of the cleaner station, a dust bin of a cleaner when the cleaner is coupled to the cleaner station; a door opening step of opening a door of the cleaner station when the dust bin is fixed; a cover opening step of opening a discharge cover configured to open or close the dust bin when the door is opened; and a dust collecting step of collecting dust in the dust bin by operating a dust collecting motor of the cleaner station when the discharge cover is opened.

20 Claims, 23 Drawing Sheets

(52) U.S. Cl.
CPC ..... *A47L 9/2842* (2013.01); *A47L 2201/022* (2013.01); *A47L 2201/024* (2013.01)

(56) References Cited

U.S. PATENT DOCUMENTS

| | | | |
|---|---|---|---|
| 2018/0125314 | A1 | 5/2018 | Kim et al. |
| 2020/0022553 | A1 | 1/2020 | Gill et al. |
| 2020/0129025 | A1 | 4/2020 | Zhong et al. |

FOREIGN PATENT DOCUMENTS

| | | | | | |
|---|---|---|---|---|---|
| CN | 209391859 | | | 9/2019 | |
| DE | 10-2017-126393 | | | 5/2019 | |
| EP | 3524115 | | | 8/2019 | |
| EP | 3563745 | | | 11/2019 | |
| JP | 2016-116850 | | | 6/2016 | |
| JP | 2016-116852 | | | 6/2016 | |
| JP | 2017-189453 | | | 10/2017 | |
| JP | 2019-005068 | | | 1/2019 | |
| KR | 20070012109 | A | * | 1/2007 | ..... A47L 9/2873 |
| KR | 10-2007-0099763 | | | 10/2007 | |
| KR | 2007-0103248 | | | 10/2007 | |
| KR | 10-2017-0126377 | | | 11/2017 | |
| KR | 10-2019-0119147 | | | 10/2019 | |
| KR | 10-2020-0037199 | | | 4/2020 | |
| WO | WO 2015/070322 | | | 5/2015 | |
| WO | WO 2020/091360 | | | 5/2020 | |
| WO | WO 2020/122631 | | | 6/2020 | |

OTHER PUBLICATIONS

KR20200037199A(machine translation) (Year: 2020).*
Extended European Search Report dated Nov. 11, 2024 issued in Application No. 21827883.6.
Korean Office Action dated Nov. 13, 2023 issued in Application No. 10-2022-0069933.
International Search Report dated Sep. 27, 2021 issued in Application No. PCT/KR2021/007253.
Australian Office Action dated Feb. 15, 2024 issued in Application No. 2021297503.
Korean Office Action dated Mar. 7, 2024 issued in Application No. 10-2022-7025899.
Chinese Office Action dated Dec. 29, 2025 issued in Application No. 202180044246.7.

* cited by examiner

[FIG. 1]
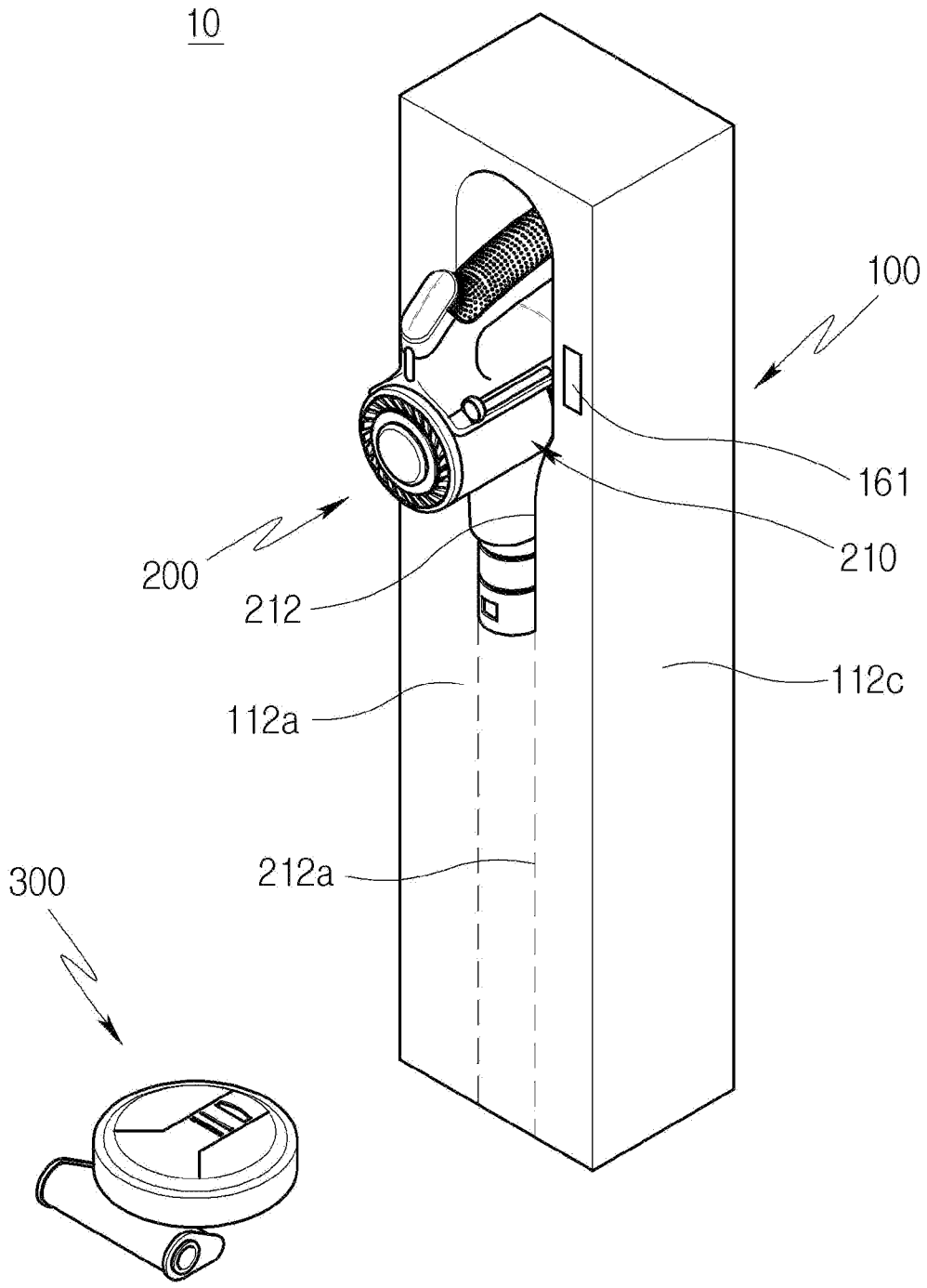

[FIG. 2]
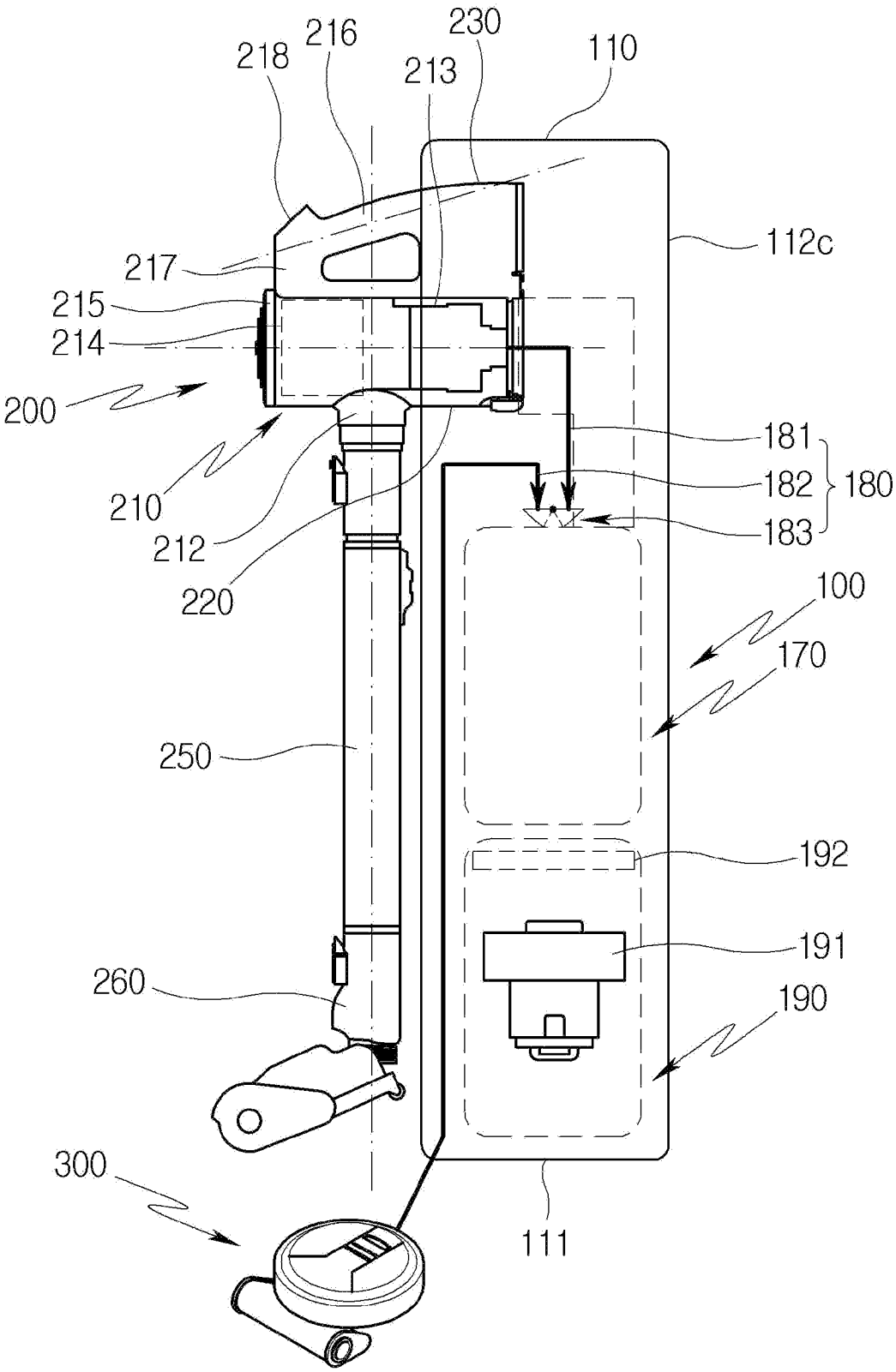

[FIG. 3]
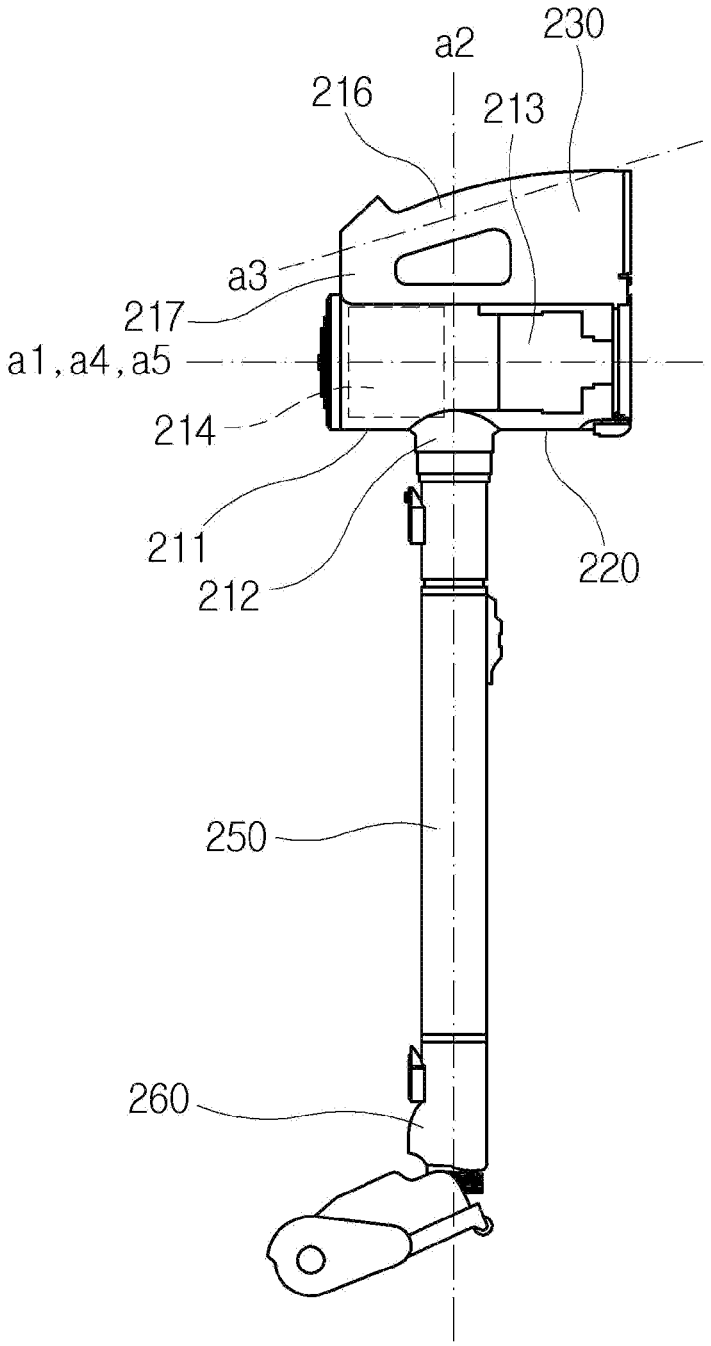

[FIG. 4]
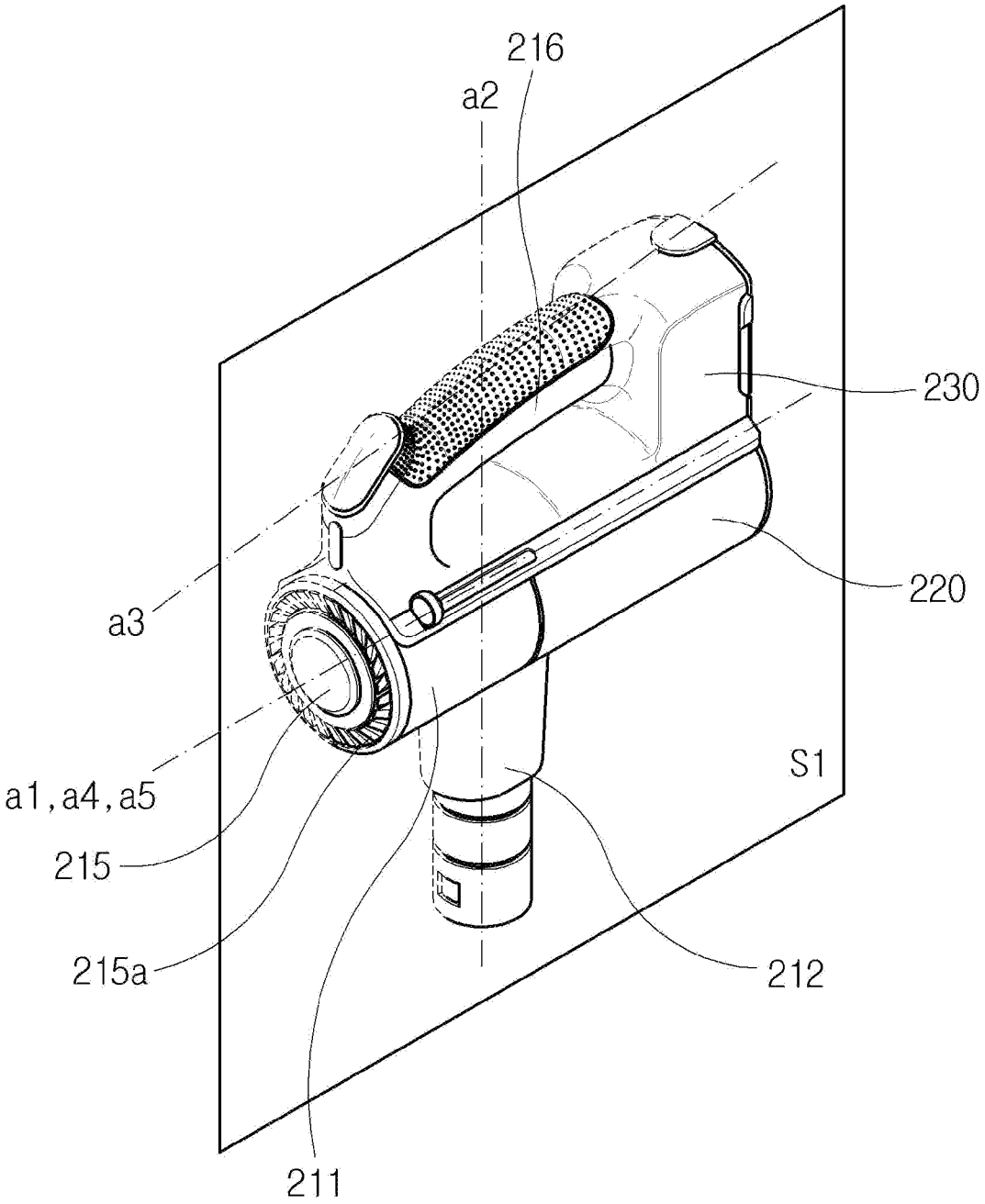

[FIG. 5]
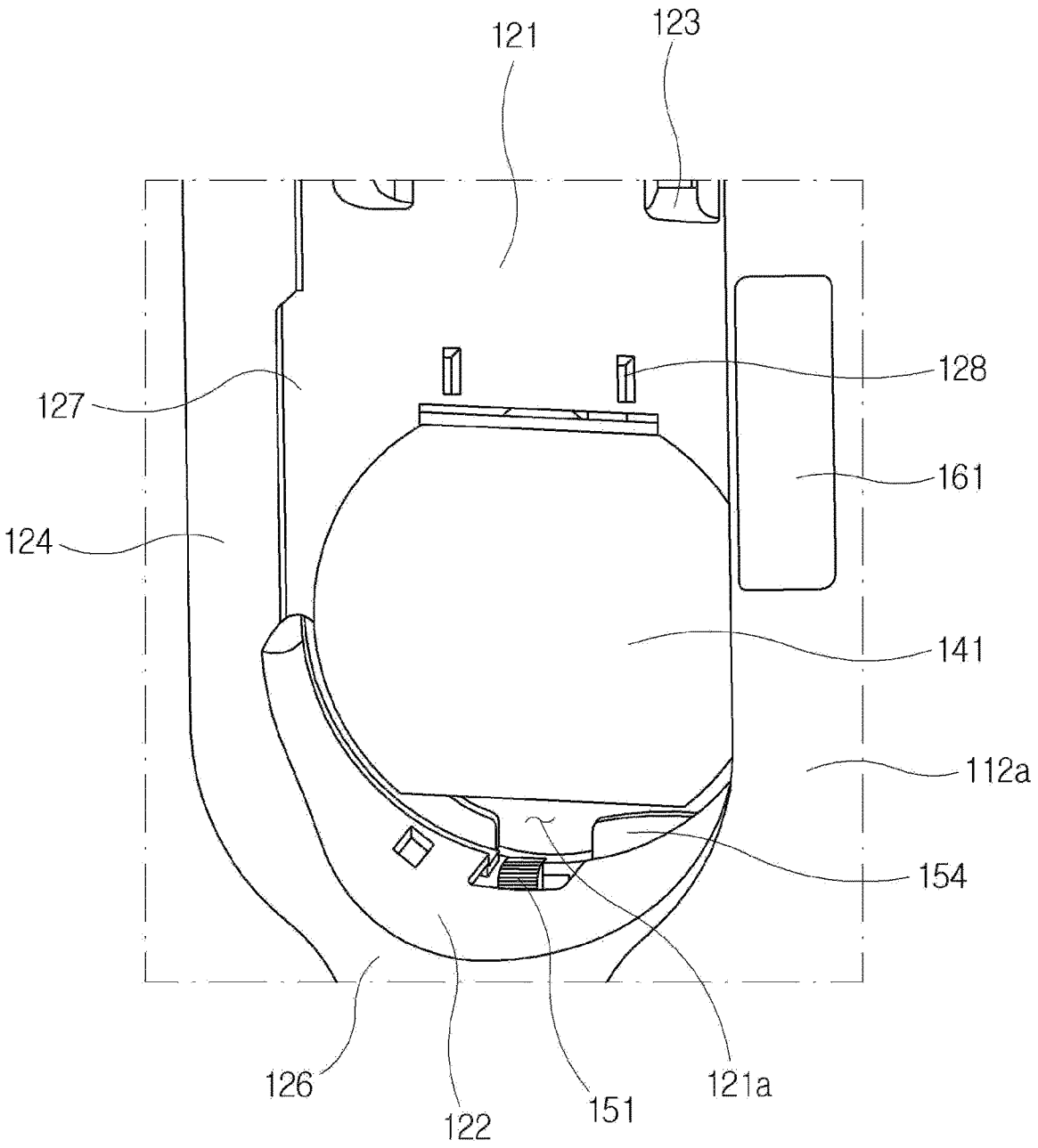

[FIG. 6]
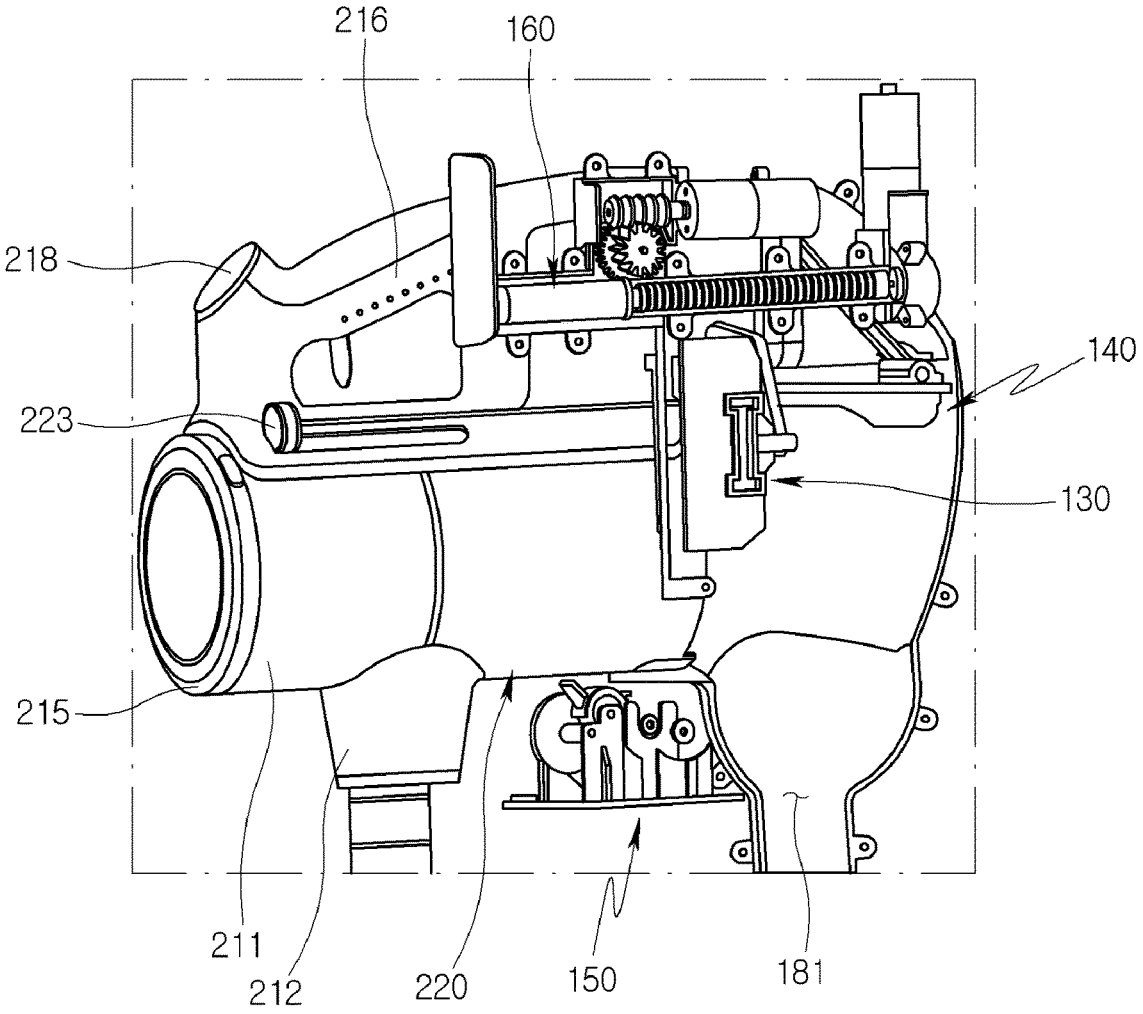

[FIG. 7]
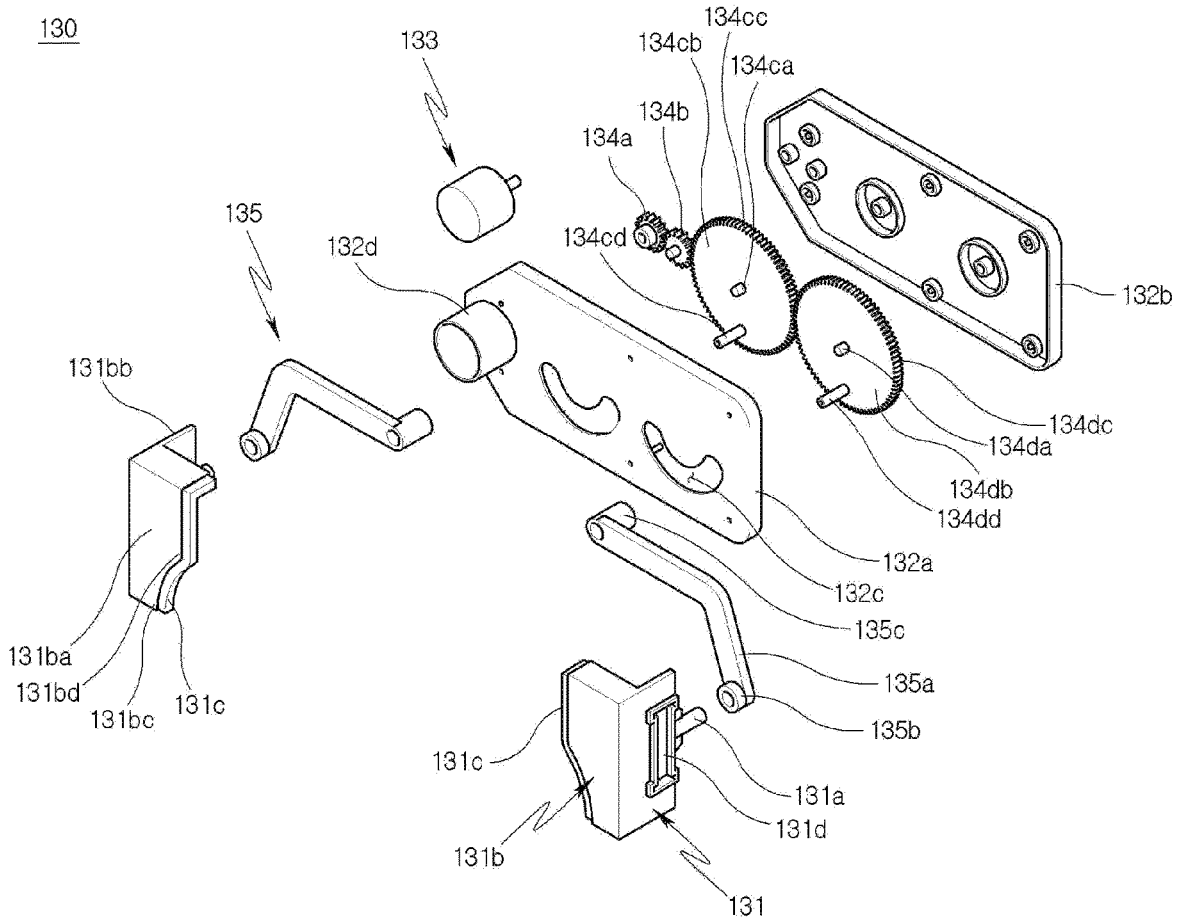

[FIG. 8]
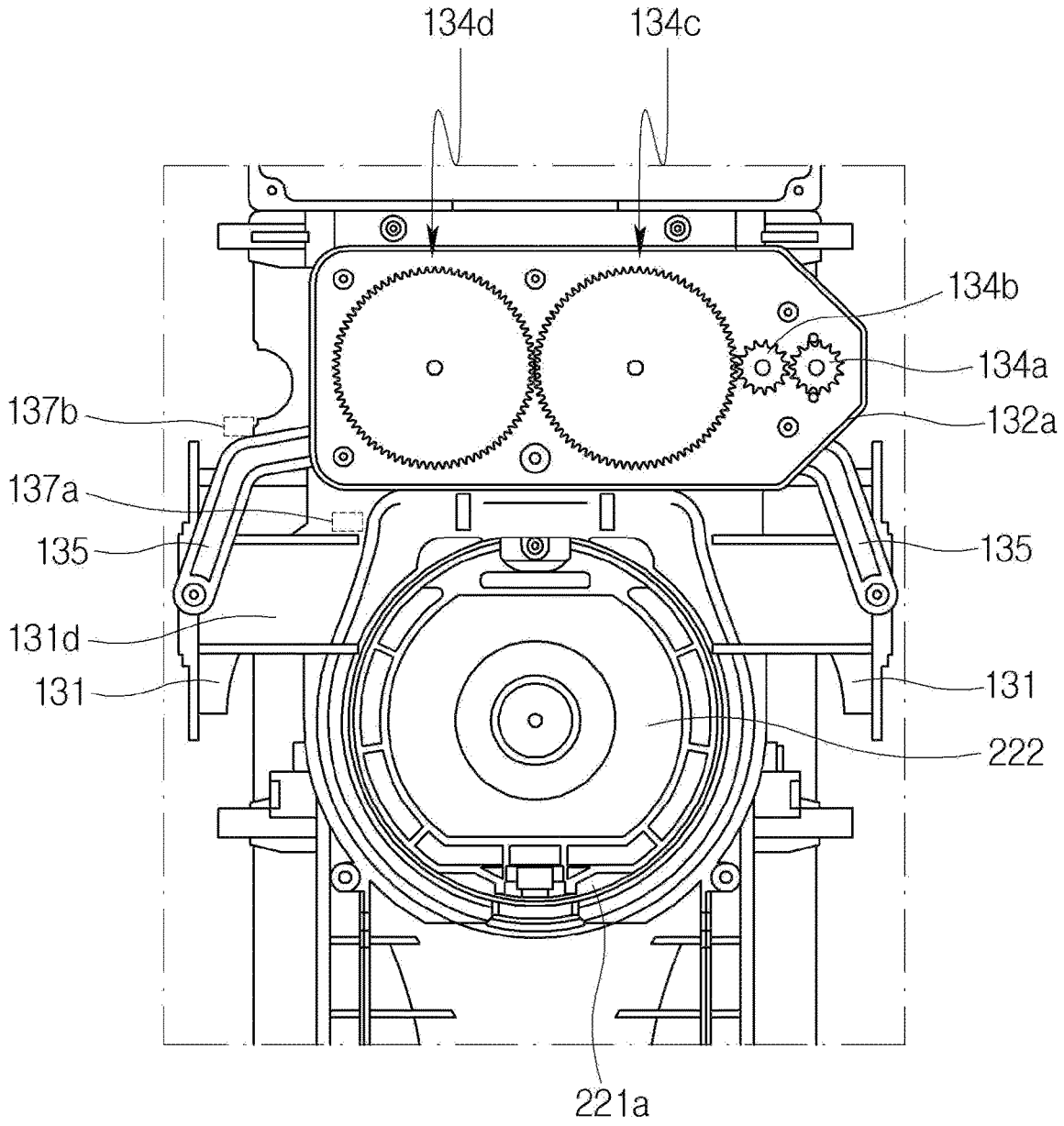

[FIG. 9]
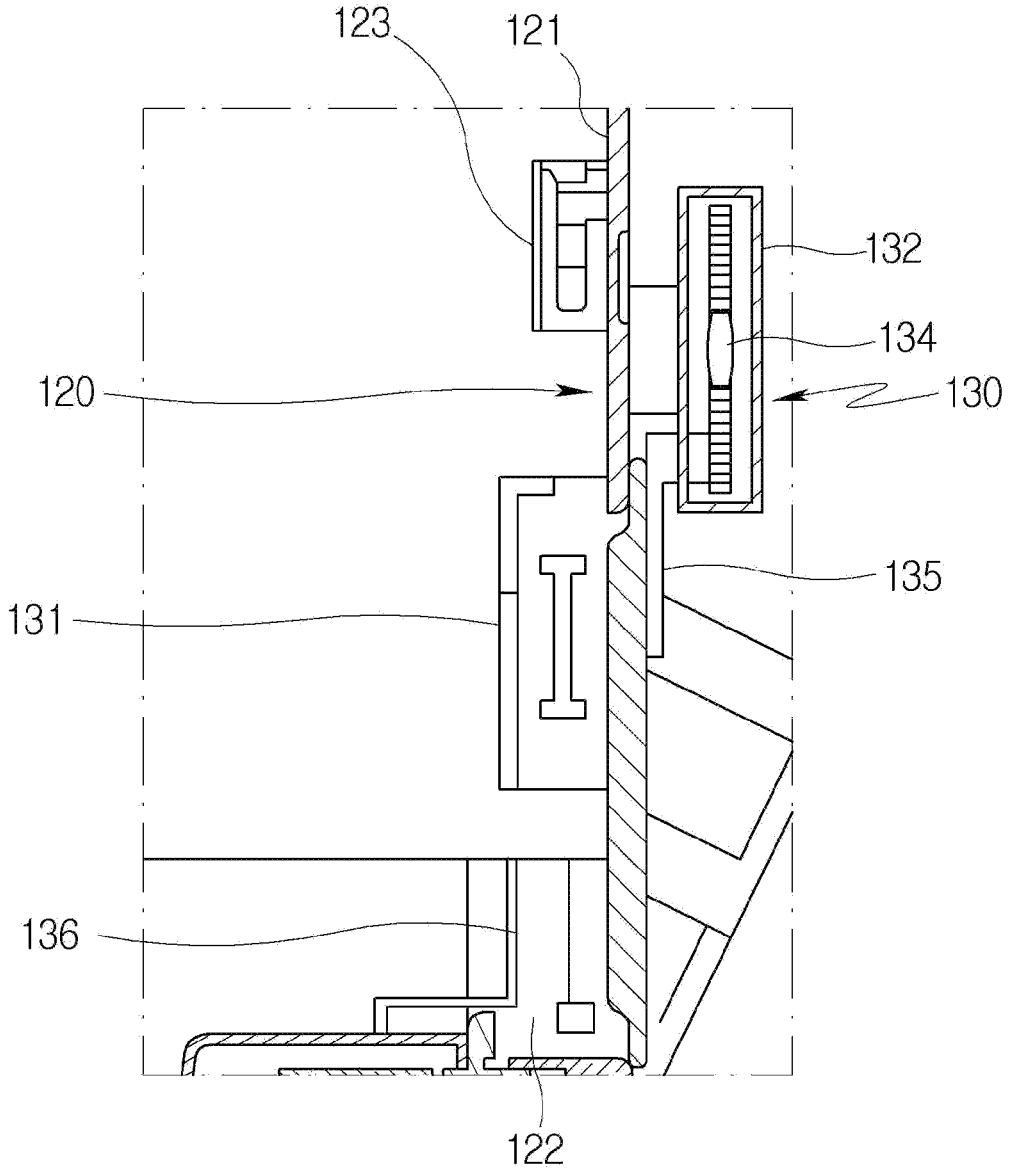

[FIG. 9A]
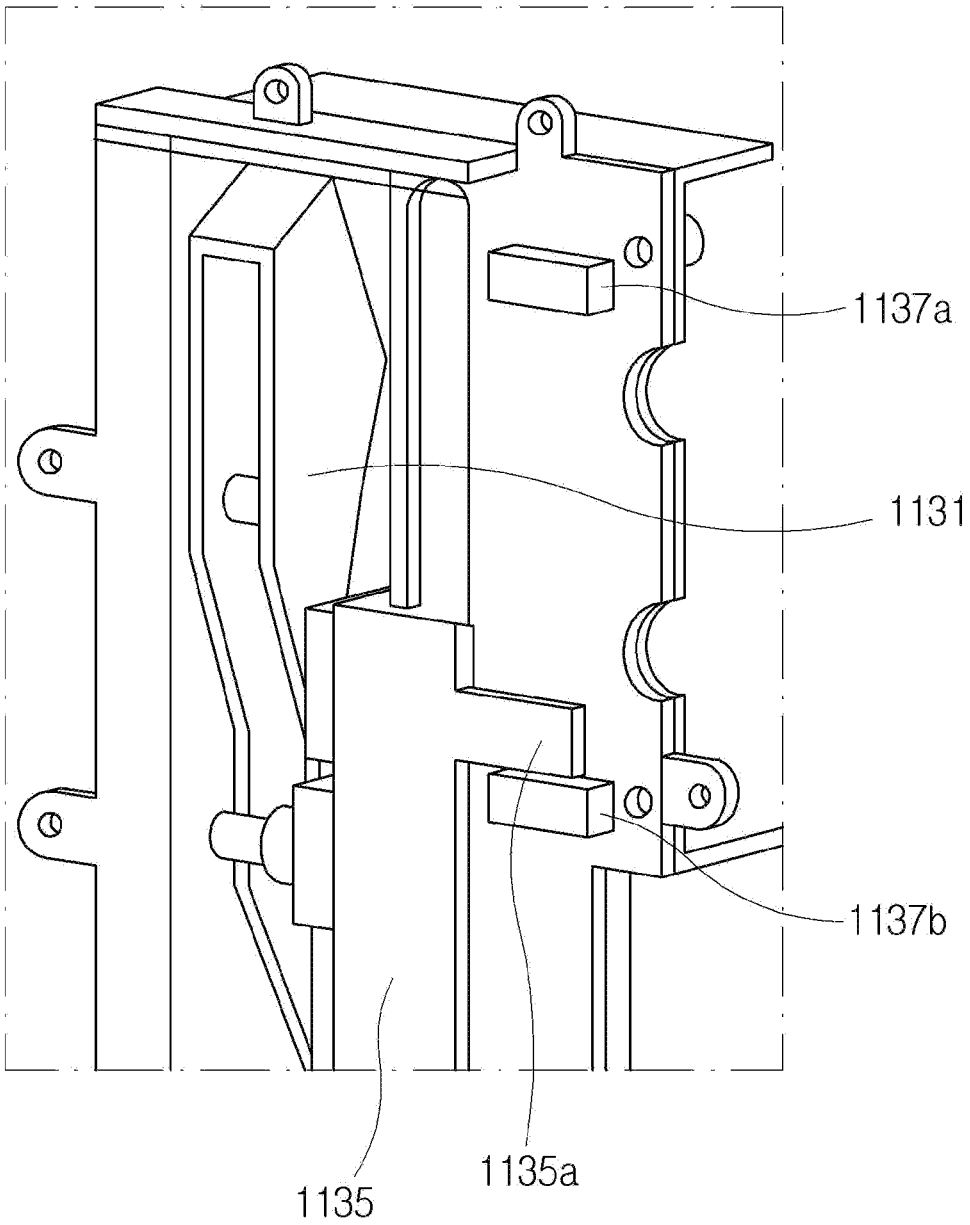

[FIG. 10]
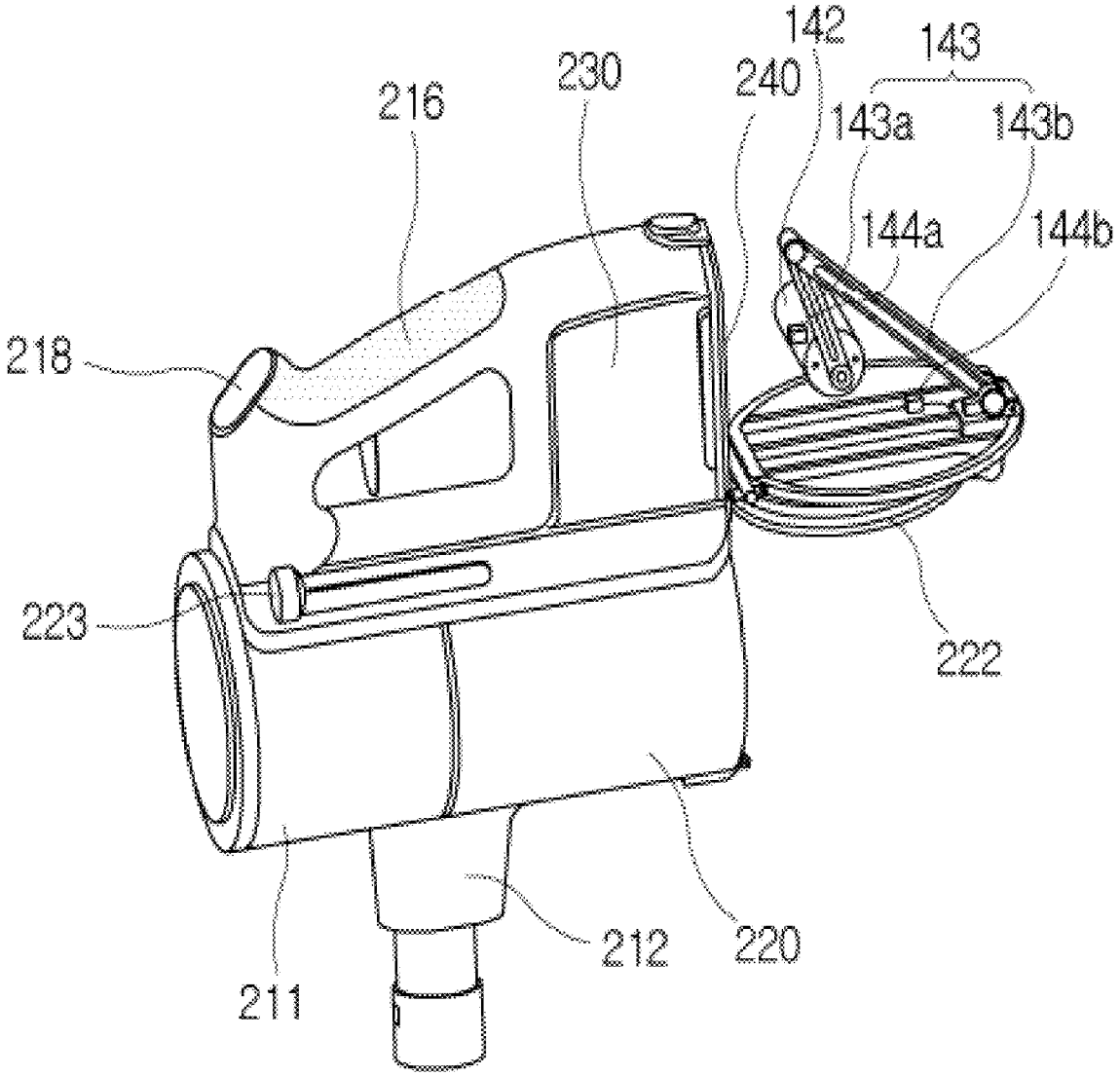

[FIG. 11]
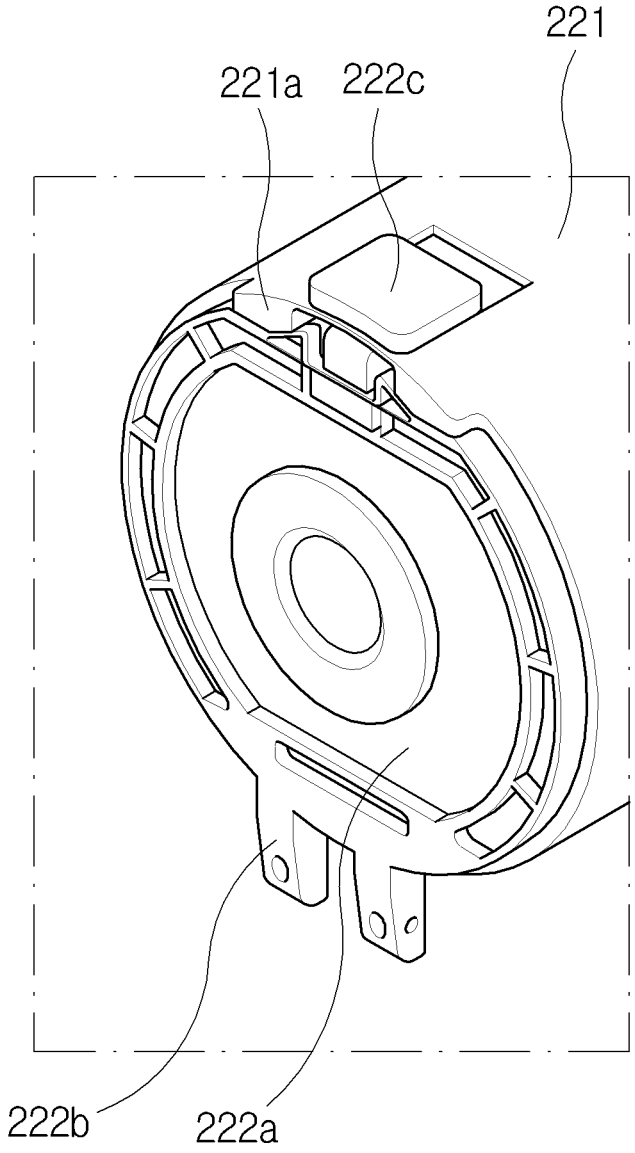

[FIG. 12]
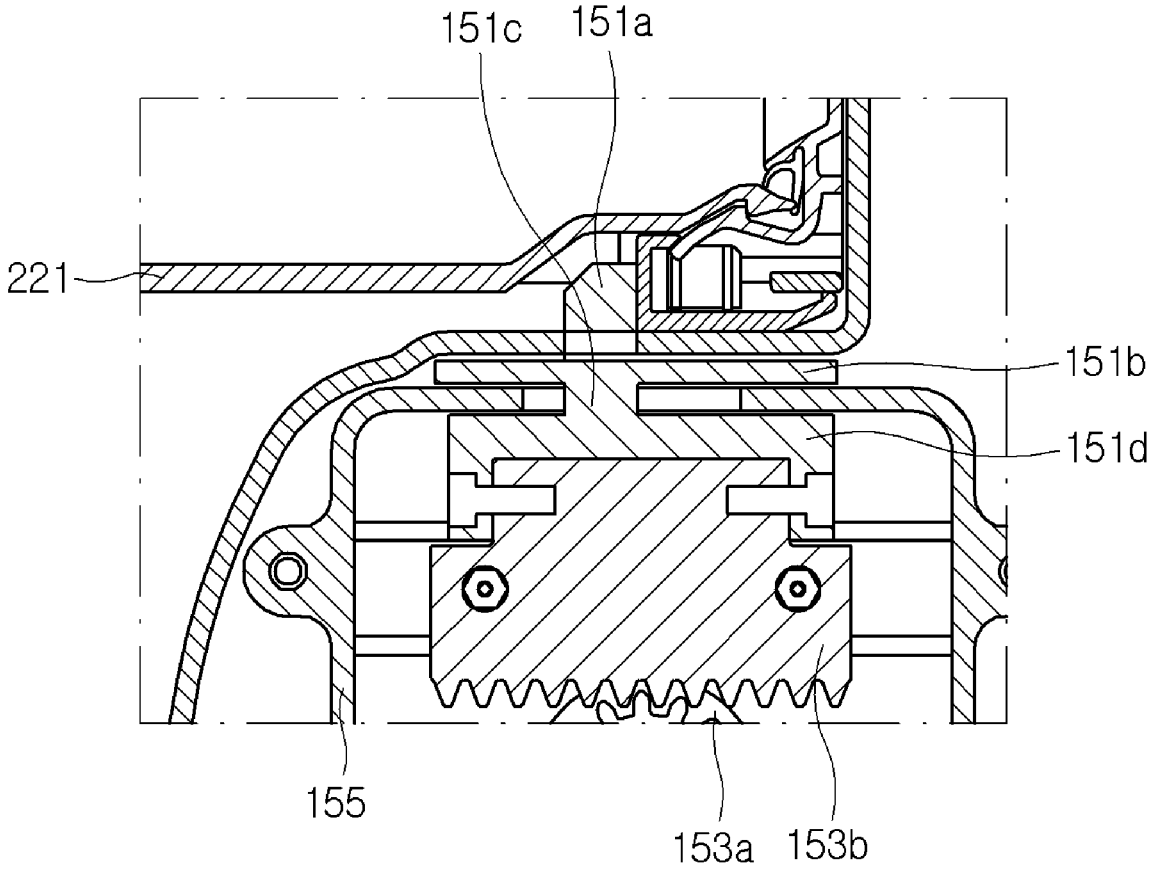

[FIG. 13]
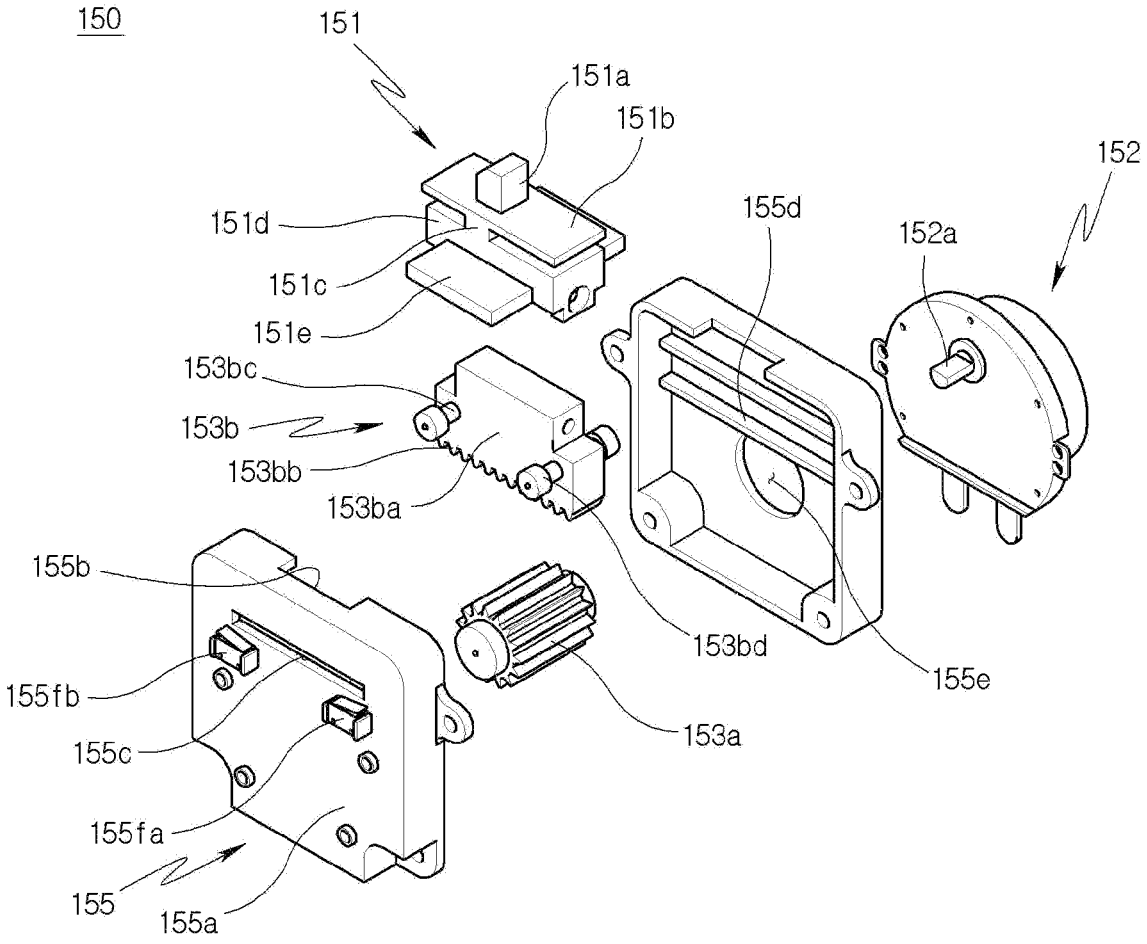

[FIG. 14]
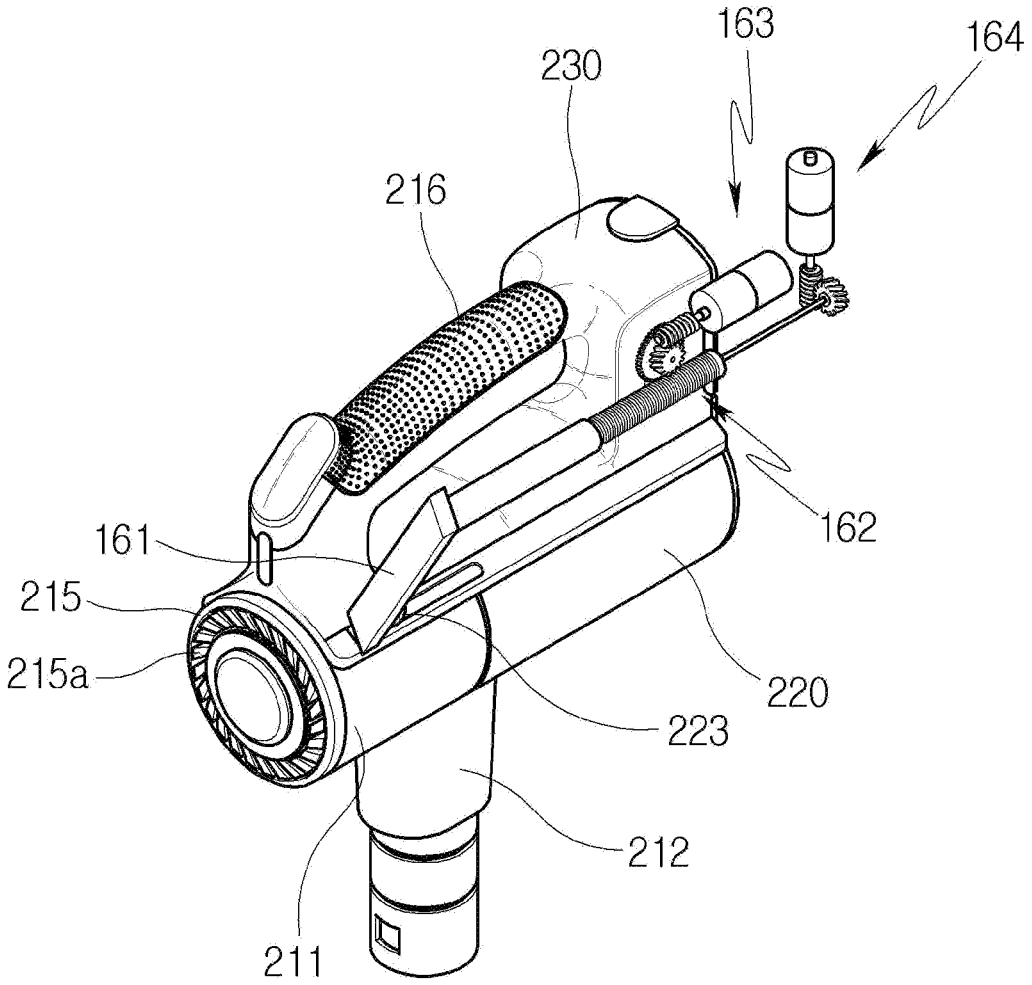

[FIG. 14A]
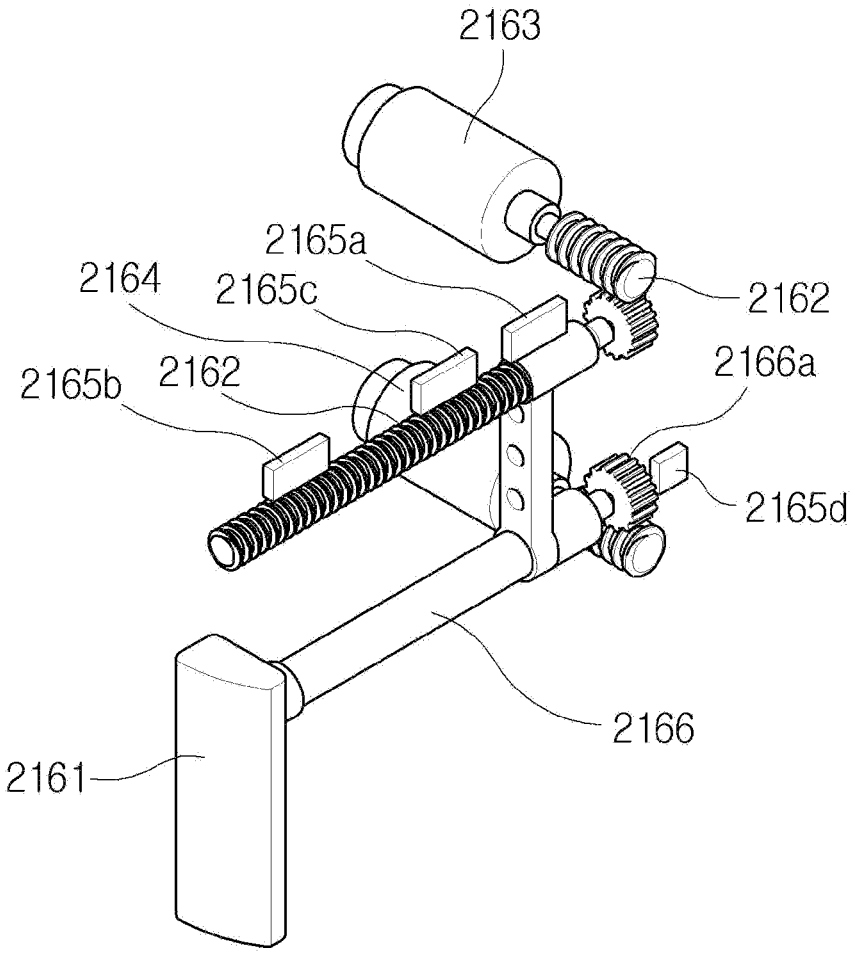

[FIG. 15]
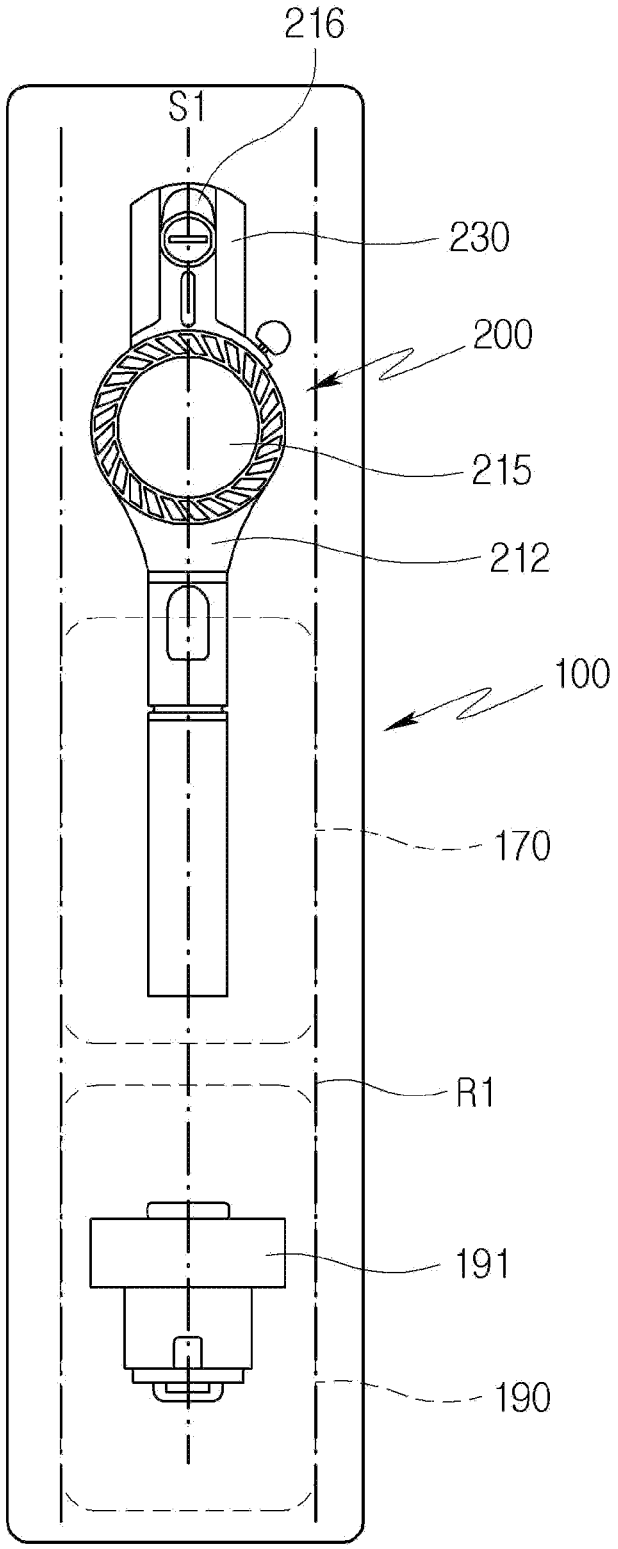

[FIG. 16]
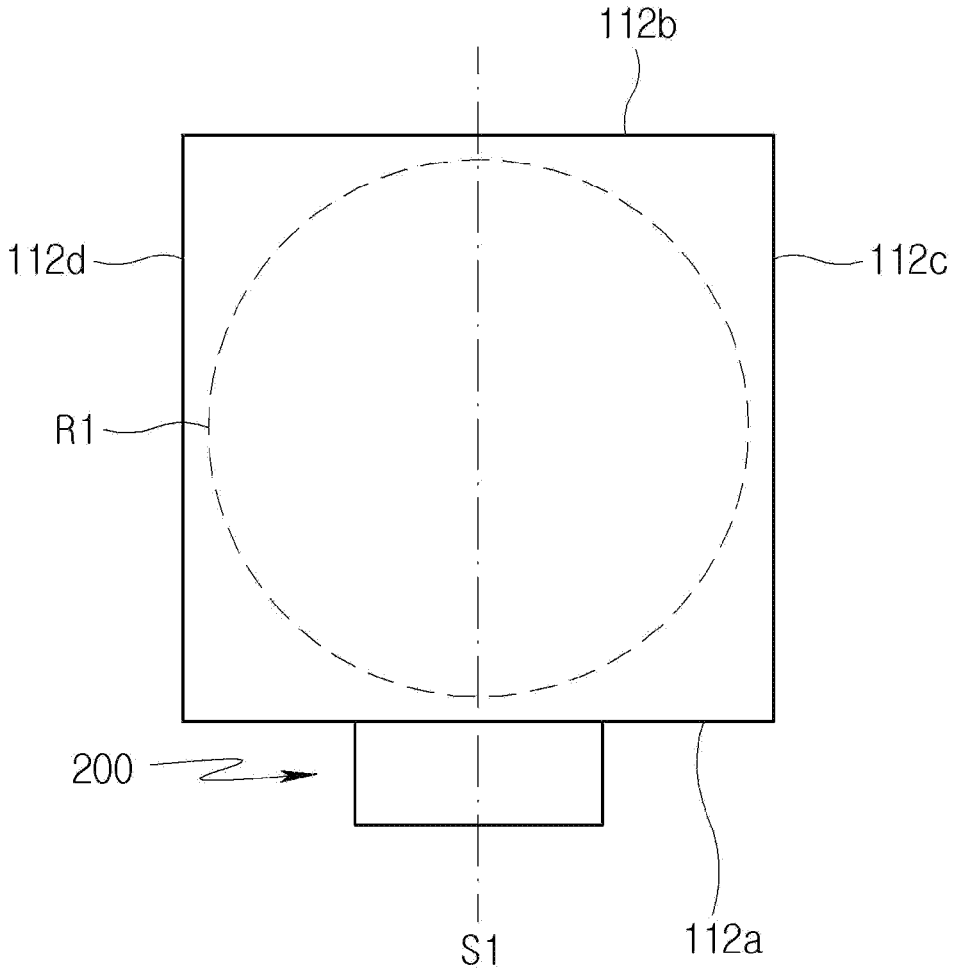

[FIG. 17]
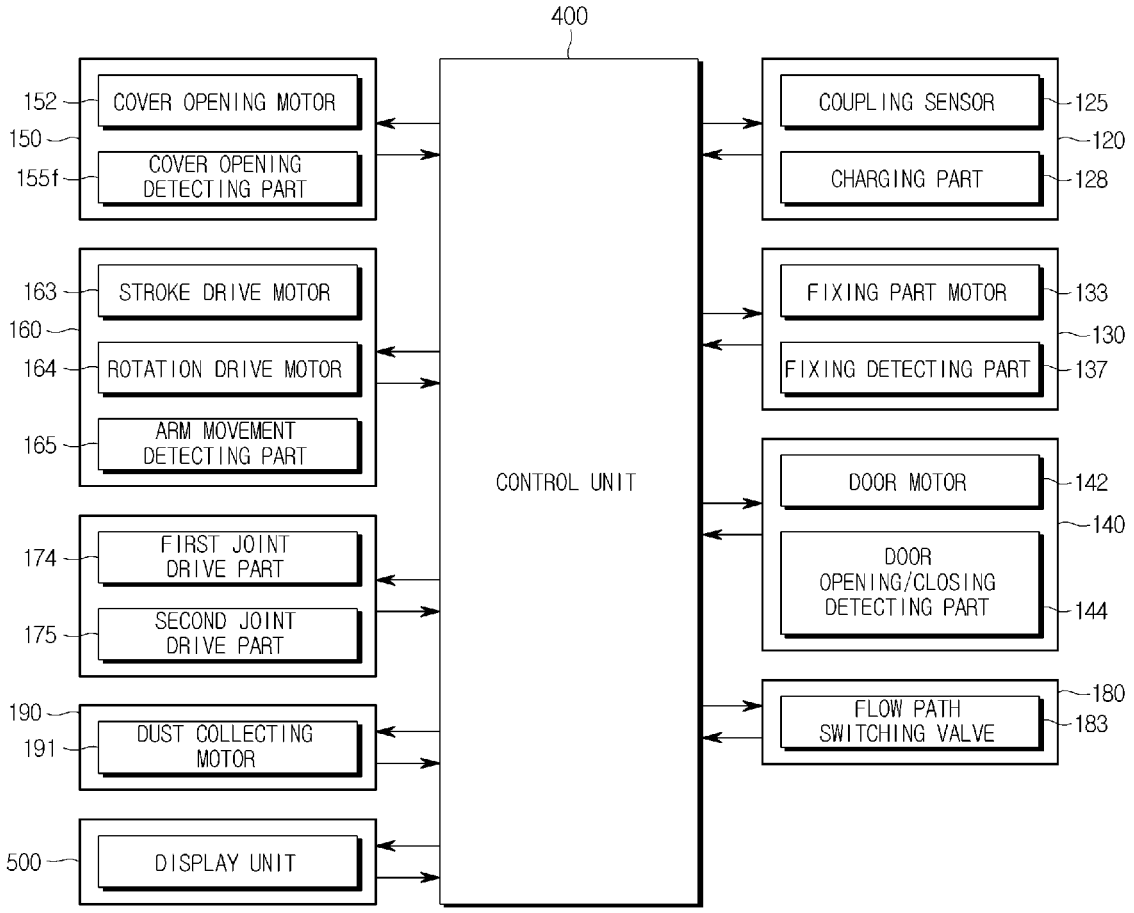

[FIG. 18]
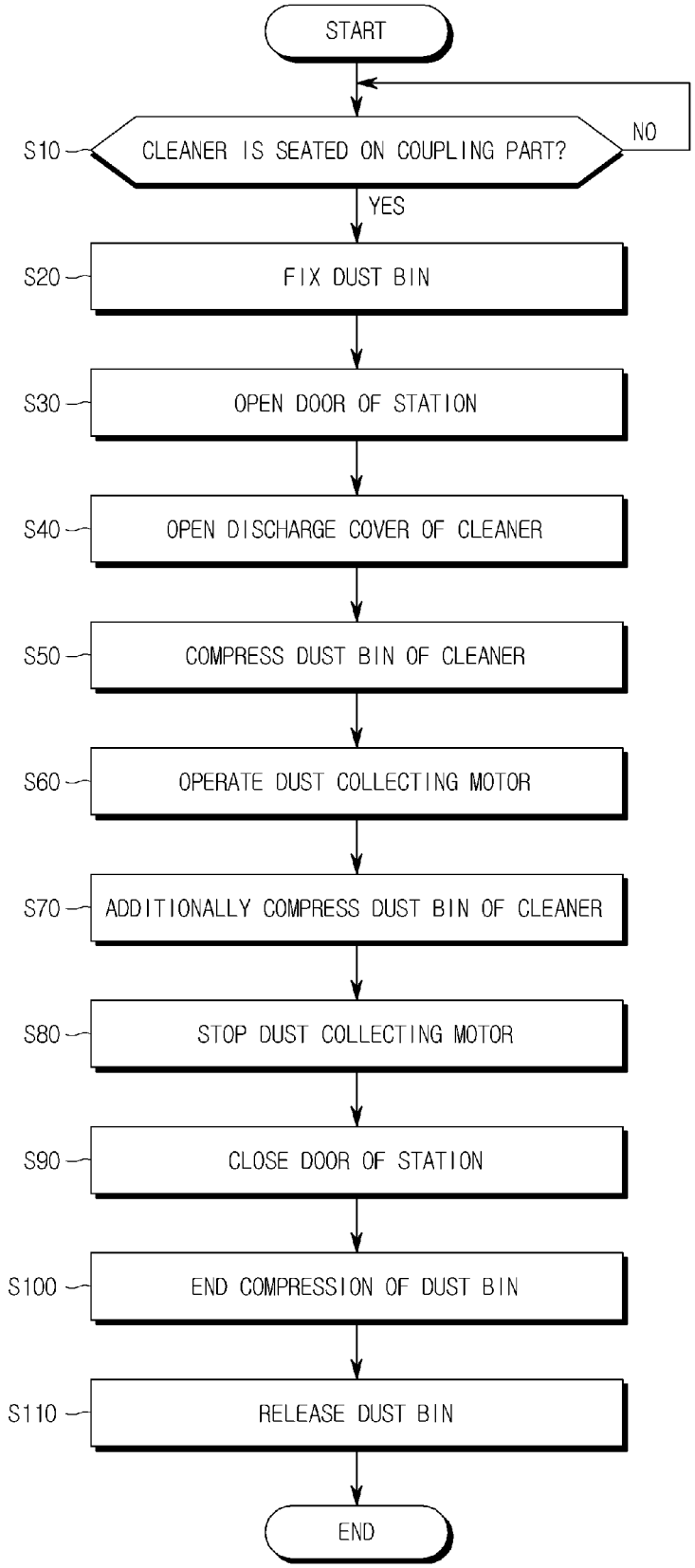

[FIG. 19]
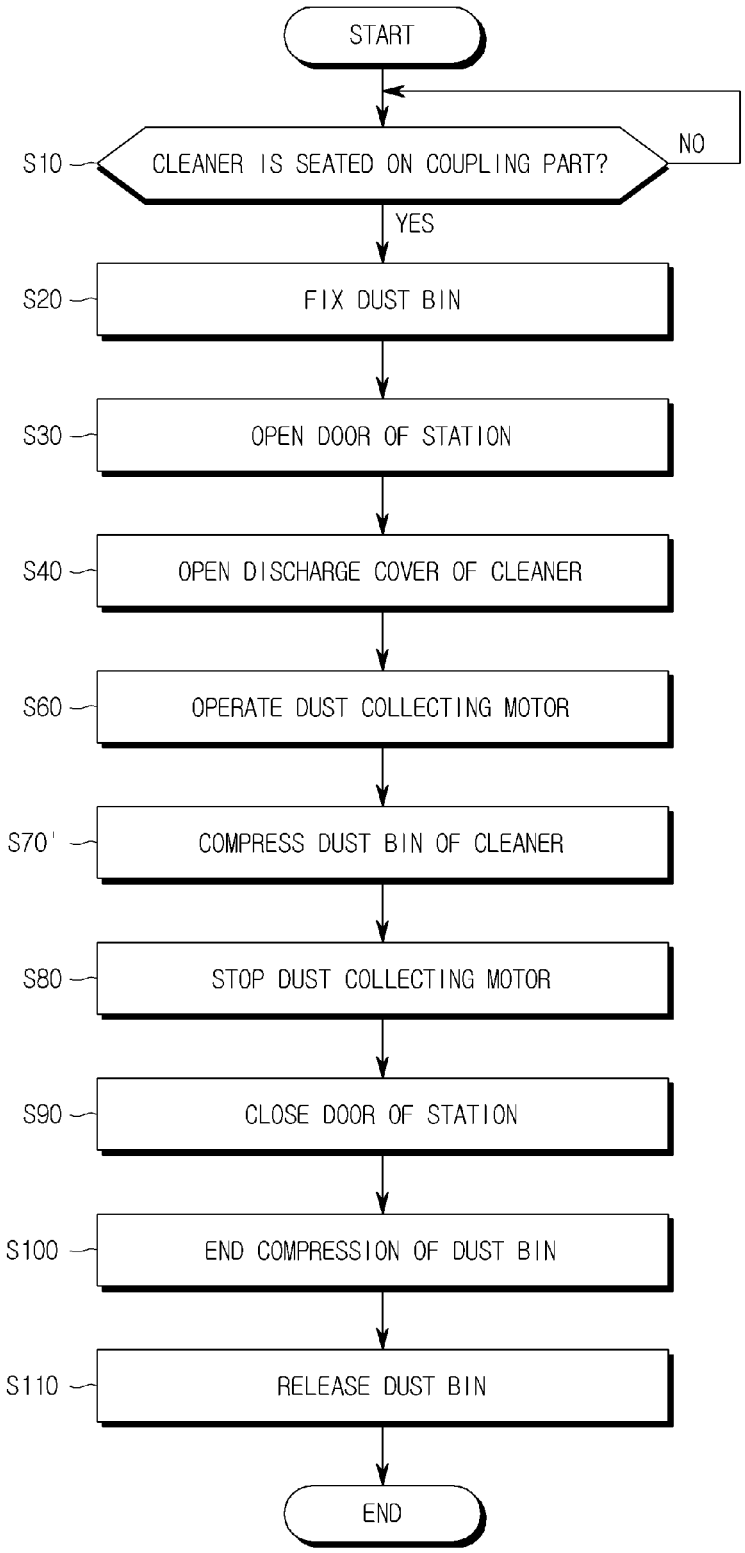

[FIG. 20]
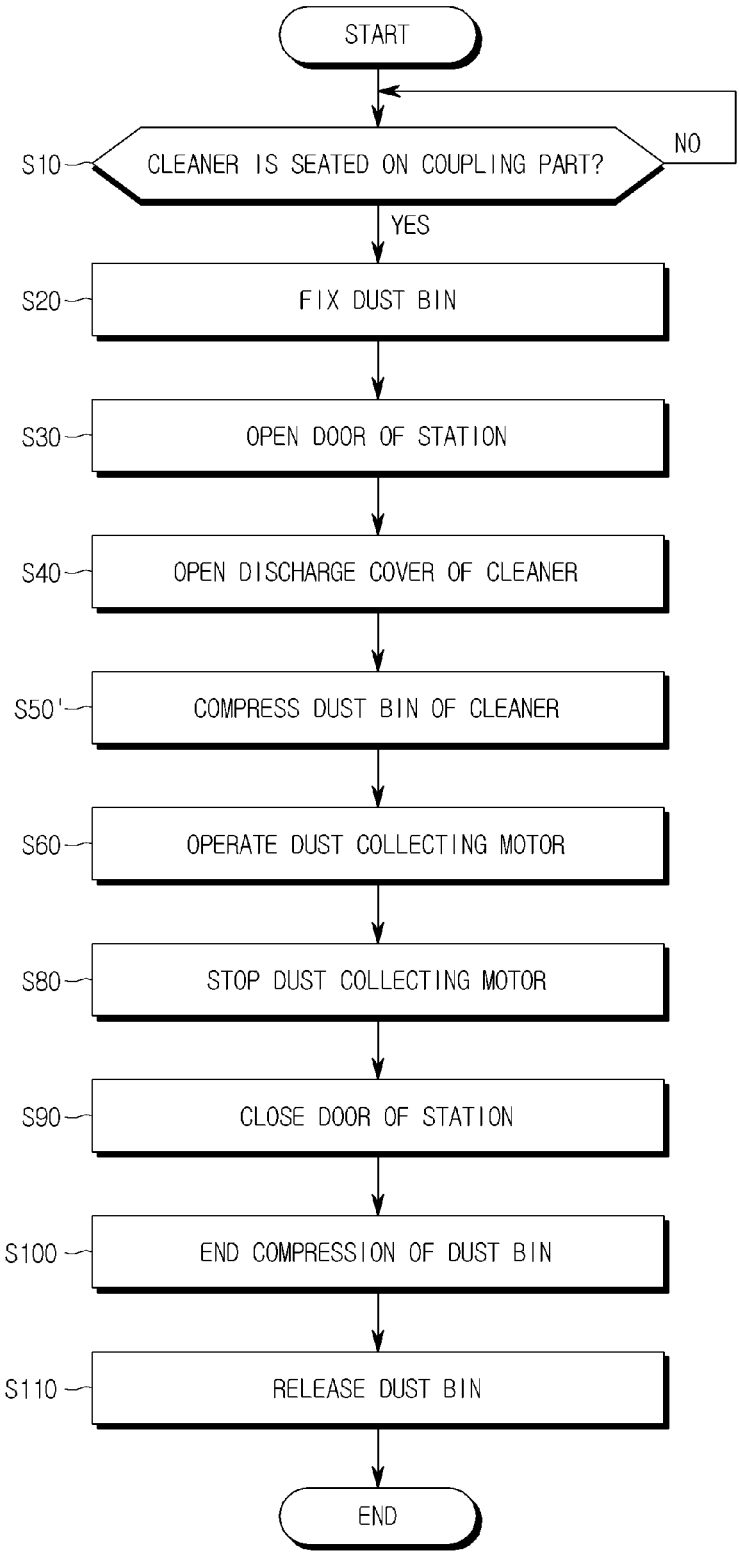

[FIG. 21]
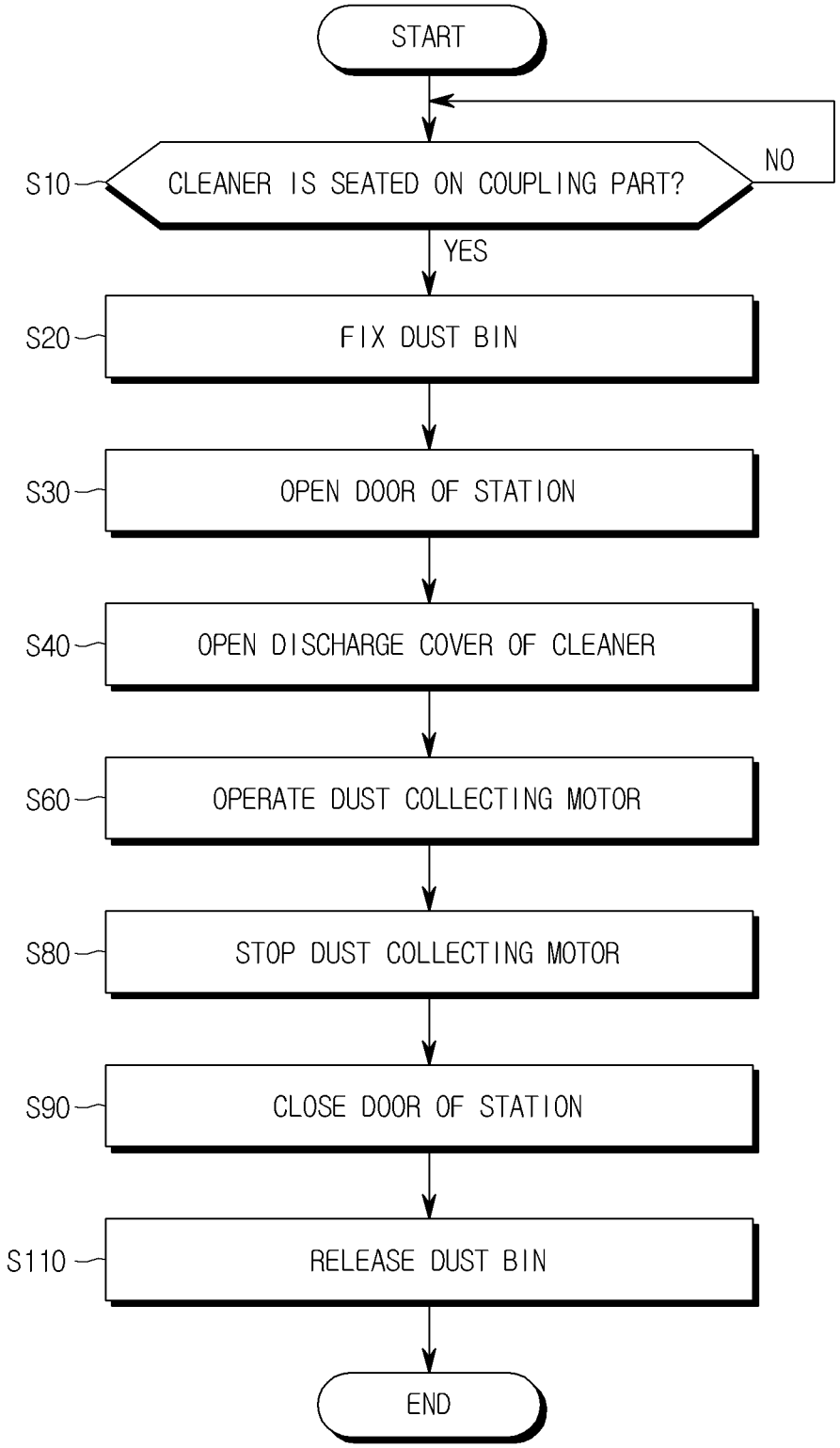

CLEANER STATION AND METHOD OF CONTROLLING THE SAME

CROSS-REFERENCE TO RELATED PATENT APPLICATIONS

This application is a U.S. National Stage Application under 35 U.S.C. § 371 of PCT Application No. PCT/KR2021/007253, filed Jun. 10, 2021, which claims priority to Korean Patent Application No. 10-2020-0075901, filed Jun. 22, 2020, whose entire disclosures are hereby incorporated by reference.

TECHNICAL FIELD

The present disclosure relates to a cleaner station and a method of controlling the cleaner station, and more particularly, to a cleaner station configured to suck dust, stored in a cleaner, into the cleaner station, and a method of controlling the cleaner station.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking foreign substances such as dust from the floor while autonomously traveling in the zone to be cleaned.

To this end, the robot cleaner includes a distance sensor configured to detect a distance from an obstacle such as furniture, office supplies, or walls installed in the zone to be cleaned, and left and right wheels for moving the robot cleaner.

In this case, the left wheel and the right wheel are configured to be rotated by a left wheel motor and a right wheel motor, respectively, and the robot cleaner cleans the room while autonomously changing its direction by operating the left wheel motor and the right wheel motor.

However, because the handy cleaner, the stick cleaner, or the robot cleaner in the related art has a dust bin with a small capacity for storing collected dust, which inconveniences the user because the user needs to empty the dust bin frequently.

In addition, because the dust scatters during the process of emptying the dust bin, there is a problem in that the scattering dust has a harmful effect on the user's health.

In addition, if residual dust is not removed from the dust bin, there is a problem in that a suction force of the cleaner deteriorates.

In addition, if the residual dust is not removed from the dust bin, there is a problem in that the residual dust causes an offensive odor.

Patent Document US 2020-0129025 A1 discloses a dust bin to be combined with a stick vacuum cleaner.

In the combination the dust bin and the vacuum cleaner of Patent Document US 2020-0129025 A1, the vacuum cleaner is disposed to be coupled to the dust bin.

However, Patent Document US 2020-0129025 A1 has a problem in that the user needs to directly assemble the vacuum cleaner and the dust bin.

In addition, there is a problem in that it is impossible to compress dust in the vacuum cleaner to remove the dust remaining in the cleaner.

Meanwhile, Patent Document U.S. Ser. No. 10/595,692 B2 discloses a discharge station having a debris bin of a robot cleaner.

In Patent Document U.S. Ser. No. 10/595,692 B2, a station to which the robot cleaner is docked is provided, and the station has a flow path through which dust is sucked in a direction perpendicular to the ground surface.

In Patent Document U.S. Ser. No. 10/595,692 B2, a sensor is provided to sense docking between the robot cleaner and the station, and a motor operates to suck the dust from the robot cleaner during the docking process.

However, in Patent Document U.S. Ser. No. 10/595,692 B2, the dust is sucked merely in a state in which the robot cleaner is coupled to a connector of the station, but there is no component to recognize whether the cleaner is coupled, fix the cleaner, and open or close the suction port.

In addition, Patent Document U.S. Ser. No. 10/595,692 B2 has a problem in that it is impossible to compress dust in the cleaner to remove the dust remaining in the cleaner.

Meanwhile, Patent Document KR 2020-0037199 A discloses a cleaner.

Patent Document KR 2020-0037199 A discloses the cleaner capable of compressing dust in a dust bin and removing the dust.

However, Patent Document KR 2020-0037199 A has a problem in that a user needs to directly push a lever to compress the dust in the dust bin.

DISCLOSURE

Technical Problem

The present disclosure has been made in an effort to solve the above-mentioned problems of the cleaner station and the method of controlling the cleaner station in the related art, and an object of the present disclosure is to provide a cleaner station and a method of controlling the cleaner station, which are capable of eliminating inconvenience caused because a user needs to empty a dust bin all the time.

Another object of the present disclosure is to provide a cleaner station and a method of controlling the cleaner station, which are capable of preventing dust from scattering when emptying a dust bin.

Still another object of the present disclosure is to provide a cleaner station and a method of controlling the cleaner station, in which when a cleaner is coupled to the cleaner station, the coupling of the cleaner may be detected, the cleaner may be automatically fixed, a suction port (door) of the cleaner station may be opened, and a cover of a dust bin of the cleaner may be opened.

Yet another object of the present disclosure is to provide a cleaner station and a method of controlling the cleaner station, which are capable of providing convenience for a user by enabling the user to remove dust in a dust bin without a separate manipulation.

Still yet another object of the present disclosure is to provide a cleaner station and a method of controlling the cleaner station, which are capable of removing an offensive odor caused by residual dust by preventing the residual dust from remaining in a dust bin.

Technical Solution

In order to achieve the above-mentioned objects, a cleaner station according to the present disclosure may include: a housing; a coupling part disposed in the housing and including a coupling surface to which a first cleaner is coupled; a dust collecting part accommodated in the housing, disposed below the coupling part, and configured to capture dust in a dust bin of the first cleaner; a dust collecting motor accommodated in the housing, disposed below the dust collecting part, and configured to generate a suction force for sucking the dust in the dust bin; a fixing unit disposed on the coupling part and configured to fix the first cleaner; and a control unit configured to control the coupling part, the fixing unit, the door unit, the cover opening unit, the lever pulling unit, and the dust collecting motor.

In this case, the coupling part may further include a guide protrusion protruding from the coupling surface; and a coupling sensor disposed on the guide protrusion and configured to detect whether the first cleaner is coupled at an exact position.

When the first cleaner is coupled at the exact position, the coupling sensor may transmit a signal indicating that the first cleaner is coupled.

The fixing unit may include: a fixing member configured to move from the outside of the dust bin toward the dust bin in order to fix the dust bin when the first cleaner is coupled to the coupling part; and a fixing part motor configured to provide power for moving the fixing member.

The control unit may receive the signal, which indicates that the first cleaner is coupled, from the coupling sensor.

When the control unit receives the signal, which indicates that the cleaner is coupled, from the coupling sensor, the control unit may operate the fixing part motor so that the fixing member fixes the dust bin.

The fixing unit may further include a fixing detecting part capable of detecting a movement of the fixing member.

When the fixing detecting part detects that the fixing member is moved to the position at which the fixing member fixes the dust bin, the fixing detecting part may transmit a signal indicating that the dust bin is fixed.

The control unit may receive the signal, which indicates that the dust bin is fixed, from the fixing detecting part and stop the operation of the fixing part motor.

When at least a part of the cleaner is coupled at the exact position on the coupling part, the fixing part motor may operate to move the fixing member.

The cleaner station according to the present disclosure may further include a door unit including a door coupled to the coupling surface and configured to open or close a dust passage hole formed in the coupling surface so that outside air may be introduced into the housing.

The door unit may include: the door hingedly coupled to the coupling surface and configured to open or close the dust passage hole; and a door motor configured to provide power for rotating the door.

In this case, when the dust bin is fixed, the control unit may operate the door motor to open the dust passage hole.

When the dust bin is fixed, the door motor may operate to rotate the door and open the dust passage hole.

The door unit may further include a door opening/closing detecting part configured to detect whether the door is opened or closed.

When the door opening/closing detecting part detects that the door is opened, the door opening/closing detecting part may transmit a signal indicating that the door is opened.

On the basis of whether power is supplied to the battery of the first cleaner, the control unit may check whether the first cleaner is coupled.

The control unit may receive the signal, which indicates that the door is opened, and stop the operation of the door motor.

The cleaner station according to the present disclosure may further include a cover opening unit disposed on the coupling part and configured to open a discharge cover of the dust bin.

The cover opening unit may include: a push protrusion configured to move when the first cleaner is coupled; and a cover opening motor configured to provide power for moving the push protrusion.

In this case, when the door is opened, the control unit may operate the cover opening motor to open the discharge cover.

The cover opening unit may further include a cover opening detecting part configured to detect whether the discharge cover is opened.

When the cover opening detecting part detects that the discharge cover is opened, the cover opening detecting part may transmit a signal indicating that the discharge cover is opened.

The control unit may receive the signal, which indicates that the discharge cover is opened, and stop the operation of the cover opening motor.

The cleaner station according to the present disclosure may further include a lever pulling unit accommodated in the housing and configured to stroke-move and rotate to pull a dust bin compression lever of the first cleaner.

The lever pulling unit may include a stroke drive motor disposed in the housing and configured to provide power for stroke-moving the lever pulling arm.

In this case, the control unit may operate the stroke drive motor to move the lever pulling arm to a height equal to or higher than a height of the dust bin compression lever.

The lever pulling unit may further include an arm movement detecting part configured to detect a movement of the lever pulling arm.

When the arm movement detecting part detects that the lever pulling arm is moved to the height equal to or higher than the height of the dust bin compression lever, the arm movement detecting part may transmit a signal indicating that the lever pulling arm is stroke-moved to a target position.

The control unit may receive the signal, which indicates that the lever pulling arm is stroke-moved to the target position, and stop the operation of the stroke drive motor.

Meanwhile, the lever pulling unit may further include a rotation drive motor configured to provide power for rotating the lever pulling arm.

In this case, when the lever pulling arm is moved to the height equal to or higher than the height of the dust bin compression lever, the control unit may operate the rotation drive motor to rotate the lever pulling arm to a position at which an end of the lever pulling arm may push the dust bin compression lever.

When the lever pulling arm is moved to the height equal to or higher than the height of the dust bin compression lever, the rotation drive motor may operate.

When the arm movement detecting part detects that the lever pulling arm is rotated to the position at which the lever pulling arm may push the dust bin compression lever, the arm movement detecting part may transmit a signal indicating that the lever pulling arm is rotated to a target position.

The control unit may receive the signal, which indicates that the lever pulling arm is rotated to the target position, and stop the operation of the rotation drive motor.

Meanwhile, when the lever pulling arm is moved to the position at which the end of the lever pulling arm may push the dust bin compression lever, the control unit may operate the stroke drive motor in a direction in which the lever pulling arm pulls the dust bin compression lever.

When the lever pulling arm is moved to the position at which the end of the lever pulling arm may push the dust bin compression lever, the stroke drive motor may operate.

When the arm movement detecting part detects that the lever pulling arm is moved to the target position when the compression lever is pulled, the arm movement detecting part may transmit a signal indicating that the lever pulling arm is pulled.

The control unit may receive the signal, which indicates that the lever pulling arm is pulled, and stop the operation of the stroke drive motor.

The control unit may operate the dust collecting motor and operate the stroke drive motor during the operation of the dust collecting motor so that the lever pulling arm pulls the dust bin compression lever at least once.

The stroke drive motor may be operated at least once during the operation of the dust collecting motor.

After the operation of the dust collecting motor is ended, the control unit may operate the door motor in a direction in which the door is closed.

The door motor may be operated after the operation of the dust collecting motor is ended.

After the operation of the dust collecting motor is ended, the control unit may operate the rotation drive motor to rotate and return the end of the lever pulling arm to the original position, and the control unit may operate the stroke drive motor to return the height of the lever pulling arm to the original position.

When the door is closed, the control unit may operate the fixing part motor so that the fixing member may release the dust bin.

The fixing part motor may operate when the door closes the dust passage hole.

In order to achieve the above-mentioned objects, a method of controlling a cleaner station according to the present disclosure may include: a dust bin fixing step of holding and fixing, by a fixing member of the cleaner station, a dust bin of a first cleaner when the first cleaner is coupled to the cleaner station; a door opening step of opening a door of the cleaner station when the dust bin is fixed; a cover opening step of opening a discharge cover configured to open or close the dust bin when the door is opened; and a dust collecting step of collecting dust in the dust bin by operating a dust collecting motor of the cleaner station when the discharge cover is opened.

The method of controlling the cleaner station according to the present disclosure may further include a dust bin compressing step of compressing an inside of the dust bin when the discharge cover is opened.

The dust bin compressing step may include: a first compression preparing step of stroke-moving a lever pulling arm of the cleaner station to a height at which the lever pulling arm may push a dust bin compression lever of the first cleaner; a second compression preparing step of rotating the lever pulling arm to a position at which the lever pulling arm may push the dust bin compression lever; and a lever pulling step of pulling, by the lever pulling arm, the dust bin compression lever at least once after the second compression preparing step.

The method of controlling the cleaner station according to the present disclosure may further include a compression ending step of returning the lever pulling arm to an original position after the dust bin compressing step.

The compression ending step may include: a first returning step of rotating the lever pulling arm to the original position; and a second returning step of stroke-moving the lever pulling arm to the original position.

The method of controlling the cleaner station according to the present disclosure may further include a coupling checking step of checking whether the first cleaner is coupled to a coupling part of the cleaner station.

The dust bin compressing step may be performed during the operation of the dust collecting motor.

The dust collecting step may be performed after the dust bin compressing step.

The method of controlling the cleaner station according to the present disclosure may further include a door closing step of closing the door after the dust collecting step.

The method of controlling the cleaner station according to the present disclosure may further include a release step of releasing the dust bin after the door closing step.

Advantageous Effect

According to the cleaner station and the method of controlling the cleaner station according to the present disclosure, it is possible to eliminate the inconvenience caused because the user needs to empty the dust bin all the time.

In addition, since the dust in the dust bin is sucked into the station when emptying the dust bin, it is possible to prevent the dust from scattering.

In addition, it is possible to open the dust passing hole by detecting coupling of the cleaner without the user's separate manipulation and remove the dust in the dust bin in accordance with the operation of the dust collecting motor, and as a result, it is possible to provide convenience for the user.

In addition, a stick cleaner and a robot cleaner may be coupled to the cleaner station at the same time, and as necessary, the dust in the dust bin of the stick cleaner and the dust in the dust bin of the robot cleaner may be selectively removed.

In addition, when the cleaner is coupled to the cleaner station, the coupling of the cleaner may be detected, the cleaner may be automatically fixed, a suction port (door) of the cleaner station may be opened, and the cover of the dust bin of the cleaner may be opened.

In addition, when the cleaner station detects the coupling of the dust bin, the lever is pulled to compress the dust bin, such that the residual dust does not remain in the dust bin, and as a result, it is possible to increase the suction force of the cleaner.

Further, it is possible to remove an offensive odor caused by the residual dust by preventing the residual dust from remaining in the dust bin.

DESCRIPTION OF DRAWINGS

FIG. 1 is a perspective view illustrating a dust removing system including a cleaner station, a first cleaner, and a second cleaner according to an embodiment of the present disclosure.

FIG. 2 is a schematic view illustrating a configuration of the dust removing system according to the embodiment of the present disclosure.

FIG. 3 is a view for explaining the first cleaner of the dust removing system according to the embodiment of the present disclosure.

FIG. 4 is a view for explaining a center of gravity of the first cleaner according to the embodiment of the present disclosure.

FIG. 5 is a view for explaining a coupling part of the cleaner station according to the embodiment of the present disclosure.

FIG. 6 is a view for explaining an arrangement of a fixing unit, a door unit, a cover opening unit, and a lever pulling unit in the cleaner station according to the embodiment of the present disclosure.

FIG. 7 is an exploded perspective view for explaining the fixing unit of the cleaner station according to the embodiment of the present disclosure.

FIG. 8 is a view for explaining an arrangement of the first cleaner and the fixing unit in the cleaner station according to the embodiment of the present disclosure.

FIGS. 9 and 9A are cross-sectional views for explaining the fixing unit of the cleaner station according to the embodiment of the present disclosure.

FIG. 10 is a view for explaining a relationship between the first cleaner and the door unit in the cleaner station according to the embodiment of the present disclosure.

FIG. 11 is a view for explaining a lower side of a dust bin of the first cleaner according to the embodiment of the present disclosure.

FIG. 12 is a view for explaining a relationship between the first cleaner and the cover opening unit in the cleaner station according to the embodiment of the present disclosure.

FIG. 13 is a perspective view for explaining the cover opening unit of the cleaner station according to the embodiment of the present disclosure.

FIGS. 14 and 14A are views for explaining a relationship between the first cleaner and the lever pulling unit in the cleaner station according to the embodiment of the present disclosure.

FIG. 15 is a view for explaining an arrangement relationship between the cleaner station and the center of gravity of the first cleaner according to the embodiment of the present disclosure.

FIG. 16 is a schematic view when viewing FIG. 15 in another direction.

FIG. 17 is a block diagram for explaining a control configuration of the cleaner station according to the embodiment of the present disclosure.

FIG. 18 is a flowchart for explaining a method of controlling the cleaner station according to the embodiment of the present disclosure.

FIG. 19 is a flowchart for explaining a second embodiment of the method of controlling the cleaner station according to the present disclosure.

FIG. 20 is a flowchart for explaining a third embodiment of the method of controlling the cleaner station according to the present disclosure.

FIG. 21 is a flowchart for explaining a fourth embodiment of the method of controlling the cleaner station according to the present disclosure.

MODE FOR INVENTION

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" may include any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions may include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

FIG. 1 is a perspective view illustrating a dust removing system for a cleaner that includes a cleaner station, a first cleaner, and a second cleaner according to an embodiment of the present disclosure, and FIG. 2 is a schematic view illustrating a configuration of the dust removing system for a cleaner according to the embodiment of the present disclosure.

Referring to FIGS. 1 and 2, a dust removing system 10 according to the embodiment of the present specification may include a cleaner station 100 and cleaners 200 and 300. In this case, the cleaners 200 and 300 may include a first cleaner 200 and a second cleaner 300. Meanwhile, the present embodiment may be carried out without some of the above-mentioned components and does not exclude additional components.

The dust removing system 10 may include the cleaner station 100. The first cleaner 200 and the second cleaner 300 may be disposed on the cleaner station 100. The first cleaner 200 may be coupled to a lateral surface of the cleaner station 100. Specifically, a main body of the first cleaner 200 may be coupled to the lateral surface of the cleaner station 100. The second cleaner 200 may be coupled to a lower portion of the cleaner station 100. The cleaner station 100 may remove dust from a dust bin 220 of the first cleaner 200. The cleaner station 100 may remove dust from a dust bin (not illustrated) of the second cleaner 300.

Meanwhile, FIG. 3 is a view for explaining the first cleaner of the dust removing system according to the embodiment of the present disclosure, and FIG. 4 is a view for explaining a center of gravity of the first cleaner according to the embodiment of the present disclosure.

First, in order to assist in understanding the cleaner station 100 according to the present disclosure, a structure of the first cleaner 200 will be described below with reference to FIGS. 1 to 4.

The first cleaner 200 may mean a cleaner configured to be manually operated by a user. For example, the first cleaner 200 may mean a handy cleaner or a stick cleaner.

The first cleaner 200 may be mounted on the cleaner station 100. The first cleaner 200 may be supported by the cleaner station 100. The first cleaner 200 may be coupled to the cleaner station 100.

The first cleaner 200 may include a main body 210. The main body 210 may include a main body housing 211, a suction part 212, a dust separating part 213, a suction motor 214, an air discharge cover 215, a handle 216, an extension part 217, and an operating part 218.

The main body housing 211 may define an external appearance of the first cleaner 200. The main body housing 211 may provide a space that may accommodate therein the suction motor 214 and a filter (not illustrated). The main body housing 211 may be formed in a shape similar to a cylindrical shape.

The suction part 212 may protrude outward from the main body housing 211.

For example, the suction part 212 may be formed in a cylindrical shape with an opened inside. The suction part 212 may communicate with an extension tube 280. The suction part 212 may provide a flow path (hereinafter, referred to as a 'suction flow path') through which air containing dust may flow.

Meanwhile, in the present embodiment, an imaginary centerline penetrating a center of the cylindrical suction part 212 may be defined. That is, an imaginary suction flow path centerline a2 passing through a center of the suction flow path may be defined.

In this case, the suction flow path centerline a2 may be an imaginary line that connects centers of gravity on planes made by cutting the suction part 212 in an axial direction and a radial direction.

The dust separating part 213 may communicate with the suction part 212. The dust separating part 213 may separate dust introduced into the dust separating part 213 through the suction part 212. The dust separating part 213 may communicate with the dust bin 220.

For example, the dust separating part 213 may be a cyclone part capable of separating dust using a cyclone flow. Further, the dust separating part 213 may communicate with the suction part 212. Therefore, the air and the dust, which are introduced through the suction part 212, spirally flow along an inner circumferential surface of the dust separating part 213. Therefore, the cyclone flow may be generated around a center axis of the dust separating part 213.

Meanwhile, in the present embodiment, the center axis of the cyclone part may be an imaginary cyclone center axis a4 extending in a vertical direction.

In this case, the cyclone center axis a4 may be an imaginary line that connects centers of gravity on planes made by cutting the dust separating part 213 in the axial direction and the radial direction. For example, the cyclone center axis a4 may be defined coaxially with a motor axis a1 to be described below.

The suction motor 214 may generate a suction force for sucking air. The suction motor 214 may be accommodated in the main body housing 211. The suction motor 214 may generate the suction force by means of a rotation. For example, the suction motor 214 may be formed in a shape similar to a cylindrical shape.

Meanwhile, in the present embodiment, the imaginary motor axis a1 may be formed by extending a center axis of the suction motor 214.

In this case, the motor axis a1 may be an imaginary line that connects centers of gravity on planes made by cutting the suction motor 214 in the axial direction and the radial direction.

The air discharge cover 215 may be disposed at one side in the axial direction of the main body housing 211. The air discharge cover 215 may accommodate a filter for filtering air. For example, an HEPA filter may be accommodated in the air discharge cover 215.

The air discharge cover 215 may have an air discharge port 215*a* for discharging the air introduced by the suction force of the suction motor 214.

A flow guide may be disposed on the air discharge cover 215. The flow guide may guide a flow of the air to be discharged through the air discharge port 215*a*.

The handle 216 may be grasped by the user. The handle 216 may be disposed at a rear side of the suction motor 214. For example, the handle 216 may be formed in a shape similar to a cylindrical shape. Alternatively, the handle 216 may be formed in a curved cylindrical shape. The handle 216 may be disposed at a predetermined angle with respect to the main body housing 211, the suction motor 214, or the dust separating part 213.

Meanwhile, in the present embodiment, an imaginary handle axis a3 may be formed by extending a center axis of the handle 216.

In this case, the handle axis a3 may be an imaginary line that connects centers of gravity on planes made by cutting the handle 216 in the axial direction and the radial direction.

A shaft of the suction motor 214 may be disposed between the suction part 212 and the handle 216. That is, the motor axis a1 may be disposed between the suction part 212 and the handle 216.

Further, the handle axis a3 may be disposed at a predetermined angle with respect to the motor axis a1 or the suction flow path centerline a2. Therefore, there may be an intersection point at which the handle axis a3 intersects the motor axis a1 or the suction flow path centerline a2.

Meanwhile, the motor axis a1, the suction flow path centerline a2, and the handle axis a3 may be disposed on the same plane S1.

With this configuration, the centers of gravity of the entire first cleaner 200 according to the present disclosure may be disposed symmetrically with respect to the plane S1.

Meanwhile, in the embodiment of the present disclosure, a forward direction may mean a direction in which the suction part 212 is disposed based on the suction motor 214, and a rear direction may mean a direction in which the handle 216 is disposed.

An upper surface of the handle 216 may define an external appearance of a part of an upper surface of the first cleaner 200. Therefore, it is possible to prevent a component of the first cleaner 200 from coming into contact with the user's arm when the user grasps the handle 216.

The extension part 217 may extend from the handle 216 toward the main body housing 211. At least a part of the extension part 217 may extend in a horizontal direction.

The operating part 218 may be disposed on the handle 216. The operating part 218 may be disposed on an inclined surface formed in an upper region of the handle 216. The user may input an instruction to operate or stop the first cleaner 200 through the operating part 218.

The first cleaner 200 may include the dust bin 220. The dust bin 220 may communicate with the dust separating part 213. The dust bin 220 may store the dust separated by the dust separating part 213.

The dust bin 220 may include a dust bin main body 221, a discharge cover 222, a dust bin compression lever 223, and a compression member (not illustrated).

The dust bin main body 221 may provide a space capable of storing the dust separated by the dust separating part 213. For example, the dust bin main body 221 may be formed in a shape similar to a cylindrical shape.

Meanwhile, in the present embodiment, an imaginary dust bin axis a5 may be formed by extending a center axis of the dust bin main body 221.

In this case, the dust bin axis a5 may be an imaginary line that connects centers of gravity on planes made by cutting the dust bin 220 in the axial direction and the radial direction. For example, the dust bin axis a5 may be defined coaxially with the motor axis a1.

Therefore, the dust bin axis a5 may also be disposed on the plane S1 including the motor axis a1, the suction flow path centerline a2, and the handle axis a3.

A part of a lower side of the dust bin main body 221 may be opened. In addition, a lower extension portion 221*a* may be formed at the lower side of the dust bin main body 221. The lower extension portion 221*a* may be formed to block a part of the lower side of the dust bin main body 221.

The dust bin 220 may include the discharge cover 222. The discharge cover 222 may be disposed at a lower side of the dust bin 220. The discharge cover 222 may selectively open or close the lower side of the dust bin 220 which is opened downward.

The discharge cover 222 may include a cover main body 222*a* and a hinge part 222*b*. The cover main body 222*a* may be formed to block a part of the lower side of the dust bin main body 221. The cover main body 222*a* may be rotated downward about the hinge part 222*b*. The hinge part 222*b* may be disposed adjacent to a battery housing 230. The discharge cover 222 may be coupled to the dust bin 220 by a hook engagement.

Meanwhile, the dust bin may further include a coupling lever 222*c*. The discharge cover 222 may be separated from the dust bin 220 by means of the coupling lever 222*c*. The coupling lever 222*c* may be disposed at a front side of the dust bin. Specifically, the coupling lever 222*c* may be disposed on an outer surface at the front side of the dust bin 220. When external force is applied to the coupling lever 222*c*, the coupling lever 222*c* may elastically deform a hook extending from the cover main body 222*a* in order to release the hook engagement between the cover main body 222*a* and the dust bin main body 221.

When the discharge cover 222 is closed, the lower side of the dust bin 220 may be blocked (sealed) by the discharge cover 222 and the lower extension portion 221*a*.

The dust bin 220 may include the dust bin compression lever 223. The dust bin compression lever 223 may be disposed outside the dust bin 220 or the dust separating part 211. The dust bin compression lever 223 may be disposed outside the dust bin 220 or the dust separating part 211 so as to be movable upward and downward. The dust bin compression lever 223 may be connected to the compression member (not illustrated). When the dust bin compression lever 223 is moved downward by external force, the compression member (not illustrated) may also be moved downward. Therefore, it is possible to provide convenience for the user. The compression member (not illustrated) and the dust bin compression lever 223 may return back to original positions by an elastic member (not illustrated). Specifically, when the external force applied to the dust bin compression lever 223 is eliminated, the elastic member may move the dust bin compression lever 223 and the compression member (not illustrated) upward.

The compression member (not illustrated) may be disposed inside the dust bin main body 221. The compression member may move in the internal space of the dust bin main body 221. Specifically, the compression member may move upward and downward in the dust bin main body 221. Therefore, the compression member may compress downward the dust in the dust bin main body 221. In addition, when the discharge cover 222 is separated from the dust bin main body 221 and thus the lower side of the dust bin 220 is opened, the compression member may move from an upper side of the dust bin 220 to the lower side of the dust bin 220, thereby removing foreign substances such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220.

The first cleaner 200 may include the battery housing 230. A battery 240 may be accommodated in the battery housing 230. The battery housing 230 may be disposed at a lower side of the handle 216. For example, the battery housing 230 may have a hexahedral shape opened at a lower side thereof. A rear surface of the battery housing 230 may be connected to the handle 216.

The battery housing 230 may include an accommodation portion opened at a lower side thereof. The battery 230 may be attached or detached through the accommodation portion of the battery housing 220.

The first cleaner 200 may include the battery 240.

For example, the battery 240 may be separably coupled to the first cleaner 200. The battery 240 may be separably coupled to the battery housing 230. For example, the battery 240 may be inserted into the battery housing 230 from the lower side of the battery housing 230.

Otherwise, the battery 240 may be integrally provided in the battery housing 230. In this case, a lower surface of the battery 240 is not exposed to the outside.

The battery 240 may supply power to the suction motor 214 of the first cleaner 200. The battery 240 may be disposed on a lower portion of the handle 216. The battery 240 may be disposed at a rear side of the dust bin 220. That is, the suction motor 214 and the battery 240 may be disposed so as not to overlap each other in the upward/downward direction and disposed at different disposition heights. On the basis of the handle 216, the suction motor 214, which is heavy in weight, is disposed at a front side of the handle 216, and the battery 240, which is heavy in weight, is disposed at the lower side of the handle 216, such that an overall weight of the first cleaner 200 may be uniformly distributed. Therefore, it is possible to prevent stress from being applied to the user's wrist when the user grasps the handle 216 and performs a cleaning operation.

In a case in which the battery 240 is coupled to the battery housing 230 in accordance with the embodiment, the lower surface of the battery 240 may be exposed to the outside. Because the battery 240 may be placed on the floor when the first cleaner 200 is placed on the floor, the battery 240 may be immediately separated from the battery housing 230. In addition, because the lower surface of the battery 240 is exposed to the outside and thus in direct contact with air outside the battery 240, performance of cooling the battery 240 may be improved.

Meanwhile, in a case in which the battery 240 is fixed integrally to the battery housing 230, the number of structures for attaching or detaching the battery 240 and the battery housing 230 may be reduced, and as a result, it is possible to reduce an overall size of the first cleaner 200 and a weight of the first cleaner 200.

The first cleaner 200 may include the extension tube 250. The extension tube 300 may communicate with a cleaning module 260. The extension tube 250 may communicate with the main body 210. The extension tube 250 may communicate with the suction part 214 of the main body 210. The extension tube 250 may be formed in a long cylindrical shape.

The main body 210 may be connected to the extension tube 250. The main body 210 may be connected to the cleaning module 260 through the extension tube 250. The main body 210 may generate the suction force by means of the suction motor 214 and provide the suction force to the cleaning module 260 through the extension tube 250. The outside dust may be introduced into the main body 210 through the cleaning module 260 and the extension tube 250.

The first cleaner 200 may include the cleaning module 260. The cleaning module 260 may communicate with the extension tube 260. Therefore, the outside air may be introduced into the main body 210 of the first cleaner 200 via the cleaning module 260 and the extension tube 250 by the suction force generated in the main body 210 of the first cleaner 200.

The dust in the dust bin 220 of the first cleaner 200 may be captured by a dust collecting part 170 of the cleaner station 100 by gravity and a suction force of a dust collecting motor 191. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

The first cleaner 200 may be coupled to a lateral surface of a housing 110. Specifically, the main body 210 of the first cleaner 200 may be mounted on a coupling part 120. More specifically, the dust bin 220 and the battery housing 230 of the first cleaner 200 may be coupled to a coupling surface 121, an outer circumferential surface of the dust bin main body 221 may be coupled to a dust bin guide surface 122, and the suction part 212 may be coupled to a suction part guide surface 126 of the coupling part 120 (see FIG. 2).

Meanwhile, in the present embodiment, an imaginary gravity center plane S1 may be defined and include at least two of the motor axis a1, the suction flow path centerline a2, the handle axis a3, the cyclone center axis a4, and the dust bin axis a5. That is, the gravity center plane S1 may be an imaginary plane made by connecting two imaginary lines and include an imaginary plane by expanding and extending the imaginary plane.

For example, the gravity center plane S1 may include the motor axis a1 and the suction flow path centerline a2. Alternatively, the gravity center plane S1 may include the motor axis a1 and the handle axis a3. Alternatively, the gravity center plane S1 may include the cyclone center axis a4 and the suction flow path centerline a2. Alternatively, the gravity center plane S1 may include the cyclone center axis a4 and the handle axis a3. Alternatively, the gravity center plane S1 may include the dust bin axis a5 and the suction flow path centerline a2. Alternatively, the gravity center plane S1 may include the dust bin axis a5 and the handle axis a3. Alternatively, the gravity center plane S1 may include the suction flow path centerline a2 and the handle axis a3.

Therefore, the suction part 212 may be disposed on an imaginary extension plane of the gravity center plane S1. Alternatively, the dust separating part 213 may be disposed on an imaginary extension plane of the gravity center plane S1. Alternatively, the suction motor 214 may be disposed on an imaginary extension plane of the gravity center plane S1. Alternatively, the handle 216 may be disposed on an imaginary extension plane of the gravity center plane S1. Alternatively, the dust bin 220 may be disposed on an imaginary extension plane of the gravity center plane S1.

With this configuration, the centers of gravity of the entire first cleaner 200 may be disposed symmetrically with respect to the gravity center plane S1.

The dust removing system 10 may include the second cleaner 300. The second cleaner 300 may mean a robot cleaner. The second cleaner 300 may automatically clean a zone to be cleaned by sucking foreign substances such as dust from the floor while autonomously traveling in the zone to be cleaned. The second cleaner 300, that is, the robot cleaner may include a distance sensor configured to detect a distance from an obstacle such as furniture, office supplies, or walls installed in the zone to be cleaned, and left and right wheels for moving the robot cleaner. The second cleaner 300 may be coupled to the cleaner station. The dust in the second cleaner 300 may be captured into the dust collecting part 170 through a second flow path (not illustrated).

Meanwhile, FIG. 15 is a view for explaining an arrangement relationship between the cleaner station and the center of gravity of the first cleaner according to the embodiment of the present disclosure, and FIG. 16 is a view illustrating a schematic view when viewing FIG. 15 in another direction.

The cleaner station 100 according to the present disclosure will be described below with reference to FIGS. 1, 2, 15, and 16.

The first cleaner 200 and the second cleaner 300 may be disposed on the cleaner station 100. The first cleaner 200 may be coupled to the lateral surface of the cleaner station 100. Specifically, a main body of the first cleaner 200 may be coupled to the lateral surface of the cleaner station 100. The second cleaner 200 may be coupled to the lower portion of the cleaner station 100. The cleaner station 100 may remove the dust from the dust bin 220 of the first cleaner 200. The cleaner station 100 may remove the dust from the dust bin (not illustrated) of the second cleaner 300.

The cleaner station 100 may include the housing 110. The housing 110 may define an external appearance of the cleaner station 100. Specifically, the housing 110 may be formed in the form of a column including one or more outer wall surfaces. For example, the housing 110 may be formed in a shape similar to a quadrangular column.

The housing 110 may have a space capable of accommodating the dust collecting part 170 configured to store dust therein, and a dust suction module 190 configured to generate a flow force for collecting the dust from the dust collecting part 170.

The housing 110 may include a bottom surface 111 and an outer wall surface 112.

The bottom surface 111 may support a lower side in a gravitational direction of the dust suction module 190. That is, the bottom surface 111 may support a lower side of the dust collecting motor 191 of the dust suction module 190.

In this case, the bottom surface 111 may be disposed toward the ground surface. The bottom surface 111 may also be disposed in parallel with the ground surface or disposed to be inclined at a predetermined angle with respect to the ground surface. The above-mentioned configuration may be advantageous in stably supporting the dust collecting motor 191 and maintaining balance of an overall weight even in a case in which the first cleaner 200 is coupled.

Meanwhile, according to the embodiment, the bottom surface 111 may further include ground surface support portions (not illustrated) in order to prevent the cleaner station 100 from falling down and increase an area being in contact with the ground surface to maintain the balance. For example, the ground surface support portion may have a plate shape extending from the bottom surface 111, and one or more frames may protrude and extend from the bottom surface 111 in a direction of the ground surface. In this case, the ground surface support portions may be disposed to be linearly symmetrical in order to maintain the left and right balance and the front and rear balance on the basis of a front surface on which the first cleaner 200 is mounted.

The outer wall surface 112 may mean a surface formed in the gravitational direction or a surface connected to the bottom surface 111. For example, the outer wall surface 112 may mean a surface connected to the bottom surface 111 so as to be perpendicular to the bottom surface 111. As another embodiment, the outer wall surface 112 may be disposed to be inclined at a predetermined angle with respect to the bottom surface 111.

The outer wall surface 112 may include at least one surface. For example, the outer wall surface 112 may include a first outer wall surface 112*a*, a second outer wall surface 112*b*, a third outer wall surface 112*c*, and a fourth outer wall surface 112*d*.

In this case, in the present embodiment, the first outer wall surface 112*a* may be disposed at the front side of the cleaner station 100. In this case, the front side may mean a side at which the first cleaner 200 or the second cleaner 300 is coupled. Therefore, the first outer wall surface 112*a* may define an external appearance of the front surface of the cleaner station 100.

Meanwhile, the directions are defined as follows to understand the present embodiment. In the present embodiment, the directions may be defined in the state in which the first cleaner 200 is mounted on the cleaner station 100.

In this case, a surface including an extension line 212*a* of the suction part 212 may be referred to as the front surface (see FIG. 1). That is, in the state in which the first cleaner 200 is mounted on the cleaner station 100, a part of the suction part 212 may be in contact with and coupled to the suction part guide surface 126, and the remaining part of the suction part 212, which is not coupled to the suction part guide surface 126, may be disposed to be exposed to the outside from the first outer wall surface 112*a*. Therefore, the imaginary extension line 212*a* of the suction part 212 may be disposed on the first outer wall surface 112*a*, and the surface including the extension line 212*a* of the suction part 212 may be referred to as the front surface.

In another point of view, in a state in which a lever pulling arm 161 is coupled to the housing 110, a surface including a side through which the lever pulling arm 161 is exposed to the outside may be referred to as the front surface.

In still another point of view, in the state in which the first cleaner 200 is mounted on the cleaner station 100, an outer surface of the cleaner station 100, which is penetrated by the main body 210 of the first cleaner, may be referred to as the front surface.

Further, in the state in which the first cleaner 200 is mounted on the cleaner station 100, a direction in which the first cleaner 200 is exposed to the outside of the cleaner station 100 may be referred to as a forward direction.

In addition, in another point of view, in the state in which the first cleaner 200 is mounted on the cleaner station 100, a direction in which the suction motor 214 of the first cleaner 200 is disposed may be referred to as the forward direction. Further, a direction opposite to the direction in which the suction motor 214 is disposed on the cleaner station 100 may be referred to as a rearward direction.

In still another point of view, a direction in which an intersection point at which the handle axis a3 and the motor axis a1 intersect is disposed may be referred to as the forward direction on the basis of the cleaner station 100. Alternatively, a direction in which an intersection point at which the handle axis a3 and the suction flow path center line a2 intersect is disposed may be referred to as the forward direction. Alternatively, a direction in which an intersection point at which the motor axis a1 and the suction flow path center line a2 intersect is disposed may be referred to as the forward direction. Further, a direction opposite to the direction in which the intersection point is disposed may be referred to as the rearward direction on the basis of the cleaner station 100.

Further, on the basis of the coupling part 120 and the internal space of the housing 110, a surface facing the front surface may be referred to as a rear surface of the cleaner station 100. Therefore, the rear surface may mean a direction in which the second outer wall surface 112*b* is formed.

Further, on the basis of the internal space of the housing 110, a left surface when viewing the front surface may be referred to as a left surface, and a right surface when viewing the front surface may be referred to as a right surface. Therefore, the left surface may mean a direction in which the third outer wall surface 112*c* is formed, and the right surface may mean a direction in which the fourth outer wall surface 112*d* is formed.

The first outer wall surface 112*a* may be formed in the form of a flat surface, or the first outer wall surface 112*a* may be formed in the form of a curved surface as a whole or formed to partially include a curved surface.

The first outer wall surface 112*a* may have an external appearance corresponding to the shape of the first cleaner 200. In detail, the coupling part 120 may be disposed on the first outer wall surface 112*a*. With this configuration, the first cleaner 200 may be coupled to the cleaner station 100 and supported by the cleaner station 100. The specific configuration of the coupling part 120 will be described below.

In addition, a lever pulling unit 161 may be disposed on the first outer wall surface 112*a*. Specifically, the lever pulling arm 161 of the lever pulling unit 160 may be mounted on the first outer wall surface 112*a*. For example, the first outer wall surface 112*a* may have an arm accommodating groove in which the lever pulling arm 161 may be accommodated. In this case, the arm accommodating groove may be formed to correspond to a shape of the lever pulling arm 161. Therefore, when the lever pulling arm 161 is mounted in the arm accommodating groove, the first outer wall surface 112*a* and an outer surface of the lever pulling arm 161 may define a continuous external shape, and the lever pulling arm 161 may be stroke-moved to protrude from the first outer wall surface 112*a* by the operation of the lever pulling unit 160.

Meanwhile, a structure for mounting various types of cleaning modules 260 used for the first cleaner 200 may be additionally provided on the first outer wall surface 112*a*.

In addition, a structure to which the second cleaner 300 may be coupled may be additionally provided on the first outer wall surface 112*a*. Therefore, the structure corresponding to the shape of the second cleaner 300 may be additionally provided on the first outer wall surface 112*a*.

Further, a cleaner bottom plate (not illustrated) to which the lower surface of the second cleaner 300 may be coupled may be additionally coupled to the first outer wall surface 112*a*. Meanwhile, as another embodiment, the cleaner bottom plate (not illustrated) may be shaped to be connected to the bottom surface 111.

In the present embodiment, the second outer wall surface 112*b* may be a surface facing the first outer wall surface 112*a*. That is, the second outer wall surface 112*b* may be disposed on the rear surface of the cleaner station 100. In this case, the rear surface may be a surface facing the surface to which the first cleaner 200 or the second cleaner 300 is coupled. Therefore, the second outer wall surface 112*b* may define an external appearance of the rear surface of the cleaner station 100.

For example, the second outer wall surface 112*b* may be formed in the form of a flat surface. With this configuration, the cleaner station 100 may be in close contact with a wall in a room, and the cleaner station 100 may be stably supported.

As another example, the structure for mounting various types of cleaning modules 260 used for the first cleaner 200 may be additionally provided on the second outer wall surface 112*b*.

In addition, the structure to which the second cleaner 300 may be coupled may be additionally provided on the second outer wall surface 112*b*. Therefore, the structure corresponding to the shape of the second cleaner 300 may be additionally provided on the second outer wall surface 112*b*.

Further, a cleaner bottom plate (not illustrated) to which the lower surface of the second cleaner 300 may be coupled may be additionally coupled to the second outer wall surface 112*b*. Meanwhile, as another embodiment, the cleaner bottom plate (not illustrated) may be shaped to be connected to the bottom surface 111. With this configuration, when the second cleaner 300 is coupled to the cleaner bottom plate (not illustrated), an overall center of gravity of the cleaner station 100 may be lowered, such that the cleaner station 100 may be stably supported.

In the present embodiment, the third outer wall surface 112*c* and the fourth outer wall surface 112*d* may mean surfaces that connect the first outer wall surface 112*a* and the second outer wall surface 112*b*. In this case, the third outer wall surface 112*c* may be disposed on the left surface of the station 100, and the fourth outer wall surface 112*d* may be disposed on the right surface of the cleaner station 100. Otherwise, the third outer wall surface 112*c* may be disposed on the right surface of the cleaner station 100, and the fourth outer wall surface 112*d* may be disposed on the left surface of the cleaner station 100.

The third outer wall surface 112*c* or the fourth outer wall surface 112*d* may be formed in the form of a flat surface, or the third outer wall surface 112*c* or the fourth outer wall surface 112*d* may be formed in the form of a curved surface as a whole or formed to partially include a curved surface.

Meanwhile, the structure for mounting various types of cleaning modules 260 used for the first cleaner 200 may be additionally provided on the third outer wall surface 112*c* or the fourth outer wall surface 112*d*.

In addition, the structure to which the second cleaner 300 may be coupled may be additionally provided on the third outer wall surface 112*c* or the fourth outer wall surface 112*d*. Therefore, the structure corresponding to the shape of the second cleaner 300 may be additionally provided on the third outer wall surface 112*c* or the fourth outer wall surface 112*d*.

Further, a cleaner bottom plate (not illustrated) to which the lower surface of the second cleaner 300 may be coupled may be additionally provided on the third outer wall surface 112*c* or the fourth outer wall surface 112*d*. Meanwhile, as another embodiment, the cleaner bottom plate (not illustrated) may be shaped to be connected to the bottom surface 111.

FIG. 5 is a view for explaining the coupling part of the cleaner station according to the embodiment of the present disclosure, and FIG. 6 is a view for explaining the arrangement of a fixing unit, a door unit, a cover opening unit, and the lever pulling unit in the cleaner station according to the embodiment of the present disclosure.

The coupling part 120 of the cleaner station 100 according to the present disclosure will be described below with reference to FIGS. 5 and 6.

The cleaner station 100 may include the coupling part 120 to which the first cleaner 200 is coupled. Specifically, the coupling part 120 may be disposed in the first outer wall surface 112*a*, and the main body 210, the dust bin 220, and the battery housing 230 of the first cleaner 200 may be coupled to the coupling part 120.

The coupling part 120 may include the coupling surface 121. The coupling surface 121 may be disposed on the lateral surface of the housing 110. For example, the coupling surface 121 may mean a surface formed in the form of a groove which is concave toward the inside of the cleaner station 100 from the first outer wall surface 112*a*. That is, the coupling surface 121 may mean a surface formed to have a stepped portion with respect to the first outer wall surface 112*a*.

The first cleaner 200 may be coupled to the coupling surface 121. For example, the coupling surface 121 may be in contact with the lower surface of the dust bin 220 and the lower surface of the battery housing 230 of the first cleaner 200. In this case, the lower surface may mean a surface directed toward the ground surface when the user uses the first cleaner 200 or places the first cleaner 200 on the ground surface.

In this case, the coupling between the coupling surface 121 and the dust bin 220 of the first cleaner 200 may mean physical coupling by which the first cleaner 200 and the cleaner station 100 are coupled and fixed to each other. This may be a premise of coupling of a flow path through which the dust bin 220 and a flow path part 180 communicate with each other and a fluid may flow.

Further, the coupling between the coupling surface 121 and the battery housing 230 of the first cleaner 200 may mean physical coupling by which the first cleaner 200 and the cleaner station 100 are coupled and fixed to each other. This may be a premise of electrical coupling by which the battery 240 and a charging part 128 are electrically connected to each other.

For example, an angle of the coupling surface 121 with respect to the ground surface may be a right angle. Therefore, it is possible to minimize a space of the cleaner station 100 when the first cleaner 200 is coupled to the coupling surface 121.

As another example, the coupling surface 121 may be disposed to be inclined at a predetermined angle with respect to the ground surface. Therefore, the cleaner station 100 may be stably supported when the first cleaner 200 is coupled to the coupling surface 121.

The coupling surface 121 may have a dust passage hole 121*a* through which air outside the housing 110 may be introduced into the housing 110. The dust passage hole 121*a* may be formed in the form of a hole corresponding to the shape of the dust bin 220 so that the dust in the dust bin 220 may be introduced into the dust collecting part 170. The dust passage hole 121*a* may be formed to correspond to the shape of the discharge cover 222 of the dust bin 220. The dust passage hole 121*a* may be formed to communicate with a first flow path 181 to be described below.

The coupling part 120 may include the dust bin guide surface 122. The dust bin guide surface 122 may be disposed on the first outer wall surface 112*a*. The dust bin guide surface 122 may be connected to the first outer wall surface 112*a*. In addition, the dust bin guide surface 122 may be connected to the coupling surface 121.

The dust bin guide surface 122 may be formed in a shape corresponding to the outer surface of the dust bin 220. A front outer surface of the dust bin 220 may be coupled to the dust bin guide surface 122. Therefore, it is possible to provide convenience when coupling the first cleaner 200 to the coupling surface 121.

The coupling part 120 may include guide protrusions 123. The guide protrusions 123 may be disposed on the coupling surface 121. The guide protrusions 123 may protrude upward from the coupling surface 121. Two guide protrusions 123 may be disposed to be spaced apart from each other. A distance between the two guide protrusions 123, which are spaced apart from each other, may correspond to a width of the battery housing 230 of the first cleaner 200. Therefore, it is possible to provide convenience when coupling the first cleaner 200 to the coupling surface 121.

The coupling part 120 may include sidewalls 124. The sidewalls 124 may mean wall surfaces disposed on two lateral surfaces of the coupling surface 121 and may be perpendicularly connected to the coupling surface 121. The sidewalls 124 may be connected to the first outer wall surface 112*a*. In addition, the sidewalls 124 may be connected to the dust bin guide surface 122. That is, the sidewalls 124 may define surfaces connected to the dust bin guide surface 122. Therefore, the first cleaner 200 may be stably accommodated.

The coupling part 120 may include the coupling sensor 125. The coupling sensor 125 may detect whether the first cleaner 200 is coupled to the coupling part 120.

The coupling sensor 125 may include a contact sensor. For example, the coupling sensor 125 may include a microswitch. In this case, the coupling sensor 125 may be disposed on the guide protrusion 123. Therefore, when the battery housing 230 or the battery 240 of the first cleaner 200 is coupled between the pair of guide protrusions 123, the battery housing 230 or the battery 240 comes into contact with the coupling sensor 125, such that the coupling sensor 125 may detect that the first cleaner 200 is physically coupled to the cleaner station 100.

Meanwhile, the coupling sensor 125 may include a non-contact sensor. For example, the coupling sensor 125 may include an infrared (IR) sensor. In this case, the coupling sensor 125 may be disposed on the sidewall 124. Therefore, when the dust bin 220 or the main body 210 of the first cleaner 200 passes the sidewall 124 and then reaches the coupling surface 121, the coupling sensor 125 may detect the presence of the dust bin 220 or the main body 210 and detect that the first cleaner 200 is physically coupled to the cleaner station 100.

Meanwhile, the coupling sensor 125 may be further disposed on the dust bin guide surface 122. In this case, the coupling sensor 125 may include a contact sensor. Therefore, when the first cleaner is coupled, the dust bin 220 may push the coupling sensor 125 by means of the weight of the dust bin 220, and the coupling sensor 125 may detect that the first cleaner 200 is coupled.

The coupling sensor 125 may face the dust bin 220 or the battery housing 230 of the first cleaner 200.

The coupling sensor 125 may be a mean for determining whether the first cleaner 200 is coupled and power is applied to the battery 240 of the first cleaner 200.

The coupling part 120 may include the suction part guide surface 126. The suction part guide surface 126 may be disposed on the first outer wall surface 112*a*. The suction part guide surface 126 may be connected to the dust bin guide surface 122. The suction part 212 may be coupled to the suction part guide surface 126. The suction part guide surface 126 may be formed in a shape corresponding to the shape of the suction part 212. Therefore, it is possible to provide convenience when coupling the main body 210 of the first cleaner 200 to the coupling surface 121.

The coupling part 120 may include fixing member entrance holes 127. The fixing member entrance hole 127 may be formed in the form of a long hole along the sidewall 124 so that a fixing member 131 may enter and exit the fixing member entrance hole 127. For example, the fixing member entrance hole 127 may be a rectangular hole formed along the sidewall 124. The fixing member 131 will be described below in detail.

With this configuration, when the user couples the first cleaner 200 to the coupling part 120 of the cleaner station 100, the main body 210 of the first cleaner 200 may be stably disposed on the coupling part 120 by the first to third guide portions 122, 123, and 126. Therefore, it is possible to provide convenience when coupling the dust bin 220 and the battery housing 230 of the first cleaner 200 to the coupling surface 121.

Meanwhile, FIG. 7 is an exploded perspective view for explaining a fixing unit of the cleaner station according to the embodiment of the present disclosure, FIG. 8 is a view for explaining an arrangement of the first cleaner and the fixing unit in the cleaner station according to the embodiment of the present disclosure, and FIG. 9 is a cross-sectional view for explaining for explaining the fixing unit of the cleaner station according to the embodiment of the present disclosure.

A fixing unit 130 according to the present disclosure will be described below and the reference to FIGS. 5 to 9.

The cleaner station 100 according to the present disclosure may include the fixing unit 130. The fixing unit 130 may be disposed on the sidewall 124. In addition, the fixing unit 130 may be disposed on a back surface to the coupling surface 121. The fixing unit 130 may fix the first cleaner 200 coupled to the coupling surface 121. Specifically, the fixing unit 130 may fix the dust bin 220 and the battery housing 230 of the first cleaner 200 coupled to the coupling surface 121.

The fixing unit 130 may include the fixing members 131 configured to fix the dust bin 220 and the battery housing 230 of the first cleaner 200, and a fixing part motor 133 configured to operate the fixing members 131. In addition, the fixing unit 130 may further include fixing part gears 134 configured to transmit power from the fixing part motor 133 to the fixing members 131, and fixing part links 135 configured to convert rotational motions of the fixing part gears 134 into reciprocating motions of the fixing members 131. Further, the fixing unit 13 may further include a fixing part housing 132 configured to accommodate the fixing part motor 133 and the fixing part gears 134.

The fixing members 131 may be disposed on the sidewall 124 of the coupling part 120 and provided on the sidewall 124 so as to reciprocate in order to fix the dust bin 220. Specifically, the fixing members 131 may be accommodated in the fixing member entrance holes 127.

The fixing members 131 may be disposed at both sides of the coupling part 120, respectively. For example, a pair of two fixing members 131 may be symmetrically disposed with respect to the coupling surface 121.

Specifically, the fixing member 131 may include a link coupling portion 131*a*, a movable panel 131*b*, and a movable sealer 131*c*. In this case, the link coupling portion 131*a* may be disposed at one side of the movable panel 131*b*, and the movable sealer 131*c* may be disposed at the other side of the movable panel 131*b*.

The link coupling portion 131*a* is disposed at one side of the movable panel 131*b* and coupled to the fixing part link 135. For example, the link coupling portion 131*a* may protrude in a cylindrical shape or a circular pin shape from a connection projection 131*bb* formed by bending and extending one end of the movable panel 131*b*. Therefore, the link coupling portion 131*a* may be rotatably inserted and coupled into one end of the fixing part link 135.

The movable panel 131*b* may be connected to the link coupling portion 131*a* and provided to be reciprocally movable from the sidewall 124 toward the dust bin 220 by the operation of the fixing part motor 133. For example, the movable panel 131*b* may be provided to be rectilinearly and reciprocally movable along a guide frame 131*d*.

Specifically, one side of the movable panel 131*b* may be disposed to be accommodated in a space in the first outer wall surface 112*a*, and the other side of the movable panel 131*b* may be disposed to be exposed from the sidewall 124.

The movable panel 131*b* may include a panel main body 131*ba*, the connection projection 131*bb*, a first pressing portion 131*bc*, and a second pressing portion 131*bd*. For example, the panel main body 131*ba* may be formed in the form of a flat plate. In addition, the connection projection 131*bb* may be disposed at one end of the panel main body 131*ba*. Further, the first pressing portion 131*bc* may be formed at the other end of the panel main body 131*ba*.

The connection projection 131*bb* may be formed by bending and extending one end of the panel main body 131*ba* toward the fixing part motor 131. The link coupling portion 131*a* may protrude and extend from the tip of the connection projection 131*bb*.

The connection projection 131*bb* may have a frame through hole that may be penetrated by the guide frame 131*d*. For example, the frame through hole may be formed in a shape similar to an 'I' shape.

The first pressing portion 131*bc* is formed at the other end of the panel main body 131*ba* and formed in a shape corresponding to the shape of the dust bin 220 in order to seal the dust bin 220. For example, the first pressing portion 131*bc* may be formed in a shape capable of surrounding a cylindrical shape. That is, the first pressing portion 131*bc* may mean an end portion having a concave arc shape and formed at the other side of the panel main body 131*ba*.

The second pressing portion 131*bd* may be connected to the first pressing portion 131*bc* and formed in a shape corresponding to the shape of the battery housing 230 in order to seal the battery housing 230. For example, the second pressing portion 131*bd* may be formed in a shape capable of pressing the battery housing 230. That is, the second pressing portion 131*bd* may mean an end portion having a straight shape and formed at the other side of the panel main body 131*ba*.

The movable sealer 131*c* may be disposed on a tip in the reciprocation direction of the movable panel 131*b* and may seal the dust bin 220. Specifically, the movable sealer 131*c* may be coupled to the first pressing portion 131*bc* and may seal a space between the dust bin 220 and the first pressing portion 131*bc* when the first pressing portion 131*bc* surrounds and presses the dust bin 220. In addition, the movable sealer 131*c* may be coupled to the second pressing portion 131*bd* and may seal a space between the battery housing 230 and the second pressing portion 131*bd* when the second pressing portion 131*bd* surrounds and presses the battery housing 230.

The fixing unit 130 may further include the guide frames 131*d* coupled to the housing 110 and configured to penetrate the movable panels 131*b* and guide the movements of the fixing members 131. For example, the guide frame 131*d* may be a frame having an 'I' shape that penetrates the connection projection 131*bb*. With this configuration, the movable panel 131*b* may rectilinearly reciprocate along the guide frame 131*d*.

The fixing part housing 132 may be disposed in the housing 110. For example, the fixing part housing 132 may be disposed on the back surface to the coupling surface 121.

The fixing part housing 132 may have therein a space capable of accommodating the fixing part gears 134. Further, the fixing part housing 132 may accommodate the fixing part motor 133.

The fixing part housing 132 may include a first fixing part housing 132*a*, a second fixing part housing 132*b*, link guide holes 132*c*, and a motor accommodation portion 132*d*.

The first fixing part housing 132*a* and the second fixing part housing 132*b* are coupled to each other to define the space capable of accommodating the fixing part gears 134 therein.

For example, the first fixing part housing 132*a* may be disposed in a direction toward the outside of the cleaner station 100, and the second fixing part housing 132*b* may be disposed in a direction toward the inside of the cleaner station 100. That is, the first fixing part housing 132*a* may be disposed in a direction toward the coupling surface 121, and the second fixing part housing 132*b* may be disposed in a direction toward the second outer wall surface 112*b*.

The link guide holes 132*c* may be formed in the first fixing part housing 132*a*. The link guide holes 132*c* may mean holes formed to guide movement routes of the fixing part link 135. For example, the link guide hole 132*c* may mean an arc-shaped hole formed in a circumferential direction about a rotary shaft of the fixing part gear 134.

Two link guide holes 132*c* may be formed to guide the pair of fixing part links 135 for moving the pair of fixing members 132. In addition, the two link guide holes 132*c* may be symmetrically formed.

The motor accommodation portion 132*d* may be provided to accommodate the fixing part motor 133. For example, the motor accommodation portion 132*d* may protrude in a cylindrical shape from the first fixing part housing 132*a* in order to accommodate the fixing part motor 133 therein.

The fixing part motor 133 may provide power for moving the fixing members 131. Specifically, the fixing part motor 133 may rotate the fixing part gears 134 in a forward direction or a reverse direction. In this case, the forward direction may mean a direction in which the fixing member 131 is moved from the sidewall 124 to press the dust bin 220. In addition, the reverse direction may mean a direction in which the fixing member 131 is moved to the inside of the sidewall 124 from a position at which the fixing member 131 presses the dust bin 220. The forward direction may be opposite to the reverse direction.

The fixing part gears 134 may be coupled to the fixing part motor 133 and may move the fixing members 131 using power from the fixing part motor 133.

The fixing part gears 134 may include a driving gear 134*a*, a connection gear 134*b*, a first link rotating gear 134*c*, and a second link rotating gear 134*d*.

A shaft of the fixing part motor 133 may be inserted and coupled into the driving gear 134*a*. For example, the shaft of the fixing part motor 133 may be inserted and fixedly coupled into the driving gear 134*a*. As another example, the driving gear 134*a* may be formed integrally with the shaft of the fixing part motor 133.

The connection gear 134*b* may engage with the driving gear 134*a* and the first link rotating gear 134*c*.

The other end of the fixing part link 135 is rotatably coupled to the first link rotating gear 134*c*, and the first link rotating gear 134*c* may transmit rotational force transmitted from the driving gear 134*a* to the fixing part link 135.

The first link rotating gear 134*c* may include a rotary shaft 134*ca*, a rotation surface 134*cb*, gear teeth 134*cc*, and a link fastening portion 134*cd*.

The rotary shaft 134*ca* may be coupled to and supported by the first fixing part housing 132*a* and the second fixing part housing 132*b*. The rotation surface 134*cb* may be formed in a circular plate shape having a predetermined thickness about the rotary shaft 134*ca*. The gear teeth 134*cc* may be formed on an outer circumferential surface of the rotation surface 134*cb* and may engage with the connection gear 134*b*. Further, the gear teeth 134*cc* may engage with the second link rotating gear 134*d*. With this configuration, the first link rotating gear 134*c* may receive power from the fixing part motor 133 through the driving gear 134*a* and the connection gear 134*b* and transmit the power to the second link rotating gear 134*d*.

The link fastening portion 134*cd* may protrude and extend in a cylindrical shape or a circular pin shape in an axial direction from the rotation surface 134*cb*. The link fastening portion 134*cd* may be rotatably coupled to the other end of the fixing part link 135. For example, the link fastening portion 134*cd* may penetrate the link guide hole 132*c* and may be coupled to the other end of the fixing part link 135. With this configuration, the first link rotating gear 134*c* may be rotated by power from the fixing part motor 133, the fixing part link 135 may be rotated and rectilinearly moved by the rotation of the first link rotating gear 134*c*, and consequently, the fixing member 131 may be moved to fix or release the dust bin 220.

The second link rotating gear 134*d* may engage with the first link rotating gear 134*c* and rotate in a direction opposite to the rotation direction of the first link rotating gear 134*c*.

The other end of the fixing part link 135 is rotatably coupled to the second link rotating gear 134*d*, and the second link rotating gear 134*d* may transmit the rotational force transmitted from the driving gear 134*a* to the fixing part link 135.

The second link rotating gear 134*d* may include a rotary shaft 134*da*, a rotation surface 134*db*, gear teeth 134*dc*, and a link fastening portion 134*dd*.

The rotary shaft 134*da* may be coupled to and supported by the first fixing part housing 132*a* and the second fixing part housing 132*b*. The rotation surface 134*db* may be formed in a circular plate shape having a predetermined thickness about the rotary shaft 134*da*. The gear teeth 134*dc* may be formed on an outer circumferential surface of the rotation surface 134*db* and may engage with the first link rotating gear 134*c*. With this configuration, the second link rotating gear 134*d* may receive the power from the fixing part motor 133 through the driving gear 134*a*, the connection gear 134*b*, and the first link rotating gear 134*c*.

The link fastening portion 134*dd* may protrude and extend in a cylindrical shape or a circular pin shape in an axial direction from the rotation surface 134*db*. The link fastening portion 134*dd* may be rotatably coupled to the other end of the fixing part link 135. For example, the link fastening portion 134*dd* may penetrate the link guide hole 132*c* and may be coupled to the other end of the fixing part link 135. With this configuration, the second link rotating gear 134*d* may be rotated by power from the fixing part motor 133, the fixing part link 135 may be rotated and rectilinearly moved by the rotation of the second link rotating gear 134*d*, and consequently, the fixing member 131 may be moved to fix or release the dust bin 220.

The fixing part links 135 may link the fixing part gears 134 and the fixing members 131 and convert the rotations of the fixing part gears 134 into the reciprocation movements of the fixing members 131.

One end of the fixing part link 135 may be coupled to the link coupling portion 131*a* of the fixing member 131, and the other end of the fixing part link 135 may be coupled to the link fastening portion 134*cd* or 134*dd* of the fixing part gear 134.

The fixing part link 135 may include a link main body 135*a*, a first link connecting portion 135*b*, and a second link connecting portion 135*c*.

For example, the link main body 135*a* may be formed in the form of a frame with a bent central portion. This is to improve efficiency in transmitting power by changing an angle at which a force is transmitted.

The first link connecting portion 135*b* may be disposed at one end of the link main body 135*a*, and the second link connecting portion 135*c* may be disposed at the other end of the link main body 135*a*. The first link connecting portion 135*b* may be protrude in a cylindrical shape from one end of the link main body 135*a*. The first link connecting portion 135*b* may have a hole into which the link coupling portion 131*a* may be inserted and coupled. The second link connecting portion 135*c* may protrude in a cylindrical shape from the other end of the link main body 135*a*. In this case, a height by which the second link connecting portion 135*c* protrudes may be greater than a height by which the first link connecting portion 135*b* protrudes. This is to enable the link fastening portions 134*cd* and 134*dd* of the fixing part gears 134 to be accommodated in the link guide holes 132*c* and move along the link guide holes 132*c*, and to support the link fastening portions 134*cd* and 134*dd* when the link fastening portions 134*cd* and 134*dd* rotate. The second link connecting portion 135*c* may have a hole into which the link fastening portion 134*cd* or 134*dd* may be inserted and coupled.

A stationary sealer 136 may be disposed on the dust bin guide surface 122 so as to seal the dust bin 220 when the cleaner 200 is coupled. With this configuration, when the dust bin 220 of the cleaner 200 is coupled, the cleaner 200 may press the stationary sealer 136 by its own weight, such that the dust bin 220 and the dust bin guide surface 122 may be sealed.

The stationary sealer 136 may be disposed in an imaginary extension line of the movable sealer 131*c*. With this configuration, when the fixing part motor 133 operates and the fixing members 131 press the dust bin 220, a circumference of the dust bin 220 at the same height may be sealed. That is, the stationary sealer 136 and the movable sealers 131*c* may seal outer circumferential surfaces of the dust bin 220 disposed on concentric circles.

According to the embodiment, the stationary sealer 136 may be disposed on the dust bin guide surface 122 and formed in the form of a bent line corresponding to an arrangement of a cover opening unit 150 to be described below.

Therefore, when the main body 210 of the first cleaner 200 is disposed on the coupling part 120, the fixing unit 130 may fix the main body 210 of the first cleaner 200. Specifically, when the coupling sensor 125 detects that the main body 210 of the first cleaner 200 is coupled to the coupling part 120 of the cleaner station 100, the fixing part motor 133 may move the fixing members 131 to fix the main body 210 of the first cleaner 200.

The fixing unit 130 may further include fixing detecting parts 137 capable of detecting the movements of the fixing members 131.

The fixing detecting parts 137 may be provided in the housing 100 and may detect whether the dust bin 220 is fixed.

For example, the fixing detecting parts 137 may be disposed at both ends in a rotational region of the fixing part links 135, respectively. That is, in the rotational region of the fixing part links 135, a first fixing detecting part 137*a* may be disposed at an end portion in a direction in which the fixing members 131 are pushed toward the dust bin 220. In addition, in the rotational region of the fixing part links 135, a second fixing detecting part 137*b* may be disposed at an end portion in a direction in which the fixing members 131 are moved away from the dust bin 220. Otherwise, as another example, the fixing detecting parts 137 may be disposed at both ends of a rectilinear movement region of the fixing members 131, respectively.

Therefore, when the fixing part link 135 is moved to a predetermined position (hereinafter, also referred to as a 'dust bin fixing position FP1') at which the first fixing detecting part 137*a* is disposed or when the fixing member 131 is rectilinearly moved to a predetermined position, the fixing detecting part 137 may detect the movement and transmit a signal indicating that the dust bin 220 is fixed. In addition, when the fixing part link 135 is moved to a predetermined position (hereinafter, also referred to as a 'dust bin releasing position FP2') at which the second fixing detecting part 137*b* is disposed or when the fixing member 131 is rectilinearly moved to a predetermined position, the fixing detecting part 137 may detect the movement and transmit a signal indicating that the dust bin 220 is released.

The fixing detecting part 137 may include a contact sensor. For example, the fixing detecting part 137 may include a micro-switch.

Meanwhile, the fixing detecting part 137 may include a non-contact sensor. For example, the fixing detecting part 137 may include an infrared (IR) sensor.

A method of controlling the fixing unit 130 will be described below together with a description of a control unit 400 of the cleaner station 100 according to the present disclosure.

Meanwhile, FIG. 9A illustrates another embodiment of a fixing unit 1130 of the cleaner station according to the present disclosure.

In order to avoid a repeated description, the contents related to the fixing unit 130 according to the embodiment of the present disclosure may be used to describe other components except for the components particularly mentioned in the present embodiment.

In the present embodiment, a fixing member 1131 may fix the dust bin 220 and the battery housing 230 by an upward/downward rectilinear movement of a fixing part frame 1135.

That is, when the fixing part frame 1135 is rectilinearly moved upward by an operation of a fixing part motor 1133, the fixing member 1131 is moved in the sidewall 124 toward the dust bin 220 by being guided by the fixing part frame 1135.

In this case, fixing detecting parts 1137 may be disposed at both ends in a movement region of the fixing part frame 1135, respectively. That is, a first fixing detecting part 1137*a* may be disposed at an upper end in the movement region of the fixing part frame 1135. In addition, a second fixing detecting part 1137*b* may be disposed at a lower end in the movement region of the fixing part frame 1135.

Therefore, when the fixing part frame 1135 is moved to a predetermined position (hereinafter, also referred to as the 'dust bin fixing position FP1') at which the first fixing detecting part 1137*a* is disposed, a sensor touch bar 1135*a* protruding from the fixing part frame 1135 pushes the first fixing detecting part 1137*a*, and the first fixing detecting part 1137*a* may transmit a signal indicating that the dust bin 220 is fixed. In addition, when the fixing part frame 1135 is moved to a predetermined position (hereinafter, also referred to as the 'dust bin releasing position FP2') at which the second fixing detecting part 1137*b* is disposed, the sensor touch bar 1135*a* pushes the second fixing detecting part 1137*b*, and the second fixing detecting part 1137*b* may transmit a signal indicating that the dust bin 220 is released.

Therefore, the amount of vibration and impact, which occur when the discharge cover 222 of the main body 210 of the fixed first cleaner 200 is separated from the dust bin 220, is increased, and as a result, it is possible to improve efficiency in moving the dust stored in the dust bin 220 to the dust collecting part 170 of the cleaner station 100. That is, it is possible to improve the suction force of the cleaner by preventing the residual dust from remaining in the dust bin. Further, it is possible to remove an offensive odor caused by the residual dust by preventing the residual dust from remaining in the dust bin.

Meanwhile, FIG. 10 is a view for explaining a relationship between the first cleaner and the door unit in the cleaner station according to the embodiment of the present disclosure.

A door unit 140 according to the present disclosure will be described below with reference to FIGS. 5, 6, and 10.

The cleaner station 100 according to the present disclosure may include the door unit 140. The door unit 140 may be configured to open or close the dust passage hole 121*a*.

The door unit 140 may include a door 141, a door motor 142, and a door arm 143.

The door 141 may be hingedly coupled to the coupling surface 121 and may open or close the dust passage hole 121*a*. The door 141 may include a door main body 141*a*, a hinge part 141*b*, and an arm coupling part 141*c*.

The door main body 141*a* may be formed in a shape capable of blocking the dust passage hole 121*a*. For example, the door main body 141*a* may be formed in a shape similar to a circular plate shape. On the basis of a state in which the door main body 141*a* blocks the dust passage hole 121*a*, the hinge part 141*b* may be disposed at an upper side of the door main body 141*a*, and the arm coupling part 141*c* may be disposed at a lower side of the door main body 141*a*.

The door main body 141*a* may be formed in a shape capable of sealing the dust passage hole 121*a*. For example, an outer surface of the door main body 141*a*, which is exposed to the outside of the cleaner station 100, is formed to have a diameter corresponding to a diameter of the dust passage hole 121*a*, and an inner surface of the door main body 141*a*, which is disposed in the cleaner station 100, is formed to have a diameter greater than the diameter of the dust passage hole 121*a*. In addition, a level difference may be defined between the outer surface and the inner surface. Meanwhile, one or more reinforcing ribs may protrude from the inner surface in order to connect the hinge part 141*b* and the arm coupling part 141*c* and reinforce a supporting force of the door main body 141*a*.

The hinge part 141*b* may be a means by which the door 141 is hingedly coupled to the coupling surface 121. The hinge part 141*b* may be disposed at an upper end of the door main body 141*a* and coupled to the coupling surface 121.

The arm coupling part 141*c* may be a means to which the door arm 143 is rotatably coupled. The arm coupling part 141*c* may be disposed at a lower side of the inner surface, and the door arm 143 may be rotatably coupled to the arm coupling part 141*c*.

With this configuration, when the door arm 143 pulls the door main body 141*a* in the state in which the door 141 closes the dust passage hole 121*a*, the door main body 141*a* is rotated about the hinge part 141*b* toward the inside of the cleaner station 100, such that the dust passage hole 121*a* may be opened. Meanwhile, when the door arm 143 pushes the door main body 141*a* in the state in which the dust passage hole 121*a* is opened, the door main body 141*a* is rotated about the hinge part 141*b* toward the outside of the cleaner station 100, such that the dust passage hole 121*a* may be closed.

The door motor 142 may provide power for rotating the door 141. Specifically, the door motor 142 may rotate the door arm 143 in a forward direction or a reverse direction. In this case, the forward direction may mean a direction in which the door arm 143 pulls the door 141. Therefore, when the door arm 143 is rotated in the forward direction, the dust passage hole 121*a* may be opened. In addition, the reverse direction may mean a direction in which the door arm 143 pushes the door 141. Therefore, when the door arm 143 is rotated in the reverse direction, at least a part of the dust passage hole 121*a* may be closed. The forward direction may be opposite to the reverse direction.

The door arm 143 may connect the door 141 and the door motor 142 and open or close the door 141 using the power generated from the door motor 142.

For example, the door arm 143 may include a first door arm 143*a* and a second door arm 143*b*. One end of the first door arm 143*a* may be coupled to the door motor 142. The first door arm 143*a* may be rotated by the power of the door motor 142. The other end of the first door arm 143*a* may be rotatably coupled to the second door arm 143*b*. The first door arm 143*a* may transmit a force transmitted from the door motor 142 to the second door arm 143*b*. One end of the second door arm 143*b* may be coupled to the first door arm 143*a*. The other end of the second door arm 143*b* may be coupled to the door 141. The second door arm 143*b* may open or close the dust passage hole 121*a* by pushing or pulling the door 141.

The door unit 140 may further include door opening/closing detecting parts 144. The door opening/closing detecting parts 144 may be provided in the housing 100 and may detect whether the door 141 is in an opened state.

For example, the door opening/closing detecting parts 144 may be disposed at both ends in a rotational region of the door arm 143, respectively. That is, in the rotational region of the door arm 143, a first door opening/closing detecting part 144*a* may be disposed at an end in a direction in which the door 141 is opened. In addition, in the rotational region of the door arm 143, a second door opening/closing detecting part 144*b* may be disposed at an end in a direction in which the door 141 is closed.

Therefore, when the door arm 143 is moved to a predetermined position (hereinafter, referred to as an 'opened position DP1') at which the first door opening/closing detecting part 144*a* is disposed, the door opening/closing detecting part 144 may detect that the door is opened. In addition, when the door arm 143 is moved to a predetermined position (hereinafter, referred to as a 'closed position DP2'), the door opening/closing detecting part 144 may detect that the door is closed.

The door opening/closing detecting parts 144 may transmit a signal indicating that the door is opened and transmit a signal indicating that the door is closed.

The door opening/closing detecting part 144 may include a contact sensor. For example, the door opening/closing detecting part 144 may include a micro-switch.

Meanwhile, the door opening/closing detecting part 144 may also include a non-contact sensor. For example, the door opening/closing detecting part 144 may include an infrared (IR) sensor.

With this configuration, the door unit 140 may selectively open or close at least a part of the coupling surface 121, thereby allowing the outside of the first outer wall surface 112*a* to communicate with the first flow path 181 and/or the dust collecting part 170.

The door unit 140 may be opened when the discharge cover 222 of the first cleaner 200 is opened. In addition, when the door unit 140 is closed, the discharge cover 222 of the first cleaner 200 may also be closed.

When the dust in the dust bin 220 of the first cleaner 200 is removed, the door motor 142 may rotate the door 141, thereby coupling the discharge cover 222 to the dust bin main body 221. Specifically, the door motor 142 may rotate the door 141 to rotate the door 142 about the hinge part 141*b*, and the door 142 rotated about the hinge part 141*b* may push the discharge cover 222 toward the dust bin main body 221.

FIG. 11 is a view for explaining the lower surface of the dust bin of the first cleaner according to the embodiment of the present disclosure, FIG. 12 is a view for explaining a relationship between the first cleaner and the cover opening unit in the cleaner station according to the embodiment of the present disclosure, and FIG. 13 is a perspective view for explaining the cover opening unit of the cleaner station according to the embodiment of the present disclosure.

The cover opening unit 150 according to the present disclosure will be described below with reference to FIGS. 5, 6, and 11 to 13.

The cleaner station 100 according to the present disclosure may include the cover opening unit 150. The cover opening unit 150 may be disposed on the coupling part 120 and may open the discharge cover 222 of the first cleaner 200.

The cover opening unit 150 may include a push protrusion 151, a cover opening motor 152, cover opening gears 153, a support plate 154, and a gear box 155.

The push protrusion 151 may move to press the coupling lever 222*c* when the first cleaner 200 is coupled.

The push protrusion 151 may be disposed on the dust bin guide surface 122.

Specifically, a protrusion moving hole may be formed in the dust bin guide surface 122, and the push protrusion 151 may be exposed to the outside by passing through the protrusion moving hole.

When the first cleaner 100 is coupled, the push protrusion 151 may be disposed at a position at which the push protrusion 151 may push the coupling lever 222*c*. That is, the coupling lever 222*c* may be disposed on the protrusion moving hole. In addition, the coupling lever 222*c* may be disposed in a movement region of the push protrusion 151.

The push protrusion 151 may rectilinearly reciprocate to press the coupling lever 222*c*. Specifically, the push protrusion 151 may be coupled to the gear box 155, such that the rectilinear movement of the push protrusion 151 may be guided. The push protrusion 151 may be coupled to the cover opening gears 153 and moved together with the cover opening gears 153 by the movements of the cover opening gears 153.

For example, the push protrusion 151 may include a protrusion portion 151*a*, a protrusion support plate 151*b*, a connection portion 151*c*, a gear coupling block 151*d*, and guide frames 151*e*.

The protrusion portion 151*a* may be provided to push the coupling lever 222*c*. The protrusion portion 151*a* may be formed in a protrusion shape similar to a hook shape, a right-angled triangular shape, or a trapezoidal shape. The protrusion support plate 151*b* may be connected to the protrusion portion 151*a* and formed in the form of a flat plate for supporting the protrusion portion 151*a*.

The protrusion support plate 151*b* may be provided to be movable along an upper surface of the gear box 155. The connection portion 151*c* may connect the protrusion support plate 151*b* and the gear coupling block 151*d*. The connection portion 151*c* may be formed to have a narrower width than the protrusion support plate 151*b* and the gear coupling block 151*d*.

The connection portion 151*c* may be disposed to penetrate a protrusion through hole 155*b* formed in the gear box 155. The gear coupling block 151*d* may be coupled to the cover opening gears 153. The gear coupling block 151*d* may be fixedly coupled to the cover opening gears 153 using a member such as a screw or a piece.

The gear coupling block 151*d* may be accommodated in the gear box 155 and may be rectilinearly reciprocated in the gear box 155 by the movement of the cover opening gears 153. The guide frames 151*e* may protrude and extend from two lateral surfaces of the gear coupling block 151*d*, respectively. The guide frames 151*e* may be protrude and extend in a quadrangular column shape from the gear coupling block 151*d*.

The guide frame 151*e* may be disposed to penetrate a guide hole 155*c* formed in the gear box 155. Therefore, when the gear coupling block 151*d* rectilinearly moves, the guide frame 151*e* may rectilinearly reciprocate along the guide hole 155*c*.

The cover opening motor 152 may provide power for moving the push protrusion 151. Specifically, the cover opening motor 152 may rotate a motor shaft 152*a* in a forward direction or a reverse direction. In this case, the forward direction may mean a direction in which the push protrusion 151 pushes the coupling lever 222*c*. In addition, the reverse direction may mean a direction in which the push protrusion 151, which has pushed the coupling lever 222*c*, returns back to an original position. The forward direction may be opposite to the reverse direction.

The cover opening motor 152 may be disposed outside the gear box 155. The motor shaft 152*a* of the cover opening motor 152 may penetrate a motor through hole 155*e* of the gear box 155 and may be coupled to the cover opening gears 153. For example, the motor shaft 152*a* may be coupled to an opening driving gear 153*a* and rotated together with the opening driving gear 153*a*.

The cover opening gears 153 may be coupled to the cover opening motor 152 and may move the push protrusion 151 using the power from the cover opening motor 152. Specifically, the cover opening gears 153 may be accommodated in the gear box 155. The cover opening gears 153 may be coupled to the cover opening motor 152 and supplied with the power. The cover opening gears 153 may be coupled to the push protrusion 151 to move the push protrusion 151.

The cover opening gears 153 may include the opening driving gear 153*a* and an opening driven gear 153*b*. Specifically, the shaft 152*a* of the cover opening motor 152 is inserted and coupled into the opening driving gear 153*a*, such that the opening driving gear 153*a* may receive rotational power from the cover opening motor 152.

The opening driven gear 153*b* may engage with the opening driving gear 153*a* and may be coupled to the gear coupling block 151*d* of the push protrusion 151, thereby moving the push protrusion 151. For example, the opening driven gear 153*b* may be formed in the form of a rack gear so as to engage with the opening driving gear 153*a* formed in the form of a pinion gear. The opening driven gear 153*b* may include a body portion 153*ba* coupled to the gear coupling block 151*d*. In addition, the opening driven gear 153*b* may include a gear portion 153*bb* formed at a lower side of the body portion 153*ba* and configured to engage with the opening driving gear 153*a*. Further, the opening driven gear 153*b* may include guide shafts 153*bc* protruding from the two lateral surfaces of the body portion 153*ba*. In addition, the opening driven gear 153*b* may include gear wheels 153*bd* into which the guide shafts 153*bc* are inserted and coupled, and the gear wheels 153*bd* may rollably move along guide rails 155*d* formed in an inner surface of the gear box 155.

The support plate 154 may be provided to support one surface of the dust bin 220. Specifically, the support plate 154 may extend from the coupling surface 121. The support plate 154 may protrude and extend toward a center of the dust passage hole 121*a* from the coupling surface 121.

The support plate 154 may protrude and extend symmetrically from the coupling surface 121, but the present disclosure is not limited thereto, and the support plate 154 may have various shapes capable of supporting the lower extension portion 221*a* of the first cleaner 200 or the lower surface of the dust bin 220.

When the first cleaner 200 is coupled to the cleaner station 100, the lower surface of the dust bin 220 may be disposed in the dust passage hole 121*a*, and the support plate 154 may support the lower surface of the dust bin 220. The discharge cover 222 may be openably and closably provided at the lower side of the dust bin 220, and the dust bin 220 may include the cylindrical dust bin main body 221 and the extending lower extension portion 221*a*. In this case, the support plate 154 may be in contact with the lower extension portion 221*a* and may support the lower extension portion 221*a*.

With this configuration, the push protrusion 151 may push the coupling lever 222*c* of the discharge cover 222 in the state in which the support plate 154 supports the lower extension portion 221*a*. Therefore, the discharge cover 222 may be opened, and the dust passage hole 121*a* and the inside of the dust bin 220 may communicate with each other. That is, as the discharge cover 222 is opened, the flow path part 180 and the inside of the dust bin 220 may communicate with each other, and the cleaner station 100 and the first cleaner 200 may be coupled to each other to enable a flow of a fluid (coupling of the flow path).

The gear box 155 may be coupled to the inner surface of the housing 110 and disposed at the lower side of the coupling part 120 in the gravitational direction, and the cover opening gears 153 may be accommodated in the gear box 155. Specifically, the box main body 155*a* has a space capable of accommodating the cover opening gears 153, and the protrusion through hole 155*b*, which is penetrated by the connection portion 151*c* of the push protrusion 151, is formed in an upper surface of the box main body 155*a*. In addition, the guide hole 155*c* is formed in the form of a long hole in the lateral surface in a leftward/rightward direction of the box main body 155*a*, such that the guide frame 151*e* of the push protrusion 151 penetrates the guide hole 155*c*.

Meanwhile, the guide rails 155*d* may be formed on the inner surfaces at the lateral sides in the leftward/rightward direction of the box main body 155*a*. The guide rails 155*d* may support the opening driven gear 153*b* and guide the movement of the opening driven gear 153*b*.

The motor through hole 155*e* may be formed in one surface of the gear box 155, and the shaft 152*a* of the cover opening motor 152 may penetrate the motor through hole 155*e*.

Cover opening detecting parts 155*f* may be disposed on the lateral surface of the gear box 155.

The cover opening detecting part 155*f* may include a contact sensor. For example, the cover opening detecting part 155*f* may include a micro-switch. Meanwhile, the cover opening detecting part 155*f* may also include a non-contact sensor. For example, the cover opening detecting part 155*f* may include an infrared (IR) sensor. Therefore, the cover opening detecting part 155*f* may detect a position of the guide frame 151*e*, thereby detecting a position of the push protrusion 151.

The cover opening detecting parts 155*f* may be disposed at both ends of the guide hole 155*c* formed in the form of a long hole, respectively. That is, in a movement region of the guide frame 151*e*, the first cover opening detecting part 155*fa* may be disposed at an end in a direction in which the discharge cover 222 is opened. In addition, in the movement region of the guide frame 151*e*, the second cover opening detecting part 155*fb* may be disposed at an end in a direction in which the push protrusion 151 returns to the original position.

Therefore, when the push protrusion 151 is moved to a position at which the push protrusion 151 may push the coupling lever 222*c* to open the discharge cover 222, the guide frame 151*e* may be positioned at a predetermined position (hereinafter, referred to as a 'cover opened position CP1'), and the cover opening detecting part 155*f* may transmit a signal indicating that the discharge cover 222 is opened. In addition, when the push protrusion 151 returns back to the original position, the guide frame 151*e* may be positioned at a predetermined position (hereinafter, referred to as a 'cover non-opened position CP2'), and the cover opening detecting part 155*f* may transmit a signal indicating that the push protrusion 151 has returned back to the original position.

With this configuration, the cover opening unit 150 may selectively open or close the lower portion of the dust bin 220 by separating the coupling lever 222*c* from the dust bin 220. In this case, the dust in the dust bin 220 may be captured into the dust collecting part 170 by the impact that occurs when the discharge cover 222 is separated from the dust bin 220.

Therefore, in the case in which the main body 210 of the first cleaner 200 is fixed to the coupling part 120, the cover opening motor 152 may move the push protrusion 151 to separate the discharge cover 222 from the dust bin 220. When the discharge cover 222 is separated from the dust bin 220, the dust in the dust bin 220 may be captured into the dust collecting part 170.

Accordingly, according to the present disclosure, the cover opening unit 150 may open the dust bin 220 even though the user separately opens the discharge cover 222 of the first cleaner, and as a result, it is possible to improve convenience.

In addition, since the discharge cover 222 is opened in the state in which the first cleaner 200 is coupled to the cleaner station 100, it is possible to prevent the dust from scattering.

Meanwhile, FIG. 14 is a view for explaining a relationship between the first cleaner and the lever pulling unit in the cleaner station according to the embodiment of the present disclosure.

The lever pulling unit 160 according to the present disclosure will be described below with reference to FIGS. 5, 6, and 14.

The cleaner station 100 according to the present disclosure may include the lever pulling unit 160. The lever pulling unit 160 may be disposed on the first outer wall surface 112*a* of the housing 110. The lever pulling unit 160 may push the dust bin compression lever 223 of the first cleaner 200 to compress the dust in the dust bin 220.

The lever pulling unit 160 may include a lever pulling arm 161, an arm gear 162, a stroke drive motor 163, a rotation drive motor 164, and arm movement detecting parts 165.

The lever pulling arm 161 is accommodated in the housing 110 and may be provided to be stroke-movable and rotatable. For example, the lever pulling arm 161 may be accommodated in an arm accommodating groove formed in the first outer wall surface 112*a*. In this case, when an imaginary cylindrical shape is defined with respect to a lower end of the arm accommodating groove, the dust bin compression lever 223 may be disposed in the imaginary cylindrical shape.

The lever pulling arm 161 may be provided to push the dust bin compression lever 223. The lever pulling arm 161 may be formed to correspond to a shape of the arm accommodating groove. For example, the lever pulling arm 161 may be formed in a shape similar to an elongated bar.

One surface of the lever pulling arm 161 may be formed to define a continuous surface together with the first outer wall surface 112*a* in the state in which the lever pulling arm 161 is accommodated in the arm accommodating groove. The arm gear 162 may be coupled to one side of the other surface of the lever pulling arm 161.

The arm gear 162 may be coupled to the lever pulling arm 161, the stroke drive motor 163, and the rotation drive motor 164. For example, the arm gear 162 may be formed to be similar to a kind of shaft. One end of the shaft of the arm gear 162 may be fixedly coupled to the lever pulling arm 161. The other end of the shaft of the arm gear 162 may be provided in the form of a worm wheel. Therefore, the other end of the shaft of the arm gear 162 is formed in the form of a worm gear and may engage with the rotation drive motor 164. The shaft of the arm gear 162 may be formed in the form of a cylindrical worm. The shaft of the arm gear 162 may be formed in the form of a worm gear and may engage with the stroke drive motor 163.

The stroke drive motor 163 may provide power for stroke-moving the lever pulling arm 161. The stroke drive motor 163 may rotate in a forward direction or a reverse direction. In this case, the forward direction may mean a direction in which the lever pulling arm 161 is moved away from the housing 110 of the cleaner station 100. In addition, the reverse direction may mean a direction in which the lever pulling arm 161 is pulled toward the cleaner station 100. The forward direction may be opposite to the reverse direction.

The rotation drive motor 164 may provide power for rotating the lever pulling arm 161. The rotation drive motor 164 may rotate in a forward direction or a reverse direction. In this case, the forward direction may mean a direction in which the lever pulling arm 161 rotates to a position at which the lever pulling arm 161 may push the dust bin compression lever 223. In addition, the reverse direction may be a direction opposite to the forward direction.

The stroke drive motor 163 and the rotation drive motor 164 may be disposed in the housing 110.

The arm movement detecting parts 165 may be disposed in the housing 110. The arm movement detecting parts 165 may be disposed on a movement route of the shaft of the arm gear 162. The arm movement detecting parts 165 may be disposed at an initial position LP1 of the shaft of the arm gear 162, a maximum stroke movement position LP2, and a position LP3 when the compression lever 223 is pulled, respectively.

The arm movement detecting part 165 may include a contact sensor. For example, the arm movement detecting part 165 may include a micro-switch. Meanwhile, the arm movement detecting part 165 may also include a non-contact sensor. For example, the arm movement detecting part 165 may include an infrared (IR) sensor. With this configuration, the arm movement detecting parts 165 may detect a stroke position of the arm gear 162.

In addition, the arm movement detecting parts 165 may be disposed at the other end of the shaft of the arm gear 162. The arm movement detecting parts 165 may be disposed at the other end of the arm gear 162 provided in the form of a worm wheel and may detect a rotation position. The arm movement detecting part 165 may include a contact sensor. For example, the arm movement detecting part 165 may include a micro-switch. Meanwhile, the arm movement detecting part 165 may also include a non-contact sensor. For example, the arm movement detecting part 165 may include an infrared (IR) sensor or a Hall sensor.

Therefore, the arm movement detecting part 165 may detect that the lever pulling arm 161 is positioned at the initial position LP1. In addition, the arm movement detecting part 165 may detect that the lever pulling arm 161 has been moved maximally away from the housing 110 (LP2). In addition, the arm movement detecting part 165 may detect that the lever pulling arm 161 rotates to pull the compression lever 223. In addition, the arm movement detecting part 165 may detect that the lever pulling arm 161 has pulled the compression lever 223. In addition, the arm movement detecting part 165 may detect that the lever pulling arm 161 rotates to the original position after pulling the compression lever 223.

Therefore, when the first cleaner 200 is coupled to the coupling part 120, the compression member (not illustrated) may move downward as the lever pulling arm 161 stroke-moves, thereby compressing the dust in the dust bin 220. In one embodiment of the present specification, the dust in the dust bin 220 may be captured primarily into the dust separating part 130 by gravity as the discharge cover 222 is separated from the dust bin 220, and then the residual dust in the dust bin 125 may be captured secondarily into the dust separating part 130 by a compression part 250. Otherwise, the compression member (not illustrated) may compress the dust in the dust bin 220 downward in the state in which the discharge cover 222 is coupled to the dust bin 220, and then the discharge cover 222 may be separated from the dust bin 220, such that the dust in the dust bin 220 may be captured into the dust separating part 130.

Meanwhile, FIG. 14A illustrates another embodiment of the lever pulling unit according to the present disclosure.

In order to avoid a repeated description, the contents related to the lever pulling unit 160 according to the embodiment of the present disclosure may be used to describe other components except for the components particularly mentioned in the present embodiment.

In the present embodiment, an arm gear 2162 and a shaft 2166 may be separately provided, and the arm gear 2162 and the shaft 2166 may be provided in parallel with each other. In addition, the shaft 2166 may be coupled to be stroke movable relative to the arm gear 2162. That is, in order to connect the shaft 2166 to the arm gear 2162, an internal screw thread may be formed on an inner surface of a connection portion of the shaft 2166.

Therefore, when the arm gear 2162 is rotated by an operation of a stroke drive motor 2163, the shaft 2166 may stroke-move along a screw thread of the arm gear 2162.

Meanwhile, a lever pulling arm 2161 may be provided at one end of the shaft 2166, a worm wheel 2166*a* may be provided at the other end of the shaft 2166, and a rotation drive motor 2164 may engage with the worm wheel 2166*a*.

Therefore, when the rotation drive motor 2164 operates, the shaft 2166 may be rotated, and the lever pulling arm 2161 may be rotated.

Arm movement detecting parts 2165 may be disposed adjacent to the arm gear 2162 and arranged on a movement route of the shaft 2166. The arm movement detecting parts 2165 may be disposed at an initial position LP1 of the shaft 2166, a maximum stroke movement position LP2, and a position LP3 when the compression lever 223 is pulled, respectively.

That is, a first arm movement detecting part 2165*a* may be disposed at the initial position LP1 of the shaft. In addition, a second arm movement detecting part 2165*b* may be disposed at the maximum stroke movement position LP2. In addition, a third arm movement detecting part 2165*c* may be disposed at the position LP3 when the compression lever 223 is pulled.

The arm movement detecting part 2165 may include a contact sensor. For example, the arm movement detecting part 2165 may include a micro-switch. Meanwhile, the arm movement detecting part 2165 may also include a non-contact sensor. For example, the arm movement detecting part 2165 may include an infrared (IR) sensor. With this configuration, the arm movement detecting parts 2165 may detect a stroke position of the shaft 2166.

In addition, the arm movement detecting parts 2165 may include a fourth arm movement detecting part 2165*d* disposed at the other end 2166*a* of the shaft. The fourth arm movement detecting part 2165*d* may detect a rotation position of the shaft 2166. The fourth arm movement detecting part 2165*d* may include a contact sensor. For example, the fourth arm movement detecting part 2165*d* may include a micro-switch. Meanwhile, the fourth arm movement detecting part 2165*d* may also include a non-contact sensor. For example, the fourth arm movement detecting part 2165*d* may include an infrared (IR) sensor or a Hall sensor.

Therefore, the first arm movement detecting part 2165*a* may detect that the lever pulling arm 2161 is positioned at the initial position LP1. In addition, the second arm movement detecting part 2165*b* may detect that the lever pulling arm 2161 has been moved maximally away from the housing 2110 (LP2). In addition, the fourth arm movement detecting part 2165*d* may detect that the lever pulling arm 2161 rotates to pull the compression lever 223. In addition, the third arm movement detecting part 2165*d* may detect that the lever pulling arm 2161 has pulled the compression lever 223. In addition, the fourth arm movement detecting part 2165*d* may detect that the lever pulling arm 2161 rotates to the original position after pulling the compression lever 223.

Meanwhile, the dust collecting part 170 will be described below with reference to FIGS. 2 and 15 to 17.

The cleaner station 100 may include the dust collecting part 170. The dust collecting part 170 may be disposed in the housing 110. The dust collecting part 170 may be disposed at a lower side in the gravitational direction of the coupling part 120.

The dust collecting part 170 may include a roll vinyl film (not illustrated). The roll vinyl film may be fixed to the housing 110 and spread downward by a load of the dust falling from the dust bin 220.

The cleaner station 100 may include a joint part (not illustrated). The joint part may be disposed in the housing 110. The joint part may be disposed in an upper region of the dust collecting part 170. The joint part may cut and join an upper region of the roll vinyl film in which the dust is captured. Specifically, the joint part may retract the roll vinyl film to a central region and join the upper region of the roll vinyl film using a heating wire. The joint part may include a first joint member (not illustrated) and a second joint member (not illustrated). The first joint member (not illustrated) may be moved in a first direction by a first joint drive part 174, and the second joint member (not illustrated) may be moved in a second direction perpendicular to the first direction by a second joint drive part 175.

With this configuration, the dust captured from the first cleaner 200 or the second cleaner 200 may be collected in the roll vinyl film, and the roll vinyl film may be automatically joined. Therefore, it is not necessary for the user to separately bind a bag in which the dust is captured, and as a result, it is possible to improve convenience for the user.

Meanwhile, the flow path part 180 will be described below with reference to FIGS. 2 and 15 to 17.

The cleaner station 100 may include the flow path part 180. The flow path part 180 may connect the first cleaner 200 or the second cleaner 300 to the dust collecting part 170.

The flow path part 180 may include the first flow path 181, a second flow path 182, and a flow path switching valve 183.

The first flow path 181 may connect the dust bin 220 of the first cleaner 200 to the dust collecting part 170. The first flow path 181 may be disposed at a rear side of the coupling surface 121. The first flow path 181 may mean a space between the dust bin 220 of the first cleaner 200 and the dust collecting part 170. The first flow path 181 may be a space formed at a rear side of the dust passage hole 121*a*. The first flow path 181 may be a flow path bent downward from the dust passage hole 121*a*, and the dust and the air may flow through the first flow path 181. The dust in the dust bin 220 of the first cleaner 200 may move to the dust collecting part 170 through the first flow path 181.

The second flow path 182 may connect the second cleaner 300 to the dust collecting part 170. The dust in the second cleaner 300 may move to the dust collecting part 170 through the second flow path 182.

The flow path switching valve 183 may be disposed between the dust collecting part 170, the first flow path 181, and the second flow path 182. The flow path switching valve 183 may selectively open or close the first flow path 181 and the second flow path 182 connected to the dust collecting part 170. Therefore, it is possible to prevent a decrease in suction force caused when the plurality of flow paths 181 and 182 is opened.

For example, in a case in which only the first cleaner 200 is coupled to the cleaner station 100, the flow path switching valve 183 may connect the first flow path 181 to the dust collecting part 170 and disconnect the second flow path 182 from the dust collecting part 170.

As another example, in a case in which only the second cleaner 300 is coupled to the cleaner station 100, the flow path switching valve 183 may disconnect the first flow path 181 from the dust collecting part 170 and connect the second flow path 182 to the dust collecting part 170.

As still another example, in a case in which both the first cleaner 200 and the second cleaner 300 are coupled to the cleaner station 100, the flow path switching valve 183 may connect the first flow path 181 to the dust collecting part 170 and disconnect the second flow path 182 from the dust collecting part 170 to remove the dust in the dust bin 220 of the first cleaner 200 first. Thereafter, the flow path switching valve 183 may disconnect the first flow path 181 from the dust collecting part 170 and connect the second flow path 182 to the dust collecting part 170 to remove the dust from the second cleaner 300. Therefore, it is possible to improve convenience in respect to the use of the first cleaner 200 manually manipulated by the user.

Meanwhile, the dust suction module 190 will be described below with reference to FIGS. 2 and 15 to 17.

The cleaner station 100 may include the dust suction module 190. The dust suction module 190 may include the dust collecting motor 191, a first filter 192, and a second filter (not illustrated).

The dust collecting motor 191 may be disposed below the dust collecting part 170. The dust collecting motor 191 may generate the suction force in the first flow path 181 and the second flow path 182. Therefore, the dust collecting motor 191 may provide the suction force capable of sucking the dust in the dust bin 220 of the first cleaner 200 and the dust in the second cleaner 300.

The dust collecting motor 191 may generate the suction force by means of the rotation. For example, the dust collecting motor 191 may be formed in a shape similar to a cylindrical shape.

The first filter 192 may be disposed between the dust collecting part 170 and the dust collecting motor 191. The first filter 192 may be a prefilter.

The second filter (not illustrated) may be disposed between the dust collecting motor 191 and the outer wall surface 112. The second filter (not illustrated) may be an HEPA filter.

Meanwhile, in the present embodiment, an imaginary balance maintaining space R1 may perpendicularly extend from the ground surface and penetrate the dust collecting part 170 and the dust suction module 190. For example, the balance maintaining space R1 may be an imaginary space perpendicularly extending from the ground surface, and the dust collecting motor 191 at least may be accommodated in the balance maintaining space R1. That is, the balance maintaining space R1 may be an imaginary cylindrical shape space that accommodates the dust collecting motor 191 therein.

Therefore, the centers of gravity of all the components disposed in the balance maintaining space R1 may be concentrated on the dust suction module 190. In this case, since the dust suction module 190 is disposed to be close to the ground surface, the cleaner station 100 may stably maintain the balance, like a roly-poly toy.

With this configuration, in the present disclosure, the cleaner station 100 may stably maintain the balance in the state in which the first cleaner 200 is mounted on the cleaner station 100.

The cleaner station 100 may include the charging part 128. The charging part 128 may be disposed on the coupling part 120. Specifically, the charging part 128 may be disposed on the coupling surface 121. In this case, the charging part 128 may be positioned at a position facing a charging terminal provided on the battery 240 of the first cleaner 200. The charging part 128 may be electrically connected to the first cleaner 200 coupled to the coupling part 120. The charging part 128 may supply power to the battery of the first cleaner 200 coupled to the coupling part 120. That is, when the first cleaner 200 is physically coupled to the coupling surface 121, the charging part 128 may be electrically coupled to the first cleaner 200.

In addition, the charging part 128 may include a lower charging part (not illustrated) disposed in a lower region of the housing 110. The lower charging part may be electrically connected to the second cleaner 300 coupled to the lower region of the housing 110. A second charger may supply power to the battery of the second cleaner 300 coupled to the lower region of the housing 110.

The cleaner station 100 may include a lateral door (not illustrated). The lateral door may be disposed in the housing 110. The lateral door may selectively expose the dust collecting part 170 to the outside. Therefore, the user may easily remove the dust collecting part 170 from the cleaner station 100.

Meanwhile, FIG. 17 is a block diagram for explaining a control configuration of the cleaner station according to the embodiment of the present disclosure.

The control configuration according to the present disclosure will be described below with reference to FIG. 17.

The cleaner station 100 according to the embodiment of the present disclosure may further include a control unit 400 configured to control the coupling part 120, the fixing unit 130, the door unit 140, the cover opening unit 150, the lever pulling unit 160, the dust collecting part 170, the flow path part 180, and the dust suction module 190.

The control unit 400 may be accommodated in the housing 110.

The control unit 400 may be disposed at the upper side in the housing 110. For example, the control unit 400 may be disposed on the coupling part 120. With this arrangement, the control unit 400, the fixing unit 130, the door unit 140, the cover opening unit 150, and the lever pulling unit 160 are disposed adjacent to one another, and as a result, response performance may be improved.

Otherwise, the control unit 400 may be disposed at the lower side in the housing 110. For example, the control unit 400 may be disposed in the dust suction module 190. With this arrangement, the control unit 400 may be disposed adjacent to the relatively heavy dust collecting motor 191 and disposed adjacent to the ground surface, such that the control unit 400 may be stably supported. As a result, it is possible to prevent damage to the control unit 400 even though external impact is applied to the control unit 400.

The control unit 400 may include a printed circuit board, and elements mounted on the printed circuit board.

The control unit 400 may determine whether the first cleaner 200 is coupled to the cleaner station 100.

When the first cleaner 200 is moved to the coupling part 120 by the user, the dust bin 220 or the battery housing 230 of the first cleaner 200 passes through a predetermined region in which the coupling sensor 125 may detect the first cleaner 200. For example, during the process of coupling the first cleaner 200 to the cleaner station 100, the battery housing 230 may come into contact with the coupling sensor 125, and the coupling sensor 125 may detect the first cleaner 200.

When the coupling sensor 125 detects the coupling of the first cleaner 200, the coupling sensor 125 may transmit a signal indicating that the first cleaner 200 is coupled to the coupling part 120. In this case, the control unit 400 may receive the signal from the coupling sensor 125 and determine that the first cleaner 200 is physically coupled to the coupling part 120.

Further, when the first cleaner 200 is coupled at the exact position on the coupling part 120, the lower surface of the dust bin 220 and the lower surface of the battery housing 230 may come into contact with the coupling surface 121, and the charging terminal of the charging part 128 and the charging terminal of the first cleaner 200 may come into contact with each other. In this case, power may be supplied to the battery 240 of the first cleaner 200 through the charging part 128.

Therefore, when the charging part 128 supplies power to the battery 240 of the first cleaner 200, the control unit 400 may determine that the first cleaner 200 is electrically coupled to the coupling part 120. Further, the control unit 400 may determine whether the charging part 128 supplies power to the battery 240 of the first cleaner 200 and check whether the cleaner 200 is coupled at the exact position based on the determination result.

In this case, the control unit 400 may generate a pulse signal by turning on or off a supply of charging voltage to the first cleaner 200 from the cleaner station 100. Therefore, the control unit 400 may transmit information to the first cleaner 200. For example, the control unit 400 may provide the first cleaner 100 with the information indicating that the first cleaner 100 is coupled to the cleaner station 100.

When the control unit 400 determines that the first cleaner 200 is coupled to the coupling part 120, the control unit 400 may operate the fixing part motor 133 to fix the first cleaner 200.

When the fixing members 131 or the fixing part links 135 are moved to the predetermined fixing point FP1, the fixing detecting part 137 may transmit a signal indicating that the first cleaner 200 is fixed. The control unit 400 may receive the signal, which indicates that the first cleaner 200 is fixed, from the fixing detecting part 137, and determine that the first cleaner 200 is fixed. When the control unit 400 determines that the first cleaner 200 is fixed, the control unit 400 may stop the operation of the fixing part motor 133.

Meanwhile, when the operation of emptying the dust bin 200 is ended, the control unit 400 may rotate the fixing part motor 133 in the reverse direction to release the first cleaner 200.

When the control unit 400 determines that the first cleaner 200 is fixed to the coupling part 120, the control unit 400 may operate the door motor 142 to open the door 141 of the cleaner station 100.

When the door 141 or the door arm 143 reaches the predetermined opened position DP1, the door opening/closing detecting part 144 may transmit a signal indicating that the door 141 is opened. The control unit 400 may receive the signal, which indicates that the door 141 is opened, from the door opening/closing detecting part 137 and determine that the door 141 is opened. When the control unit 400 determines that the door 141 is opened, the control unit 400 may stop the operation of the door motor 142.

Meanwhile, when the operation of emptying the dust bin 200 is ended, the control unit 400 may rotate the door motor 142 in the reverse direction to close the door 141.

When the control unit 400 determines that the door 141 is opened, the control unit 400 may operate the cover opening motor 152 to open the discharge cover 222 of the first cleaner 200. As a result, the dust passage hole 121*a* may communicate with the inside of the dust bin 220. Therefore, the cleaner station 100 and the first cleaner 200 may be coupled to each other to enable a flow of a fluid (coupling of the flow path).

When the guide frame 151*e* reaches the predetermined opened position CP1, the cover opening detecting part 155*f* may transmit a signal indicating that the discharge cover 222 is opened. The control unit 400 may receive the signal, which indicates that the discharge cover 222 is opened, from the cover opening detecting part 155*f* and determine that the discharge cover 222 is opened. When the control unit 400 determines that the discharge cover 222 is opened, the control unit 400 may stop the operation of the cover opening motor 152.

The control unit 400 may operate the stroke drive motor 163 and the rotation drive motor 164 to control the lever pulling arm 161 so that the lever pulling arm 161 may pull the dust bin compression lever 223.

When the arm movement detecting part 165 detects that the arm gear 162 reaches the maximum stroke movement position LP2, the arm movement detecting part 165 may transmit a signal, and the control unit 400 may receive the signal from the arm movement detecting part 165 and stop the operation of the stroke drive motor 163.

When the arm movement detecting part 165 detects that the arm gear 162 is rotated to the position at which the arm gear 162 may pull the compression lever 223, the arm movement detecting part 165 may transmit a signal, and the control unit 400 may receive the signal from the arm movement detecting part 165 and stop the operation of the rotation drive motor 164.

In addition, the control unit 400 may operate the stroke drive motor 163 in the reverse direction to pull the lever pulling arm 161.

In this case, when the arm movement detecting part 165 detects that the arm gear 162 reaches the position LP3 when the compression lever 223 is pulled, the arm movement detecting part 165 may transmit a signal, and the control unit 400 may receive the signal from the arm movement detecting part 165 and stop the operation of the stroke drive motor 163.

Meanwhile, when the operation of emptying the dust bin 200 is ended, the control unit 400 may rotate the stroke drive motor 163 and the rotation drive motor 164 in the reverse direction to return the lever pulling arm 161 to the original position.

The control unit 400 may operate the first joint drive part 174 and the second joint drive part 175 to join the roll vinyl film (not illustrated).

The control unit 400 may control the flow path switching valve 183 of the flow path part 180. For example, the control unit 400 may selectively open or close the first flow path 181 and the second flow path 182.

The control unit 400 may operate the dust collecting motor 191 to suck the dust in the dust bin 220.

The control unit 400 may operate a display unit 500 to display a dust bin emptied situation and a charged situation of the first cleaner 200 or the second cleaner 300.

A specific control process of the control unit 400 over time will be described below.

Meanwhile, the cleaner station 100 according to the present disclosure may include the display unit 500.

The display unit 500 may be disposed on the housing 110, disposed on a separate display device, or disposed on a terminal such as a mobile phone.

The display unit 500 may be configured to include at least any one of a display panel capable of outputting letters and/or figures and a speaker capable of outputting voice signals and sound. The user may easily ascertain a situation of a currently performed process, a residual time, and the like on the basis of information outputted through the display unit 500.

Meanwhile, FIG. 18 is a flowchart for explaining a method of controlling the cleaner station according to the embodiment of the present disclosure.

The method of controlling the cleaner station according to the embodiment of the present disclosure will be described below with reference to FIGS. 5 to 18.

The method of controlling the cleaner station according to the present disclosure includes the coupling checking step S10, the dust bin fixing step S20, the door opening step S30, the cover opening step S40, a dust bin compressing step S50, the dust collecting step S60, an additional dust bin compressing step S70, the dust collection ending step S80, the door closing step S90, a compression ending step S100, and the release step S110.

In the coupling checking step S10, whether the first cleaner 200 is coupled to the coupling part 120 of the cleaner station 100 may be checked.

Specifically, in the coupling checking step S10, when the first cleaner 200 is coupled, the coupling sensor 125 disposed on the guide protrusion 123 may come into contact with the battery housing 230, and the coupling sensor 125 may transmit a signal indicating that the first cleaner 200 is coupled to the coupling part 120. Alternatively, the coupling sensor 125 of a non-contact sensor type disposed on the sidewall 124 may detect the presence of the dust bin 220, and the coupling sensor 125 may transmit a signal indicating that the first cleaner 200 is coupled to the coupling part 120. Further, in the case in which the coupling sensor 125 is disposed on the dust bin guide surface 122, the dust bin 220 may push the coupling sensor 125 by means of the weight of the dust bin 220, the coupling sensor 125 may detect that the first cleaner 200 is coupled, and the coupling sensor 125 may transmit a signal indicating that the first cleaner 200 is coupled to the coupling part 120.

Therefore, in the coupling checking step S10, the control unit 400 may receive the signal generated by the coupling sensor 125 and determine that the first cleaner 200 is coupled to the coupling part 120.

Meanwhile, in the coupling checking step S10 according to the present disclosure, the control unit 400 may determine whether the first cleaner 200 is coupled at the exact position on the basis of whether the charging part 128 supplies power to the battery 240 of the first cleaner 200.

Therefore, in the coupling checking step S10, the control unit 400 may receive the signal, which indicates that the first cleaner 200 is coupled, from the coupling sensor 125, and check whether the charging part 128 supplies power to the battery 240, thereby checking whether the first cleaner 200 is coupled to the coupling part 120 of the cleaner station 100.

In the dust bin fixing step S20, when the first cleaner 200 is coupled to the cleaner station 100, the fixing member 130 may hold and fix the dust bin 200.

Specifically, when the control unit 400 receives the signal, which indicates that the first cleaner is coupled, from the coupling sensor 125, the control unit 400 may operate the fixing part motor 133 in the forward direction so that the fixing member 131 fixes the dust bin 220.

In this case, when the fixing member 131 or the fixing part link 135 is moved to the dust bin fixing position FP1, the first fixing detecting part 137*a* may transmit a signal indicating that the first cleaner 200 is fixed.

Therefore, the control unit 400 may receive the signal, which indicates that the first cleaner 200 is fixed, from the first fixing detecting part 137*a* and determine that the first cleaner 200 is fixed.

When the control unit 400 determines that the first cleaner 200 is fixed, the control unit 400 may stop the operation of the fixing part motor 133.

In the door opening step S30, when the dust bin 220 is fixed, the door 141 may be opened.

Specifically, when the control unit 400 receives the signal, which indicates that the dust bin 220 is fixed, from the first fixing detecting part 137*a*, the control unit 400 may operate the door motor 142 in the forward direction to open the dust passage hole 121*a*.

In this case, when the door arm 143 is moved to the opened position DP1 at which the first door opening/closing detecting part 144*a* is disposed, the first door opening/closing detecting part 144*a* may transmit a signal indicating that the door 141 is opened.

Therefore, the control unit 400 may receive the signal, which indicates that the door 141 is opened, from the first door opening/closing detecting part 144*a* and determine that the door 141 is opened.

When the control unit 400 determines that the door 141 is opened, the control unit 400 may stop the operation of the door motor 142.

In the cover opening step S40, when the door 141 is opened, the discharge cover 222 may be opened.

Specifically, when the control unit 400 receives the signal, which indicates that the door 141 is opened, from the first door opening/closing detecting part 144*a*, the control unit 400 may operate the cover opening motor 152 in the forward direction to open the discharge cover 222. That is, the discharge cover 222 may be separated from the dust bin main body 221.

When the guide frame 151*e* reaches the predetermined cover opened position CP1 at which the first cover opening detecting part 155*fa* is disposed, the cover opening detecting part 155*f* may transmit a signal indicating that the discharge cover 222 is opened.

In this case, the control unit 400 may receive the signal, which indicates that the discharge cover 222 is opened, from the first cover opening detecting part 155*fa* and determine that the discharge cover 222 is opened.

When the control unit 400 determines that the discharge cover 222 is opened, the control unit 400 may stop the operation of the cover opening motor 152.

In the dust bin compressing step S50, when the discharge cover 222 is opened, the inside of the dust bin 220 may be compressed.

The dust bin compressing step S50 may include a first compression preparing step S51, a second compression preparing step S52, and a lever pulling step S53.

In the first compression preparing step S51, the lever pulling arm 161 or 2161 may be stroke-moved to the height at which the lever pulling arm 161 or 2161 may push the dust bin compression lever 223.

Specifically, when the control unit 400 receives the signal, which indicates that the discharge cover 222 is opened, from the first cover opening detecting part 155*fa*, the control unit 400 may operate the stroke drive motor 163 or 2163 to move the lever pulling arm 161 or 2161 to a height equal to or higher than the height of the dust bin compression lever 223.

When the arm movement detecting part 165 or 2165 detects that the lever pulling arm 163 or 2163 is moved to the height equal to or higher than the height of the dust bin compression lever 223, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the maximum stroke movement position LP2. The control unit 400 may receive the signal from the arm movement detecting part 165 or 2165 and stop the operation of the stroke drive motor 163 or 2163.

In the second compression preparing step S52, the lever pulling arm 161 or 2161 may be rotated to the position at which the lever pulling arm 161 or 2161 may push the dust bin compression lever 223.

Specifically, when the control unit 400 receives the signal, which indicates that the lever pulling arm 163 or 2163 is moved to the height equal to or higher than the height of the dust bin compression lever 223, from the arm movement detecting part 165 or 2165, the control 2161 to the position at which the lever pulling arm 161 or 2161 may push the dust bin compression lever 223.

When the arm movement detecting part 165 or 2165 detects that the arm gear 162 or the shaft 2166 is rotated to the position at which the arm gear 162 or the shaft 2166 may pull the compression lever 223, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the lever pulling step S53, the lever pulling arm 161 or 2161 may pull the dust bin compression lever 223 at least once.

Specifically, after the second compression preparing step S52, the control unit 400 may operate the stroke drive motor 163 or 2163 in the reverse direction to pull the lever pulling arm 161 or 2161.

In this case, when the arm movement detecting part 165 or 2165 detects that the arm gear 162 or the shaft 2166 reaches the position LP3 when the compression lever 223 is pulled, the arm movement detecting part 165 or 2165 may transmit a signal indicating that the compression lever 223 is pulled. The control unit 400 may receive the signal from the arm movement detecting part 165 or 2165 and stop the operation of the stroke drive motor 163 or 2163.

In the dust bin compressing step S50, the dust in the dust bin 220 is compressed in advance before the dust collecting motor 191 operates, and as a result, there is an effect of preventing residual dust remaining in the dust bin 220 and improving efficiency in collecting the dust in the dust collecting motor 191.

In the dust collecting step S60, when the discharge cover 222 is opened and the inside of the dust bin 220 is compressed, the dust collecting motor 191 may operate to collect the dust from the dust bin 220.

Specifically, when the control unit 400 receives the signal, which indicates that the discharge cover 222 is opened, from the first cover opening detecting part 155*fa* and receives the signal, which indicates that the compression lever 223 is pulled, from the arm movement detecting part 165 or 2165, the control unit 400 may operate the dust collecting motor 191.

In the dust collecting step S60, the dust in the dust bin 220 may pass through the dust passage hole 121*a* and the first flow path 181 and then be collected in the dust collecting part 170. Therefore, the user may remove the dust in the dust bin 220 without a separate manipulation, and as a result, it is possible to provide convenience for the user.

In the additional dust bin compressing step S70, the inside of the dust bin 220 may be compressed during the operation of the dust collecting motor 191.

Specifically, after the lever pulling step S53, the control unit 400 may operate the stroke drive motor 163 or 2163 in the forward direction to move the lever pulling arm 161 or 2161 to the height LP2 before the dust bin compression lever 223 is pulled. In this case, the dust bin compression lever 223 is also returned to the original position by the elastic member (not illustrated).

That is, the arm movement detecting part 165 or 2165 may transmit the signal when the arm gear 162 or the shaft 2166 reaches the maximum stroke movement position LP2 again. The control unit 400 may receive the signal from the arm movement detecting part 165 or 2165 and stop the forward operation of the stroke drive motor 163 or 2163.

Thereafter, immediately after the dust collecting motor 191 operates or when a predetermined time has elapsed after the operation of the dust collecting motor 191, the control unit 400 may operate the stroke drive motor 163 or 2163 in the reverse direction to pull the dust bin compression lever 223.

Meanwhile, the additional dust bin compressing step S70 may be performed at least once. In this case, the number of times the additional dust bin compressing step S70 is performed may be preset, or the user may input the number of times through an input part (not illustrated). Alternatively, the control unit 400 may automatically set the number of times by detecting the amount of dust in the dust bin 220 using a sensor or the like.

In the additional dust bin compressing step S70, since the dust in the dust bin 220 is compressed during the operation of the dust collecting motor 191, there is an effect of removing the dust remaining even during the operation of the dust collecting motor 191.

In the dust collection ending step S80, the operation of the dust collecting motor 191 may be ended when the dust collecting motor 191 operates for a predetermined time.

Specifically, the control unit 400 may be embedded with a timer (not illustrated), and the operation of the dust collecting motor 191 may be ended when the control unit 400 determines that a predetermined time has elapsed.

In this case, the operating time of the dust collecting motor 191 may be preset, or the user may input the operating time through an input part (not illustrated). Alternatively, the control unit 400 may automatically set the operating time by detecting the amount of dust in the dust bin 220 using a sensor or the like.

In the door closing step S90, the door 141 may be closed after the dust collection ending step S80.

Specifically, after the control unit 400 stops the operation of the dust collecting motor 191, the control unit 400 may operate the door motor 142 in the reverse direction to close at least a part of the dust passage hole 121*a*. That is, in the door closing step S90, the operation of collecting dust from the dust bin 220 is ended, and then the door 141 may rotate to close the dust passage hole 121*a*. In this case, the discharge cover 222 supported by the door 141 may be rotated by the door 141 and fastened to the dust bin main body 221, such that the lower side of the dust bin main body 221 may be closed.

In this case, when the door arm 143 is moved to the closed position DP2 at which the second door opening/closing detecting part 144*b* is disposed, the second door opening/closing detecting part 144*b* may transmit a signal indicating that the door 141 is closed.

Therefore, the control unit 400 may receive the signal, which indicates that the door 141 is closed, from the second door opening/closing detecting part 144*b* and determine that the door 141 is closed.

When the control unit 400 determines that the door 141 is closed, the control unit 400 may stop the operation of the door motor 142.

With this configuration, after ending the operation of collecting dust from the dust bin 220, the cleaner station 100 may automatically close the door 141 of the cleaner station 100 and simultaneously close the discharge cover 222 of the dust bin 220 of the first cleaner 200. As a result, the cleaner station 100 may block the flow path connection between the flow path part 180 of the cleaner station 100 and the internal space of the dust bin 220.

In the compression ending step S100, the lever pulling arm may be returned back to the original position after the door closing step S90.

The compression ending step S100 may include a first returning step S101 and a second returning step S102.

In the first returning step S101, the lever pulling arm 163 or 2163 may be rotated to the original position.

Specifically, when the control unit 400 receives the signal, which indicates that the door 141 is closed, from the second door opening/closing detecting part 144*b*, the control unit 400 may operate the rotation drive motor 164 or 2164 in the reverse direction to move the lever pulling arm 161 or 2161 to the original position.

When the arm movement detecting part 165 or 2165 detects that the arm gear 162 or the shaft 2166 rotates the compression lever 223 to the original position, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the second returning step S102, the lever pulling arm 163 or 2163 may be stroke-moved to the original position.

Specifically, when the control unit 400 receives the signal indicating that the lever pulling arm 163 or 2163 is rotated to the target position, the control unit 400 may operate the stroke drive motor 163 or 2163 in the reverse direction to move the lever pulling arm 161 or 2161 to the original position (the position LP1 at which the lever pulling arm 161 or 2161 is coupled to the housing 110).

When the arm movement detecting part 165 or 2165 detects that the lever pulling arm 163 or 2163 is moved to the original position, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the initial position LP1. The control unit 400 may receive the signal from the arm movement detecting part 165 or 2165 and stop the operation of the stroke drive motor 163 or 2163.

In the release step S110, when the door 141 is closed, the fixing part motor 133 may be operated, such that the fixing member 131 may release the dust bin 220.

Specifically, when the control unit 400 receives the signal, which indicates that the arm gear reaches the initial position LP1, from the arm movement detecting part 165 or 2165, the control unit 400 may operate the fixing part motor 133 in the reverse direction to release the dust bin 220.

In this case, when the fixing member 131 or the fixing part link 135 is moved to the dust bin releasing position FP2, the second fixing detecting part 137*b* may transmit a signal indicating that the first cleaner 200 is released.

Therefore, the control unit 400 may receive the signal, which indicates that the first cleaner 200 is released, from the second fixing detecting part 137*b* and determine that the first cleaner 200 is released.

When the control unit 400 determines that the first cleaner 200 is released, the control unit 400 may stop the operation of the fixing part motor 133.

With this configuration, when the dust passage hole 121*a* are closed by the door 141 of the cleaner station 100 and the discharge cover 222 of the dust bin 220 is closed, the flow path connection between the flow path part 180 of the cleaner station 100 and the internal space of the dust bin 220 are blocked, such that the dust bin 220 may be released, and the user may separate the first cleaner 200 from the cleaner station 100.

Meanwhile, FIG. 19 is a flowchart for explaining a second embodiment of the method of controlling the cleaner station according to the present disclosure.

A method of controlling the cleaner station according to a second embodiment of the present disclosure will be described below with reference to FIGS. 5 to 19.

The method of controlling the cleaner station according to the present embodiment includes the coupling checking step S10, the dust bin fixing step S20, the door opening step S30, the cover opening step S40, the dust collecting step S60, a dust bin compressing step S70', the dust collection ending step S80, the door closing step S90, the compression ending step S100, and the release step S110.

In order to avoid a repeated description, the contents related to the method of controlling the cleaner station according to the foregoing embodiment of the present disclosure may be used to describe the coupling checking step S10, the dust bin fixing step S20, the door opening step S30, the cover opening step S40, the dust collection ending step S80, the door closing step S90, the compression ending step S100, and the release step S110 according to the second embodiment.

In the present embodiment, the dust collecting step S60 may be performed after the cover opening step S40.

Specifically, in the dust collecting step S60, when the discharge cover 222 is opened, the dust collecting motor 191 may operate to collect the dust from the dust bin 220.

Specifically, when the control unit 400 receives the signal, which indicates that the discharge cover 222 is opened, from the first cover opening detecting part 155*fa*, the control unit 400 may operate the dust collecting motor 191.

In the dust collecting step S60, the dust in the dust bin 220 may pass through the dust passage hole 121*a* and the first flow path 181 and then be collected in the dust collecting part 170. Therefore, the user may remove the dust in the dust bin 220 without a separate manipulation, and as a result, it is possible to provide convenience for the user.

In addition, in the dust bin compressing step S70' according to the present embodiment, the dust bin 220 may be compressed during the operation of the dust collecting motor 191.

The dust bin compressing step S70' may include a first compression preparing step S71', a second compression preparing step S72', a lever pulling step S73', and an additional pulling step S74'.

In this case, the first compression preparing step S71' and the second compression preparing step S72' may be performed after the operation of the dust collecting motor 191 or performed before the operation of the dust collecting motor 191.

In the first compression preparing step S71', the lever pulling arm 161 or 2161 may be stroke-moved to the height at which the lever pulling arm 161 or 2161 may push the dust bin compression lever 223.

Specifically, the control unit 400 may operate the stroke drive motor 163 or 2163 to move the lever pulling arm 161 or 2161 to a height equal to or higher than the height of the dust bin compression lever 223.

When the arm movement detecting part 165 or 2165 detects that the lever pulling arm 163 or 2163 is moved to the height equal to or higher than the height of the dust bin compression lever 223, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the maximum stroke movement position LP2. The control unit 400 may receive the signal from the arm movement detecting part 165 or 2165 and stop the operation of the stroke drive motor 163 or 2163.

In the second compression preparing step S72', the lever pulling arm 161 or 2161 may be rotated to the position at which the lever pulling arm 161 or 2161 may push the dust bin compression lever 223.

Specifically, when the control unit 400 receives the signal, which indicates that the lever pulling arm 163 or 2163 is moved to the height equal to or higher than the height of the dust bin compression lever 223, from the arm movement detecting part 165 or 2165, the control 2161 to the position at which the lever pulling arm 161 or 2161 may push the dust bin compression lever 223.

When the arm movement detecting part 165 or 2165 detects that the arm gear 162 or the shaft 2166 is rotated to the position at which the arm gear 162 or the shaft 2166 may pull the compression lever 223, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the lever pulling step S73', the lever pulling arm 161 or 2161 may pull the dust bin compression lever 223 at least once.

Specifically, after the second compression preparing step S72', the control unit 400 may operate the stroke drive motor 163 or 2163 in the reverse direction to pull the lever pulling arm 161 or 2161.

In this case, when the arm movement detecting part 165 or 2165 detects that the arm gear 162 or the shaft 2166 reaches the position LP3 when the compression lever 223 is pulled, the arm movement detecting part 165 or 2165 may transmit a signal indicating that the compression lever 223 is pulled. The control unit 400 may receive the signal from the arm movement detecting part 165 or 2165 and stop the operation of the stroke drive motor 163 or 2163.

In the additional pulling step S74', the lever pulling arm 161 or 2161 may additionally pull the dust bin compression lever 223.

In this case, whether to perform the additional pulling step S74' and the number of times the additional pulling step S54' is performed may be preset, or the user may input, through an input part (not illustrated), whether to perform the additional pulling step S54' and the number of times the additional pulling step S54' is performed. Alternatively, the control unit 400 may detect the amount of dust in the dust bin 220 using a sensor or the like and automatically set whether to perform the additional pulling step S54' and the number of times the additional pulling step S54' is performed.

After the lever pulling step S73', the control unit 400 may operate the stroke drive motor 163 or 2163 in the forward direction to move the lever pulling arm 161 or 2161 to the height LP2 before the dust bin compression lever 223 is pulled. In this case, the dust bin compression lever 223 is also returned to the original position by the elastic member (not illustrated).

That is, the arm movement detecting part 165 or 2165 may transmit the signal when the arm gear 162 or the shaft 2166 reaches the maximum stroke movement position LP2 again. The control unit 400 may receive the signal from the arm movement detecting part 165 or 2165 and stop the forward operation of the stroke drive motor 163 or 2163.

Thereafter, immediately after the dust collecting motor 191 operates or when a predetermined time has elapsed after the operation of the dust collecting motor 191, the control unit 400 may operate the stroke drive motor 163 or 2163 in the reverse direction to pull the dust bin compression lever 223.

According to the present embodiment, since the dust bin compression lever 223 is pulled an appropriate number of times during the operation of the dust collecting motor 191, there is an effect of reducing the time it takes to empty the dust bin 220.

Meanwhile, FIG. 20 is a flowchart for explaining a third embodiment of the method of controlling the cleaner station according to the present disclosure.

A method of controlling the cleaner station according to a third embodiment of the present disclosure will be described below with reference to FIGS. 5 to 20.

The method of controlling the cleaner station according to the present embodiment includes the coupling checking step S10, the dust bin fixing step S20, the door opening step S30, the cover opening step S40, a dust bin compressing step S50', the dust collecting step S60, the dust collection ending step S80, the door closing step S90, the compression ending step S100, and the release step S110.

In order to avoid a repeated description, the contents related to the method of controlling the cleaner station according to the foregoing embodiment of the present disclosure may be used to describe the coupling checking step S10, the dust bin fixing step S20, the door opening step S30, the cover opening step S40, the dust collection ending step S80, the door closing step S90, the compression ending step S100, and the release step S110 according to the third embodiment.

The dust bin compressing step S50' may include a first compression preparing step S51', a second compression preparing step S52', a lever pulling step S53', and an additional pulling step S54'.

In the first compression preparing step S51', when the control unit 400 receives a signal, which indicates that the discharge cover 222 is opened, from the first cover opening detecting part 155*fa*, the control unit 400 may stroke-move the lever pulling arm 161 or 2161 to the height at which the lever pulling arm 161 or 2161 may push the dust bin compression lever 223.

Specifically, the control unit 400 may operate the stroke drive motor 163 or 2163 to move the lever pulling arm 161 or 2161 to a height equal to or higher than the height of the dust bin compression lever 223.

When the arm movement detecting part 165 or 2165 detects that the lever pulling arm 163 or 2163 is moved to the height equal to or higher than the height of the dust bin compression lever 223, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the maximum stroke movement position LP2. The control unit 400 may receive the signal from the arm movement detecting part 165 or 2165 and stop the operation of the stroke drive motor 163 or 2163.

In the second compression preparing step S52', the lever pulling arm 161 or 2161 may be rotated to the position at which the lever pulling arm 161 or 2161 may push the dust bin compression lever 223.

Specifically, when the control unit 400 receives the signal, which indicates that the lever pulling arm 163 or 2163 is moved to the height equal to or higher than the height of the dust bin compression lever 223, from the arm movement detecting part 165 or 2165, the control unit 400 may operate the rotation drive motor 164 or 2164 to move the lever pulling arm 161 or 2161 to the position at which the lever pulling arm 161 or 2161 may push the dust bin compression lever 223.

When the arm movement detecting part 165 or 2165 detects that the arm gear 162 or the shaft 2166 is rotated to the position at which the arm gear 162 or the shaft 2166 may pull the compression lever 223, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the lever pulling step S53', the lever pulling arm 161 or 2161 may pull the dust bin compression lever 223 at least once.

Specifically, after the second compression preparing step S52', the control unit 400 may operate the stroke drive motor 163 or 2163 in the reverse direction to pull the lever pulling arm 161 or 2161.

In this case, when the arm movement detecting part 165 or 2165 detects that the arm gear 162 or the shaft 2166 reaches the position LP3 when the compression lever 223 is pulled, the arm movement detecting part 165 or 2165 may transmit a signal indicating that the compression lever 223 is pulled. The control unit 400 may receive the signal from the arm movement detecting part 165 or 2165 and stop the operation of the stroke drive motor 163 or 2163.

In the additional pulling step S54', the lever pulling arm 161 or 2161 may additionally pull the dust bin compression lever 223.

In this case, whether to perform the additional pulling step S54' and the number of times the additional pulling step S54' is performed may be preset, or the user may input, through an input part (not illustrated), whether to perform the additional pulling step S54' and the number of times the additional pulling step S54' is performed. Alternatively, the control unit 400 may detect the amount of dust in the dust bin 220 using a sensor or the like and automatically set whether to perform the additional pulling step S54' and the number of times the additional pulling step S54' is performed.

After the lever pulling step S53', the control unit 400 may operate the stroke drive motor 163 or 2163 in the forward direction to move the lever pulling arm 161 or 2161 to the height LP2 before the dust bin compression lever 223 is pulled. In this case, the dust bin compression lever 223 is also returned to the original position by the elastic member (not illustrated).

That is, the arm movement detecting part 165 or 2165 may transmit the signal when the arm gear 162 or the shaft 2166 reaches the maximum stroke movement position LP2 again. The control unit 400 may receive the signal from the arm movement detecting part 165 or 2165 and stop the forward operation of the stroke drive motor 163 or 2163.

Thereafter, immediately after the dust collecting motor 191 operates or when a predetermined time has elapsed after the operation of the dust collecting motor 191, the control unit 400 may operate the stroke drive motor 163 or 2163 in the reverse direction to pull the dust bin compression lever 223.

In the present embodiment, the dust collecting step S60 is performed after the dust bin compressing step S50'.

Therefore, in the dust collecting step S60, when the discharge cover 222 is opened and the inside of the dust bin 220 is compressed a preset number of times, the dust collecting motor 191 may operate to collect the dust from the dust bin 220.

According to the present embodiment, since the dust collecting motor 191 operates after the dust bin compression lever 223 is pulled an appropriate number of times, there is an effect of reducing the time it takes to empty the dust bin 220.

Meanwhile, FIG. 21 is a flowchart for explaining a fourth embodiment of the method of controlling the cleaner station according to the present disclosure.

A method of controlling the cleaner station according to a fourth embodiment of the present disclosure will be described below with reference to FIGS. 5 to 21.

The method of controlling the cleaner station according to the present embodiment includes the coupling checking step S10, the dust bin fixing step S20, the door opening step S30, the cover opening step S40, the dust collecting step S60, the dust collection ending step S80, the door closing step S90, the compression ending step S100, and the release step S110.

The present embodiment may be applied when the first cleaner having no dust bin compression lever 223 is coupled to the cleaner station 100 or when the dust bin needs to be quickly emptied.

Whether to apply the present embodiment may be set in advance or inputted by the user through an input part (not illustrated). Alternatively, whether to apply the present embodiment may be automatically set by the control unit 400 on the basis of whether the dust bin compression lever 223 is present which is detected by a sensor or the like.

In the present embodiment, the step of compressing the dust bin 220 is excluded, which makes it possible to most quickly empty the dust bin 220.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

DESCRIPTION OF REFERENCE NUMERALS

10: Cleaner system
100: Cleaner station
110: Housing
120: Coupling part
121: Coupling surface
121*a*: Dust passage hole
130: Fixing unit
131: Fixing member
133: Fixing part motor
134: Fixing part gear
135: Fixing part link
140: Door unit
141: Door
142: Door motor
143: Door arm
150: Cover opening unit
151: Push protrusion
152: Cover opening motor
153: Cover opening gear
154: Gear box
160: Lever pulling unit
161: Lever pulling arm
162: Arm gear
163: Stroke drive motor
164: Rotation drive motor
170: Dust collecting part
180: Flow path part
181: First flow path
182: Second flow path
183: Flow path switching valve
190: Dust suction module
191: Dust collecting motor
200: First cleaner
210: Main body
212: Suction part
213: Dust separating part
214: Suction motor
216: Handle
220: Dust bin
222: Discharge cover
222*c*: Coupling lever
223: Dust bin compression lever
230: Battery housing
240: Battery
250: Extension tube
260: Cleaning module
300: Second cleaner
400: Control unit

The invention claimed is:

1. A cleaner station comprising:

a housing;

a coupling part disposed in the housing and including a coupling surface to which at least a part of a cleaner is coupled;

a dust collecting part accommodated in the housing, disposed below the coupling part, and configured to capture dust in a dust bin of the cleaner;

a dust collecting motor accommodated in the housing, disposed below the dust collecting part, and configured to generate a suction force for sucking the dust in the dust bin;

a fixing unit disposed on the coupling part and configured to fix the cleaner; and a control unit accommodated in the housing and configured to control the dust collecting motor, wherein the fixing unit comprises:

a fixing member configured to move from outside of the dust bin toward the dust bin to fix the dust bin when at least a part of the cleaner is coupled to the coupling part; and a fixing part motor configured to provide power for moving the fixing member, and wherein the fixing part motor operates to move the fixing member when at least a part of the cleaner is coupled at an exact position on the coupling part.

2. The cleaner station of claim 1, further comprising:

a door unit comprising a door hingedly coupled to the coupling surface and configured to open or close a dust passage hole formed in the coupling surface.

3. The cleaner station of claim 2, wherein the door unit comprises a door motor configured to provide power for rotating the door, and wherein the door motor operates to rotate the dust passage hole by rotating the door when the dust bin is fixed.

4. The cleaner station of claim 3, wherein the door motor operates after the operation of the dust collecting motor is ended.

5. The cleaner station of claim 3, wherein the fixing part motor operates when the door closes the dust passage hole.

6. The cleaner station of claim 1, further comprising:

a cover opening unit disposed on the coupling part and configured to open a discharge cover of the dust bin, wherein the cover opening unit comprises:

a push protrusion configured to move when the first cleaner is coupled; and a cover opening motor configured to provide power for moving the push protrusion.

7. The cleaner station of claim 1, further comprising:

a lever pulling unit comprising a lever pulling arm accommodated in the housing and configured to stroke-move and rotate to pull a dust bin compression lever of the first cleaner, wherein the lever pulling unit comprises a stroke drive motor configured to provide power for stroke-moving the lever pulling arm.

8. The cleaner station of claim 7, wherein the lever pulling unit further comprises a rotation drive motor disposed in the housing and configured to provide power for rotating the lever pulling arm, and wherein the rotation drive motor operates when the lever pulling arm is moved to a height equal to or higher than a height of the dust bin compression lever.

9. The cleaner station of claim 7, wherein the stroke drive motor operates to allow the lever pulling arm to pull the dust bin compression lever when the lever pulling arm is moved to a position at which the lever pulling arm pushes the dust bin compression lever.

10. The cleaner station of claim 7, wherein the stroke drive motor operates at least once while the dust collecting motor operates.

11. A method of controlling a cleaner station, the method comprising:

a dust bin fixing step of holding and fixing, by a fixing member of the cleaner station, a dust bin of a first cleaner when the first cleaner is coupled to the cleaner station;

a door opening step of opening a door of the cleaner station when the dust bin is fixed;

a discharge cover opening step of opening a discharge cover configured to open or close the dust bin when the door is opened; and a dust collecting step of collecting dust in the dust bin by operating a dust collecting motor of the cleaner station when the discharge cover is opened, wherein the dust bin fixing step includes the fixing member moving from outside of the dust bin toward the dust bin to fix the dust bin.

12. The method of claim 11, further comprising:

a dust bin compressing step of compressing an inside of the dust bin when the discharge cover is opened.

13. The method of claim 12, wherein the dust bin compressing step comprises:

a first compression preparing step of stroke-moving a lever pulling arm of the cleaner station to a height at which the lever pulling arm pushes a dust bin compression lever of the first cleaner;

a second compression preparing step of rotating the lever pulling arm to a position at which the lever pulling arm pushes the dust bin compression lever; and a lever pulling step of pulling, by the lever pulling arm, the dust bin compression lever at least once after the second compression preparing step.

14. The method of claim 13, further comprising:

a compression ending step of returning the lever pulling arm to an original position after the dust bin compressing step.

15. The method of claim 14, wherein the compression ending step comprises:

a first returning step of rotating the lever pulling arm to the original position; and a second returning step of stroke-moving the lever pulling arm to the original position.

16. The method of claim 12, wherein the dust bin compressing step is performed during the operation of the dust collecting motor.

17. The method of claim 12, wherein the dust collecting step is performed after the dust bin compressing step.

18. The method of claim 11, further comprising:

a coupling checking step of checking whether the first cleaner is coupled to a coupling part of the cleaner station.

19. The method of claim 11, further comprising:

a door closing step of closing the door after the dust collecting step.

20. The method of claim 19, further comprising:

a release step of releasing the dust bin after the door closing step.

* * * * *